United States Patent [19]

Shane et al.

[11] 4,223,893

[45] Sep. 23, 1980

[54] ELECTRONIC GAME

[75] Inventors: Tim A. Shane, Cleveland Heights, Ohio; Gary J. O'Hara, Ann Arbor, Mich.

[73] Assignee: Tryom, Inc., Cleveland, Ohio

[21] Appl. No.: 630,913

[22] Filed: Nov. 11, 1975

[51] Int. Cl.[3] ..... A63F 3/02

[52] U.S. Cl. ..... 273/237; 273/138 A

[58] Field of Search ..... 273/1 E, 130 AB, 131 A, 273/134 A, 135 A, 136 A, 138 A, 54 C; 235/92 GA; 340/323 R, 172.5, 324 R, 324 AD; 445/1

[56] References Cited

U.S. PATENT DOCUMENTS

| | | | |
|---|---|---|---|
| D. 238,289 | 12/1975 | Regensburg | 273/136 H X |
| 3,189,888 | 6/1965 | Bradley | 340/323 R |
| 3,654,392 | 4/1972 | Beinhocker et al. | 273/136 A |
| 3,778,058 | 12/1973 | Rausch | 273/85 R |
| 3,874,669 | 4/1975 | Ariano et al. | 273/DIG. 28 X |
| 3,888,491 | 6/1975 | Bernard et al. | 273/136 A |
| 3,902,723 | 9/1975 | Colling et al. | 273/1 E |
| 4,019,745 | 4/1977 | Mustelier | 273/136 A |
| 4,026,555 | 5/1977 | Kirschner et al. | 273/85 R |

OTHER PUBLICATIONS

*Popular Science;* "Games Computers Play"; vol. 197, No. 4; Oct., 1970; p. 44.

*101 Basic Computer Games;* "Mnoply"; Digital Equipment Corp., 1975; pp. 1, 2, 153–155.

*Electronics;* "Scamp Microprocessor Aims to Replace Mechanical Logic"; Sep. 18, 1975; pp. 81–87.

*Primary Examiner*—Vance Y. Hum

*Attorney, Agent, or Firm*—Arnold, White & Durkee

[57] ABSTRACT

An electronic backgammon game includes an illuminated display which is energized utilizing a microprocessor programmed according to the rules of the game of backgammon. The display includes pictorial representations of pips of a backgammon board, and first, second, and third sets of electrically responsive visual indicators. The first set of visual indicators manifest a substantially randomly determined chance value, the second set of visual indicators indicates the occupancy of a given pip during the play of the game, and the third set of indicators indicates which contestant is to enter the next in sequence play instruction. The microprocessor energizes the third set of indicators according to a value given by the first set of indicators to indicate which contestant is to enter the first instruction. The microprocessor utilizes memory for storing the previous occupancy states of the pips during the entry of subsequent play instructions and selectively energizes the second set of visual indicators to indicate the previous occupancy state of at least one of the pips when so commanded during subsequent play instructions.

13 Claims, 41 Drawing Figures

60
86
START GAME
X7
X6
X5
X4
76
I REFUSE
80
BEAR OFF
82
RE-MOVE
84
FINALIZE
78
I ACCEPT
70
A's BAR
68
B's BAR
72
ROLL DICE
74
I DOUBLE
64
66
(TO CPU 240)
DATA READY
110
TO BUFFER 63 PBO-PB7
DATA OUT
ENCODER 62
Xi
Yj
PIP 1
PIP 2
PIP 3
PIP 4
PIP 5
PIP 6
PIP 7
PIP 8
PIP 9
PIP 10
PIP 11
PIP 12
PIP 13
PIP 14
PIP 15
PIP 16
PIP 17
PIP 18
PIP 19
PIP 20
PIP 21
PIP 22
PIP 23
PIP 24
Y0
Y1
Y2
Y3
Y4
Y5
Y6
Y7
Y8
Y9
61

| MEMORY WORD → | 2 | 6 | 10 | 14 | 18 | 22 | 26 | 30 |
|---|---|---|---|---|---|---|---|---|
| COLUMN → | 0 | 1 | 2 | 3 | 4 | 5 | 6 | 7 |
| ROW 7 | A's CUBE STATUS INDICATOR | B's CUBE STATUS INDICATOR | | | | | | |
| ROW 6 | | | | | | | | |
| ROW 5 | | | | | | | | |
| ROW 4 | PIP 18 | PIP 17 | PIP 16 | PIP 15 | PIP 14 | PIP 13 | PLAYER A 7-SEGMENT SCORE HIGH ORDER DIGIT | PLAYER A 7-SEGMENT SCORE LOW ORDER DIGIT |
| ROW 3 | | | | | | | | |
| ROW 2 | | | | | | | | |
| ROW 1 | | | | | | | | |

Fig. 9c

| MEMORY WORD → | 3 | 7 | 11 | 15 | 19 | 23 | 27 | 31 |
|---|---|---|---|---|---|---|---|---|
| COLUMN → | 0 | 1 | 2 | 3 | 4 | 5 | 6 | 7 |
| ROW 7 | — | — | — | — | — | — | | |
| ROW 6 | | | | | | | | |
| ROW 5 | | | | | | | | |
| ROW 4 | PIP 24 | PIP 23 | PIP 22 | PIP 21 | PIP 20 | PIP 19 | PLAYER B 7-SEGMENT SCORE HIGH ORDER DIGIT | PLAYER B 7-SEGMENT SCORE LOW ORDER DIGIT |
| ROW 3 | | | | | | | | |
| ROW 2 | | | | | | | | |
| ROW 1 | | | | | | | | |

Fig. 9d

ELECTRONIC GAME

BACKGROUND OF THE INVENTION

The present invention relates to electronic games involving chance, and more specifically to a method and apparatus for electronically playing the game of backgammon.

Games of chance historically have required several types of apparatus. In some games, a playing board is required which usually is configured with a pattern having game significance. Playing pieces are usually associated with the playing board, and their coaction with the board during play is often determined by instruments of chance, such as dice or cards, and by the skill of contestants playing the game. Scorekeeping apparatus is often required at least for keeping a tally of the winners of a sequence of games.

Use of such apparatus has restricted versatility of the games. Care had to be exercised in order that pieces of the required apparatus were not lost. The game had to be played in a suitable environment which would allow viewing of the board and pieces during play by the contestants, and which would not disturb status of the playing pieces on the board. These conditions often were not conducive for a large number of spectators to view the play of the game. For example, a stable horizontal support was usually required for the playing board in order to minimize disturbances to the playing pieces. Since both contestants and spectators had to gather around the support to view the playing board, only a limited number of spectators could be accommodated.

Another restriction on versatility was imposed by the mechanical nature of the coaction between the playing pieces and the board. Because of the mechanical relationship, such games of chance have been suitable only for play by human contestants, obviating the possibility of computerized play.

Still another restriction on versatility was imposed by the nature of the play of the game. The sequence of play and options available to the contestants often alternate between contestants. Either special, manually actuated, status indicating apparatus has been utilized for keeping track of the play sequence, or the contestants, when needed, have reminded each other whose turn was awaited. Because such games of chance are usually fast-moving, expert play is effected only through concentration. The latter alternative may interrupt the necessary concentration; the former requires the nuisance of additional apparatus.

The logistics of play also posed inconveniences. Often the consequence of one play resulted in movement of one playing piece to another predetermined location, either on or off the board. This required extra effort on the part of the contestants as well as delayed play of the game. Similarly, other such consequential play, such as scorekeeping and determining which contestant was entitled to the first move, often had to be performed by the contestants.

Yet other inconveniences were encountered. If a contestant entered a play which he later wished to cancel, or a play which was disallowed by the rules of the game, the board had to be restored to the previous status. This necessitated not only accurate recall of the previous status, but performance by a contestant in restoring the previous status.

Some of the described drawbacks of prior games have been overcome by the use of electronic displays for representing the playing board and the playing pieces as they associate with the playing board. These prior electronic games, however, have utilized indicating mechanisms which required separate inputs from the contestants each time the electronic display was to be changed. Accordingly, these electronic games have alleviated the described problems only to the extent achieved by removal of the mechanical nature of the coaction between the playing pieces and the playing board.

SUMMARY OF THE INVENTION

The present invention provides electronic apparatus having a display comprising electronically operated indicators which represents both an element of chance and the results of plays input by contestants in response to a given element of chance. The invention obviates any need for separate chance providing apparatus, for separate playing pieces, or for separate status indicating apparatus. Disallowed plays are routinely detected, and the display is automatically restored upon entry of a disallowed play. The electronic apparatus also is versatilely adapted to be connected to a computerized system for play as one or both contestants.

In accordance with the invention, the electronic apparatus includes a display having a plurality of visually perceivable electrical indicators, an input mechanism for receiving play instructions, and an energizing mechanism for operating selected ones of indicators. A first group of the indicators (referred to as the chance indicators) is arranged on the display to represent a chance value having a magnitude selected from a predetermined range of values. A second group of the indicators (referred to as the play indicators) is arranged on the display to represent a play value based in part on their location on the display and in part on their operative states. The play value is the result of play instructions input by contestants and thereby indicates the ongoing status of the game during play.

According to one aspect of the invention, the display includes a third group of electrically responsive visual indicators which are associated with respective indicators of the second group. The indicators of the second and third groups provide, when operated, a pair of the play values each of which is respectively based on the location and operation state of indicators of each group.

According to another aspect of the invention, the indicators of the second group are arranged in a predetermined path to simulate all possible positions of assumed playing pieces along the path. The indicators are operated to represent occupancy by the assumed playing pieces of the various positions along the path, and the play value is based in part on the occupancies of the positions along the path.

According to another aspect of the invention, the input mechanism includes a set of manually actuated switches and set of input terminals. The manually actuated switches allow play instructions to be input mechanically, and the input terminals allow play instructions to be input in the form of electrical signals from, for example, an electronic source. This feature accords capability for the game to be played by human contestants, by a computerized system, or by both a human contestant and a computerized system.

In accordance with yet another aspect of the invention, the energizing mechanism includes a display value storage unit. The display value storage unit is operably coupled to the display for sequentially storing the play values as they are manifested. Upon certain predeterminable conditions, after a play instruction has provisionally altered a play value manifested on the display, the display is restored to the previous play value which is stored in the display value storage unit. This feature is particularly advantageous when a contestant wishes to cancel a previously input play instruction and to submit another play instruction.

According to another feature of the invention, the energizing mechanism includes a programmable controller. The programmable controller is conditioned to perform a multitude of operations which contestants of the game otherwise would have to perform. For example, the programmable controller is programmed to provide a validation mechanism. According to this feature it is conditioned to monitor the chance values and the play values and to determine whether a subsequently input play instruction is allowable according to rules of the game. The programmable controller is also programmed to detect predetermined relationships between the play values and to perform consequential operations. For example, if the relationship between the play values indicates that an assumed playing piece is to be removed from the board, the programmable controller automatically causes the indicators at the proper locations to be operated to simulate this consequence. As another example, if the relationship between the play values indicates that a game is terminated, the programmable controller automatically detects the termination and automatically adjusts scorekeeping apparatus by a proper value. The controller is also conditioned to keep track of the input sequence of the play instructions for conditioning the display to indicate to contestants whose play instructions should next be input.

As another feature of the energizing means, the programmable controller operates in conjunction with the display value storage unit for automatically restoring a previous play value whenever a subsequent play instruction has been input which is disallowed for a given chance value and play value. This obviates the need for continuous recall of past play values and for manual restoration of the status of the game to the previous value.

In the preferred embodiment, the electronic game is backgammon, and the play values represent occupancy conditions of backgammon PIPS as represented by the play indicators. The play indicators are arranged in association with triangular-shaped indicia on the display to represent the backgammon PIPS. The chance indicators are portrayed in association with indicia on the display to simulate a roll of dice. The chance indicators and the play indicators are respectively operated by play instructions which are input in the form of chance requests and move instructions.

The programmable controller and the display value storage unit allow consequential operations to be performed automatically and nearly simultaneously with the input of each move instruction. For example, the programmable controller, which is conditioned to determine all allowable move instructions for a given set of occupancy conditions on the display (the display value) and for a given chance value, automatically restores the display to the previous occupancy condition upon the input of a disallowed move instruction. As another example applicable to backgammon, the programmable controller operates the play indicators to represent removal of a playing piece from a given location, due to a "hit," and to represent the reassignment of the "hit" playing piece to a new location (termed the BAR). As yet another example, the programmable controller is conditioned to monitor the play values at the termination of the game and to automatically increment a set of scorekeeping indicators. In backgammon the indicators are changed by values of magnitude 1, 2, or 3 depending on whether the degree of victory was a "regular" win, a "gammon," or a "backgammon." Also, upon the initial entry of a chance request, the programmable controller is conditioned to operate a group of indicators for informing the contestant who is to play the first move instruction.

In addition to the programmable controller and the display value storage unit, the energizing mechanism includes a decoder driver unit and a display driver storage unit. The decoder driver unit takes the form of a plurality of display registers which are coupled to the display storage unit for receiving a sequence of multibit display words and operating the appropriate indicators according to the display words. The multibit display words are generated by the controller and stored in the display driver storage unit for subsequent transmission to the decoder driver unit.

The programmable controller is coupled to both the input mechanism and to the display driver storage unit for updating the display driver storage unit according to the type of play instruction input. If a chance request is input, the programmable controller provides a substantial randomly determined value and writes this value into appropriate storage locations in the display driver storage unit. If a move instruction is input, the programmable controller evaluates the move instruction and correspondingly updates the display storage unit according to whether the move is an allowable move. The programmable controller also updates status information contained in the display driver storage unit according to the rules of the game.

As another feature of the preferred embodiment, the display includes a set of indicators which represent a DOUBLING CUBE and its operation. The programmable controller is conditioned to monitor and cause indication of (1) the current value of the DOUBLING CUBE, and (2) which contestant has the right to proffer a challenge for doubling the stakes for which the game is being played.

As still another feature of the preferred embodiment, the indicators assigned to each backgammon PIP are disposed in a pair of linear arrays respectively assigned to each contestant. The programmable controller is conditioned to automatically enable operation of only the array assigned to the contestant, and then to enter his move instruction. Each move instruction comprises a pair of sequentially input entries. In response to the first entry, the controller initially causes a unitary decrease in the number of operated indicators of the enabled linear array, thereby decreasing by one the represented occupancy of the associated PIP. Upon the second entry, the controller enables the appropriate linear array at another PIP location and causes the number of operated indicators at that location to increase by one. The programmable controller advantageously ensures that for every decrease in the number of operated indicators, there is a corresponding increase at another location, thereby obviating the possibility that a playing piece may be removed from play inadvertently.

Accordingly, it is a general object of the present invention to provide a novel and improved method and apparatus for electronically playing a game whose play is based in part on chance.

Other objects and features of the present invention will become apparent upon a reading of a detailed description of a preferred embodiment of the invention in conjunction with the accompanying drawings.

BRIEF DESCRIPTION OF THE DRAWINGS

FIGS. 9*a–d* are diagrams showing memory location assignments in a display storage unit of FIG. 3;

DETAILED DESCRIPTION OF A PREFERRED EMBODIMENT

Figure 1:
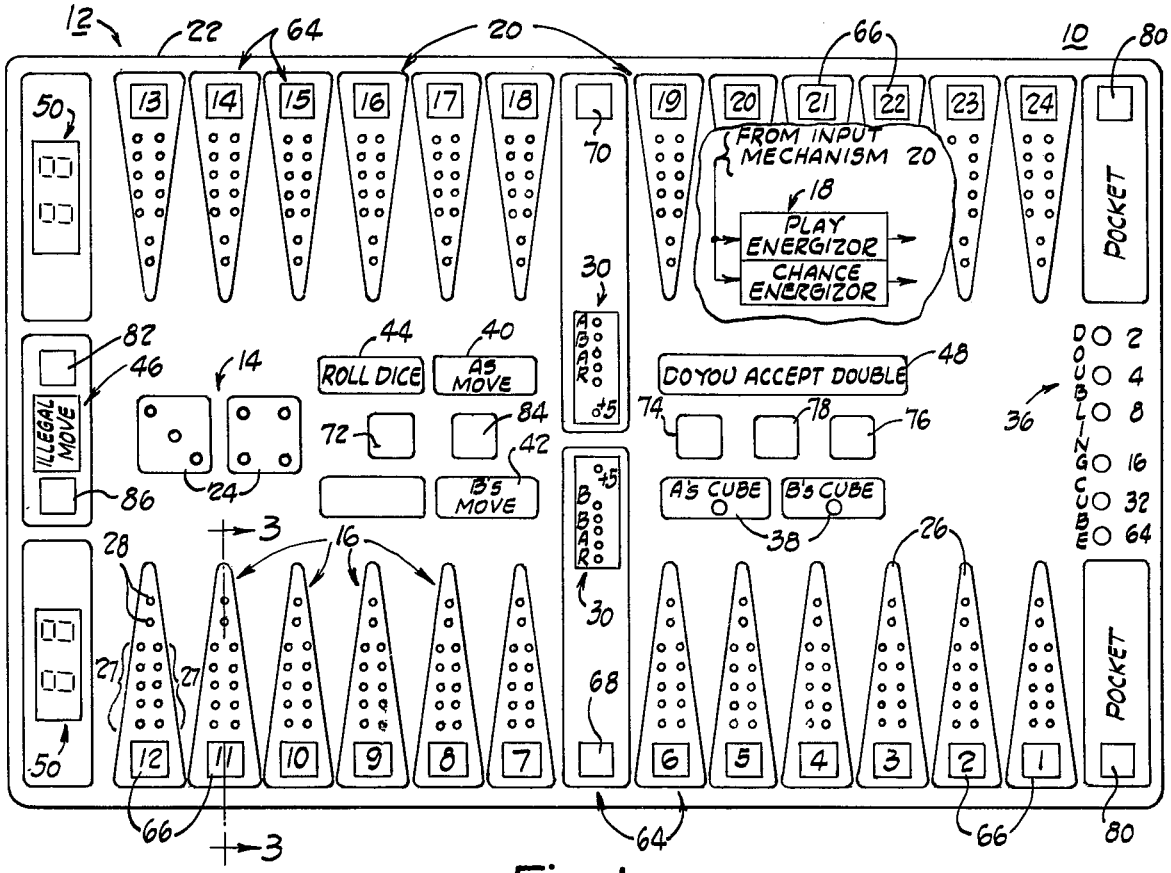
FIG. 1 is a plan view of the display of the electronic game of chance having a cutaway section functionally showing a coupling mechanism and a signal generator.

A plan view of gaming apparatus 10 in which play is partially controlled by chance is shown in FIG. 1. The apparatus 10 includes a display 12 having at least first and second pluralities of visually perceivable electrical indicators 14, 16, respectively. An energizing mechanism 18 and an input mechanism 20 are provided for operating selected ones of the first and second pluralities of electrical indicators. The first plurality of electrical indicators 14 is operated to provide randomly determined CHANCE VALUES which are utilized in determining which indicators 16 of the second plurality are to be operated. The indicators 14 of the first plurality are referred to as CHANCE indicators. The second plurality of indicators 16 are located on the display 12 to have positional significance in the game. When operated, they manifest a PLAY VALUE by virtue of their location. These indicators 16 are referred to as PLAY indicators. The PLAY VALUE results from play instructions input via the input mechanism 20, e.g., by contestants, and indicates the ongoing status of the game during play.

Figure 2:
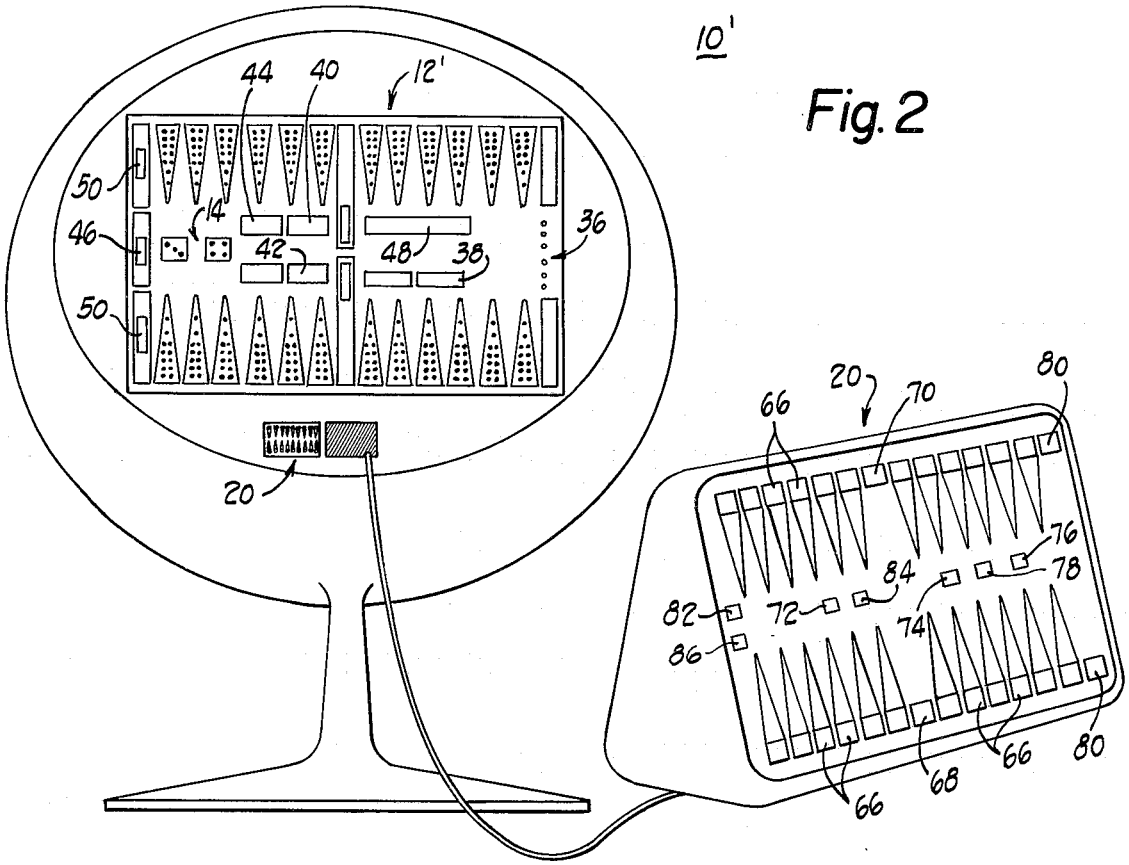
FIG. 2 is a perspective view of another embodiment of the electronic game having remote control capabilities.

The apparatus 10 is comprised of a portable housing structure 22, one surface of which includes the display 12. The energizing mechanism 18 and the input mechanism 20 may either be attached to the housing structure 22 as illustrated diagrammatically in FIG. 1 or may be removably coupled to the housing structure 22 to provide remote control capability as shown in FIG. 2. The apparatus 10' shown in FIG. 2 has a display 12' of large dimensions for accommodating spectator viewing relatively. The apparatus 10 of FIG. 1 is of low power consumption and is well-suited for operation by batteries (not shown) contained within the housing structure 22.

In the preferred embodiment, the electronic apparatus 10 implements the game of backgammon, and the display 12 depicts a backgammon board. The CHANCE indicators of the first plurality 14 are associated with indicia 24 on the face of the display 12 to represent a pair of DICE. The PLAY indicators of the plurality 16 are associated with triangular-shaped indicia 26 on the face of the display 12 for representing backgammon PIPS. Individual ones of the indicators, when actuated, represent the occupancy of the PIPS by playing pieces (referred to as MEN). To operate these indicators, the play instructions take the form of chance requests and move instructions, respectively.

THE GAME OF BACKGAMMON

A brief description of the game of backgammon facilitates understanding of the invention. Backgammon is a game between two contestants. Each contestant initially has a set of fifteen MEN positioned on a gaming board. The gaming board is rectangularly configured and has locations called PIPS represented by triangular-shaped indicia disposed along the long edges of the board. The MEN are initially positioned on preselected PIPS and are respectively advanced from PIP to PIP from their initial positions according to counts determined by a roll of a pair of DICE.

One or more MEN are advanced, according to the count on each DIE and whether doubles are thrown, from their initial positions in a respective forward direction towards his HOME BOARD. Respective HOME BOARDS are defined as the last six PIPS which a contestant's MEN encounter as they advance in their respective forward (but opposite) directions. Advancing the MEN past their last HOME BOARD is said to be BEARING OFF the MEN, and they are then positioned in a POCKET off the playing board. BEARING OFF may begin only after all the MEN of the respective contestant have been advanced to their HOME BOARD. When a contestant has advanced all his MEN from their initial starting points and past the last home point into the POCKET, the game is completed, and that contestant is the victor.

Certain rules must be observed during advancing of the MEN. One or more MEN may advance a total number of PIPS equal to the total count on the DICE. However, the advance of each of the MEN must be by groups of PIPS, with the number of PIPS in each group being the same as shown by the count on a respective DIE. Also the advancing of the MEN may not result in one contestant's MEN landing on a PIP occupied by two or more of the other contestant's MEN.

Another rule of the game is that if one of a contestant's MEN lands on a PIP which is occupied by only one of his opponent's MEN, the opponent's MAN is removed from the board, losing occupancy of that PIP. This man is removed to a nonPIP location on the board called the BAR where it awaits being put back into play. When it is placed back into play, it must begin at the respective contestant's first PIP (farthest from his HOME BOARD). The removal of any opponent's MAN in this manner is referred to as a HIT. In order for the HIT MAN to be placed back onto the board into play, a roll of the DICE must produce one DIE having a count which would place the HIT MAN onto a PIP unoccupied by any MEN of his opponent.

Wagering is an optional, but exciting, feature of backgammon. According to this aspect of the game, an initially agreed-upon WAGER may be consecutively DOUBLED by first one contestant and then the other. In this connection, a DOUBLING CUBE is provided bearing indicia 1, 2, 4, 8, 16, 32, and 64. As the WAGER is DOUBLED, the DOUBLING CUBE is positioned to indicate the current multiple value of the WAGER and to indicate ownership (i.e., who has the right to proffer the next challenge of a DOUBLE). Refusal to accept the challenge of a DOUBLE is automatic concession of the game.

Still another aspect of backgammon connected with wagering is the DEGREE OF VICTORY. When the losing contestant has BORNE OFF at least one MAN at the completion of the game, the victorious contestant receives, via a regular WIN, the amount of the WAGER as multiplied by the value of the DOUBLING CUBE. If the losing contestant has not BORNE OFF at least one MAN, a GAMMON has occurred, and the victorious contestant wins at a rate double the value of the DOUBLING CUBE. If the losing contestant has not BORNE OFF at least one MAN, and has one or more of his MEN stranded on the HOME BOARD of the victorious contestant or stranded in the BAR, a BACKGAMMON has occurred, and the victorious contestant wins at a rate triple the current value of the DOUBLING CUBE.

Referring again to FIG. 1, the PLAY indicators 16 which represent each PIP include first and second associated groupings of indicators. Each grouping includes a linear array 27 of five indicators, plus an associated sixth indicator 28, and each grouping is assigned to a particular contestant and represents, when operated, occupancy of the PIP by him. Each grouping is operated to provide a value of up to ten, with each indicator of the array 27 operated to provide a value of up to five, and the indicator 28 operated to provide a value equal to five.

The display 12 also includes groups of STATUS indicators. Some of these indicators are operated primarily as a direct consequence of the input of a play instruction via the mechanism 20. Others of the indicators are operated by the energizing mechanism 18 as an indirect consequence of the input of a particular play instruction.

The STATUS indicators which are operated primarily as a direct consequence of a play instruction include BAR STATUS indicators 30, and DOUBLING CUBE STATUS indicators 32. The BAR STATUS indicators 30 are operated to represent the occupancy of the BAR by HIT MEN of each contestant. The BAR STATUS indicators are directly operated to indicate when a MAN has left the BAR and is represented once again as occupying a PIP.

The DOUBLING CUBE STATUS indicators 32 include VALUE indicators 36 and OWNERSHIP indicators 38. The value indicators, when operated, indicate values of 2, 4, 8, 16, 32, 64 for indicating the current value of the DOUBLING sequence by which the WAGER is to be multiplied. The OWNERSHIP indicators 38 indicate which contestant presently owns (i.e., is entitled to proffer a challenge of a DOUBLE) the DOUBLING CUBE.

The STATUS indicators which are operated as an indirect consequence of a particular play instruction include A's MOVE and B's MOVE indicators 40, 42, respectively; ROLL DICE indicators 44; ILLEGAL MOVE indicators 46; DO YOU ACCEPT DOUBLE indicators 48; and SCOREKEEPING indicators 50.

The A's MOVE and B's MOVE indicators 40, 42 are alternately operated to indicate which contestant is next to submit a play instruction. The ROLL DICE indicators 44 indicate when a chance request is to be entered as a play instruction. When considered with the MOVE indicators 40, 42, an indication is provided of which contestant is to submit the chance request and when he is to do so.

The ILLEGAL MOVE indicators 46 are operated to indicate whenever a contestant has entered a play instruction which is disallowed by the rules of backgammon. As one example, if one contestant enters a move instruction which attempts to operate a PLAY indicator corresponding to a PIP already occupied by two MEN of his opponent, the ILLEGAL MOVE indicators 46 are operated. As another example, if one contestant attempts to BEAR OFF one of his MEN when all of his MEN are not in his HOME BOARD, the ILLEGAL MOVE indicators 46 are operated. Still another example is an attempt by a contestant to remove one MAN from a PIP and not to place him at another legal location (including in the POCKET).

The DO YOU ACCEPT DOUBLE indicators 48 are operated in conjunction with a play instruction which proffers a challenge of a DOUBLE. The indicators 48 act as a reminder that the DOUBLE has been offered and that the opponent must respond to the offer.

The SCOREKEEPING indicator 50 are automatically operated by the energizing mechanism at the end of each game to keep a tally on the running score between contestants. The SCOREKEEPING indicators 50 are automatically incremented by a magnitude in accordance with the DEGREE OF VICTORY, depending upon the value of the VALUE indicators 36 and the operative states of the PLAY indicators 16 of the losing contestant (i.e., the PLAY VALUE of the PLAY indicators 16 associated with the losing contestant).

As a feature, the BAR STATUS indicators 30 are also operated as an indirect consequence of a play instruction. For example, if the PLAY indicators 16 are operated to indicate that a MAN has been HIT, the HIT MAN is automatically represented by the indicators 30 as occupying the BAR. When the HIT MAN is able to leave the BAR, the indicators 30 are directly operated to indicate his vacating the BAR.

Similarly, PIP representing PLAY indicators 16, the SCOREKEEPING indicators 50, and the VALUE indicators 36 are operated both directly and indirectly. They are directly initialized at the beginning of a sequence of games, and are indirectly conditioned to automatically initialize for a new game at the end of each game in the sequence. More specifically, at the end of each game in the sequence, the VALUE indicators 36 and the SCOREKEEPING indicators (as well as the BAR STATUS indicators 30) are reset to zero. This indicates that the DOUBLING CUBE has a value equal to one and that no MEN occupy the BAR. The SCOREKEEPING indicators 50 are automatically incremented according to the DEGREE of the win. Also at completion of each of the interim games, the PIP representing PLAY indicators 16 are automatically reset to represent starting occupancy conditions of the PIPS.

Figure 3:
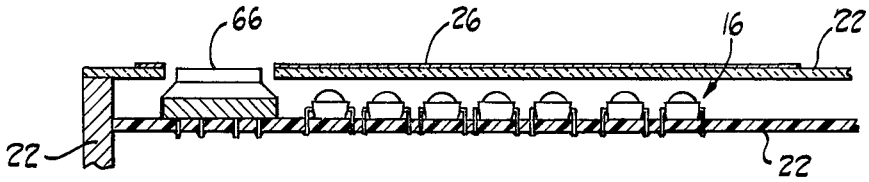
FIG. 3 is a cross-sectional view of Section 3—3 of the display in FIG. 1 showing a set of indicators and an associated switch.

Referring now to FIG. 3, a cross-sectional view of Section 3—3 shows the indicia 26 associated with the PLAY indicators 16 of the preferred embodiment of FIG. 1 as they are secured within the housing structure 22. The indicators 16 are light-emitting diodes and are arranged (as seen in FIG. 1) in a pair of parallel linear arrays 27 each having an associated indicator 28. Preferably one of the linear arrays 27 and indicators 28 has a light-emitting diode which emits in one color, and the other linear array 27 and indicator 28 has light-emitting diodes which emit in another color. Each linear array 27 and associated indicator 28 is assigned to a contestant and is operated accordingly to indicate the occupancy of his MEN on the PIP (for use in establishing his PLAY VALUE).

Suitable diodes are Model P/N MV 50 and Model P/N MV·53 light-emitting diodes which are available from Monsanto Corporation. They respectively emit in the red and yellow spectrums when operated. The diodes are mounted on a printed circuit board 52 which is secured to the housing structure 22. The diodes are positioned underlying the indicia 26 which is translucent and silk-screened onto a transparent section of the housing structure 22. Accordingly, a plan view of the indicia 26, as associated with the arrangement of indicators 16, depicts a backgammon PIP.

For simplifying description, the other indicators shown in FIG. 1 are not described in detail. However, in the preferred embodiment, all except the SCORE-KEEPING indicators 50 take the form of light-emitting diodes which are positioned underlying transparent sections of the housing structure 22 which, in turn, support a silk-screened pattern of indicia. The SCORE-KEEPING indicators 50 are conventional seven-segment, gas discharge displays. It is understood that various types of indicators are suitable for employment in the display 12. For example, plasma discharge displays are especially suitable for the embodiment shown in FIG. 2 which is designed primarily for accommodating distance viewing by spectators.

THE INPUT MECHANISM 20

Figure 4:
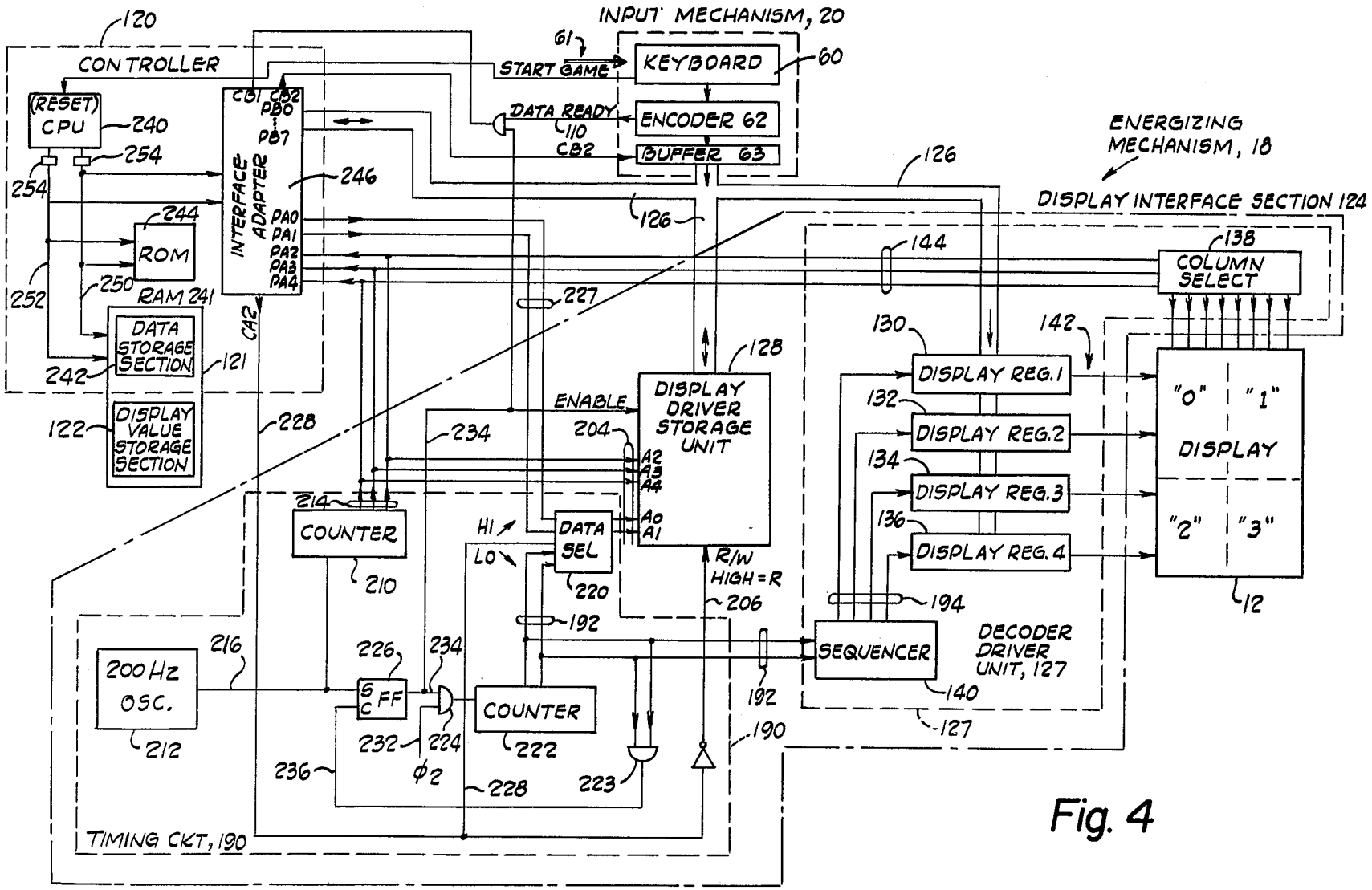
FIG. 4 is a functional block diagram of the electronic game of chance shown in FIG. 1.
Figure 5:
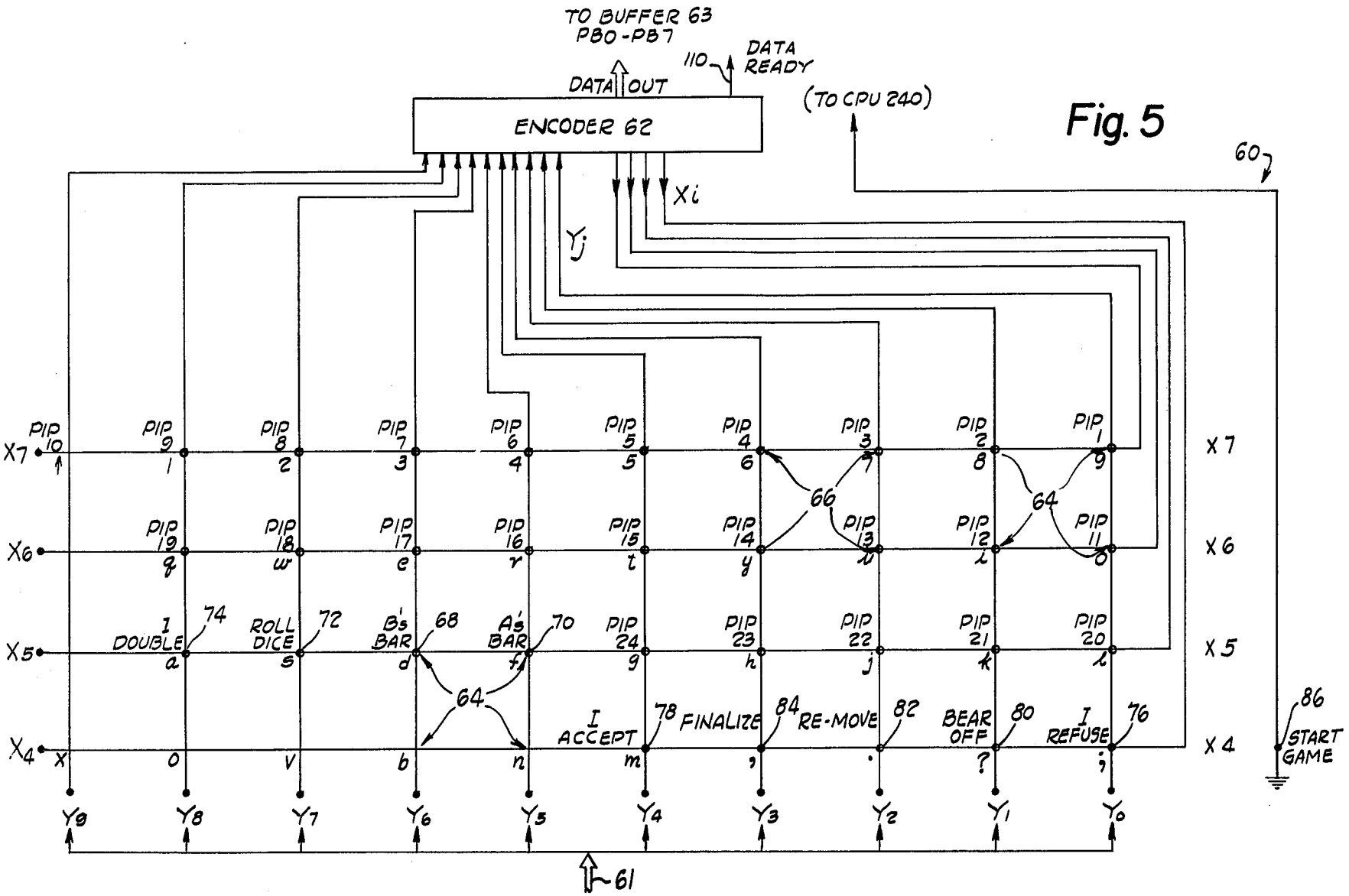
FIG. 5 is a functional diagram presenting a keyboard and an encoder utilized as an input mechanism in the game of FIG. 3.

Referring to FIGS. 2, 4, and 5 in addition to FIG. 1, the input mechanism 20 includes a keyboard 60, an encoder 62, and a tristate buffer 63. The play instructions are input to the mechanism 20 either by manual actuation of the keyboard 60 or by the transmission of electronic signals, as indicated at 61, which are coupled to the encoder 62 for simulating keyboard 60 generation of the signals. The encoder 62 encodes the play instruction representing signals and couples them to the energizing mechanism 18 via the tristate buffer 63.

The keyboard 60 may be directly secured to the housing structure 22, or it may be remotely coupled to the structure 22 by the set of lines 61 as shown in FIG. 2. As shown in FIG. 2, the remotely coupled keyboards 60 are connected in parallel. On the other hand, the play instruction signals on the lines 61 could be generated by a computerized system, as previously described.

The Keyboard 60

The keyboard 60 is schematically illustrated in FIG. 5. It includes a plurality of switches 64 which are represented both as intersections or cross-points in a $4\times10$ array of rows $X_i$ and columns $Y_j$ and as separate from the array. The switches 64 are preferably conventional keyboard switches of the single-pole, single-throw, momentary type.

The switches 64 include a set of PIP switches 66 for operating the PLAY indicators 16 representing each of the PIPS. Operation of the PIP switches 66 includes first and second sequential actuations. The actuations are synchronized with the energizing mechanism 18 for decreasing by one the number of operated indicators at the particular PIP via the first actuation and for increasing by one the number of operated indicators at the particular PIP via the second actuation.

A set of B's BAR and A's BAR switches 68, 70 are provided for operating the BAR STATUS indicators 30. Upon actuation of the respective BAR switches 68, 70, the number of operated indicators of the BAR indicators 30 is decreased by one to represent a decrease in the occupancy of the BAR.

A ROLL DICE switch 72 is provided. Actuation of the ROLL DICE switch 72 indicates that a chance request has been input. In response to the chance request, the energizing mechanism 18 operates the CHANCE indicators 14 to represent a simulated roll of DICE.

An I-DOUBLE switch 74 is provided for operating the DO YOU ACCEPT DOUBLE indicator 48 whenever the possessor of the DOUBLING CUBE proffers the challenge of a DOUBLE. The switch 74 conditions the energizing mechanism 18 to either increment the VALUE indicators 36 and to adjust operation of the OWNERSHIP indicators 38, or to indicate the game is concluded due to refusal of the proffered DOUBLE.

An I REFUSE switch 76 and an I ACCEPT switch 78 are provided so that the contestant to whom the DOUBLE is offered may respond. Actuation of the I REFUSE switch 76 signals foreiture of the game and conditions the energizing mechanism 18 to reset and increment the appropriate indicators. Operation of the I ACCEPT switch 78 conditions the energizing mechanism 18 to increment the VALUE indicators 36 to shown the proper value of the DOUBLING CUBE and causes the OWNERSHIP indicators 38 to reflect the new possession of the DOUBLING CUBE.

A pair of BEARING OFF switches 80 are provided, upon actuation of each, for signaling the energizing mechanism 18 that the respective contestant has BORNE OFF a MAN. Actuation of one of these switches 80 as an element of a play instruction is an acceptable alternative to the second sequential actuation of the PIP switches 66. More specifically, after a contestant has entered a move instruction to decrease the number of operated indicators at a particular PIP representation, rather than operate a PLAY indicator 16 at another PIP, he may operate the BEARING OFF switch 80 if his current PLAY VALUE entitles him, according to the rules of backgammon, to BEAR OFF.

A RE-MOVE switch 82 is provided for conditioning the energizing mechanism 18 to restore the display 12 to a previous PLAY VALUE. If a contestant has entered a move instruction which he wishes to cancel, the contestant actuates the RE-MOVE switch 82, and the PLAY indicators 16 are automatically restored to their operative states prior to the submission of the cancelled move instruction.

The display 12 also includes a FINALIZE switch 84. The FINALIZE switch 84 is actuated whenever a contestant has completed the input of his play instructions. The FINALIZE switch 84 conditions the energizing mechanism 18 to evaluate the previously submitted play instruction and to either operate the display 12 accordingly or to indicate that the play instruction was disallowed by the rules of backgammon. Unless a disallowed play instruction was input, actuation of the FINALIZE switch 84 operates the MOVE indicators 40, 42 to indicate that it is the other contestant's next move.

The display 12 also has a START GAME switch 86, which is directly connected to the energizing mechanism 18, bypassing the encoder 621. The START GAME switch 86 is actuated by a contestant prior to the beginning of a sequence of games. Actuation of this key causes appropriate resetting and clearing of the indicators of the display 12 in preparation for the first game.

The Encoder 62

Figure 6:
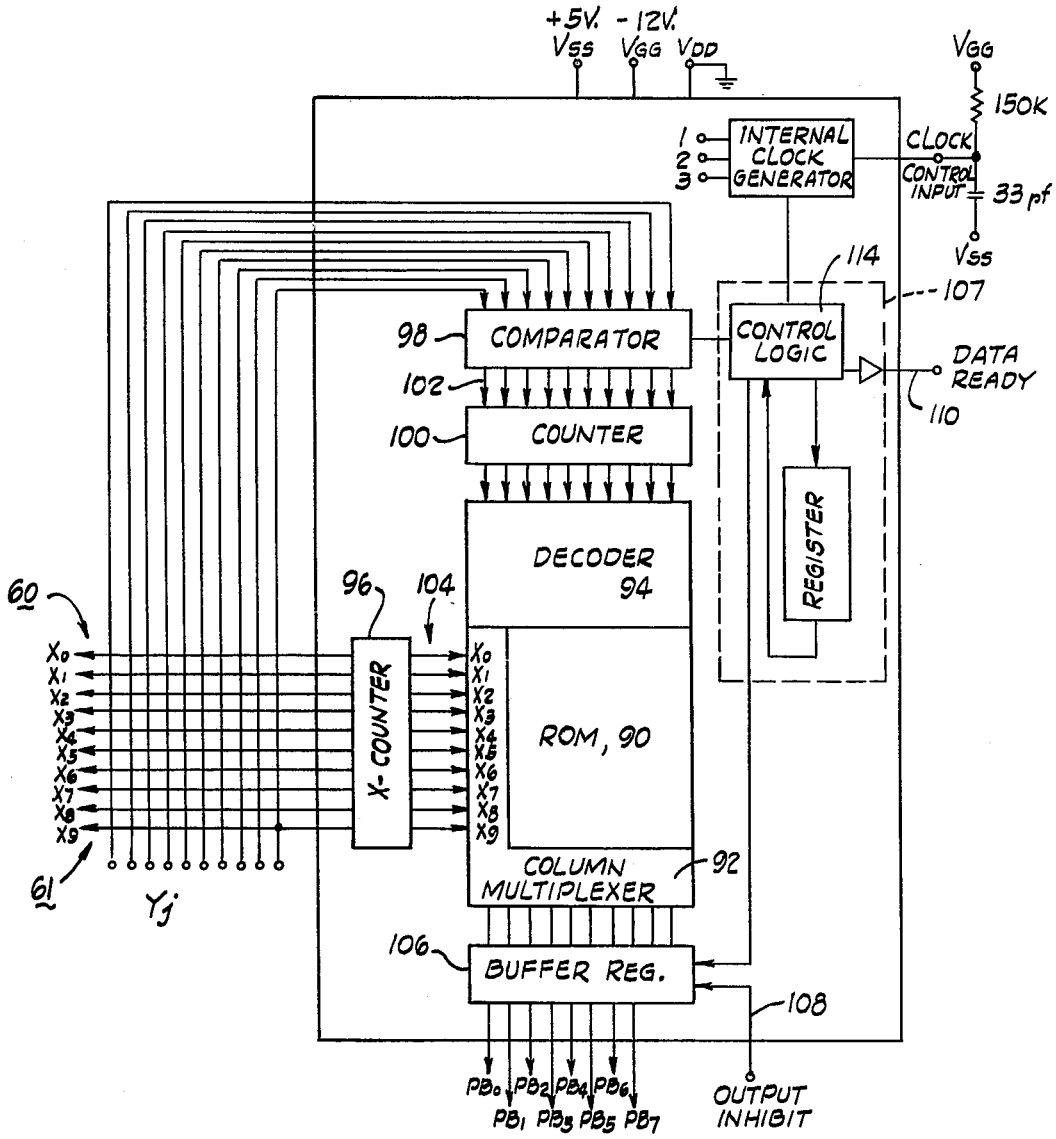
FIG. 6 is a detailed functional diagram of the encoder of FIG. 4.

The encoder 62 is functionally shown in detail in FIG. 6. It includes a read-only memory 90 (hereafter ROM90), a column multiplexer 92, and an input decoder 94. The ROM 90, the multiplexer 92, and the decoder 94 cooperate to provide conventional eight-bit, ASC II, coded signals for each operation of a switch 64 of the keyboard 60.

To this end, the encoder 62 also includes an X counter 96 which is coupled to the $X_i$ rows of the keyboard 60, a comparator 98 coupled to the $Y_j$ columns of the keyboard 60, and a Y counter 100 coupling the comparator 98 to the decoder 94. The X counter 96 sequentially provides STROBE signals to the column multiplexer 92 and to the $X_i$ rows of the keyboard 60. As the X counter 96 enables a particular X row of the keyboard 60, the comparator 98 determines if a particular key in one of the $Y_j$ columns of the keyboard 60 has been actuated. If an actuation has occurred, the comparator 98 provides a SWITCH signal on one of a plurality of lines 102 to the Y counter 100. The Y counter 100 is operated at a frequency which enables all of the lines 102 corresponding to all columns $Y_j$ to be monitored to see if a SWITCH signal exists during strobing of each of the rows $X_i$. If a switch 64 has been actuated, the counter 100 indicates to the decoder 94 which column of the keyboard 60 contains the actuated switch. The X counter 96 via a set of lines 104 indicates to the column multiplexer 92 which row of the keyboard was strobed at the time actuation of the switch was detected. Accordingly, the decoder 94 and column multiplexer 92 are supplied with signals which identify which switch 64 has been actuated.

The ROM 90 is organized having forty word-select lines and one hundred bit lines. The decoder 94 enables a selected word-select line according to the switch signal detected by the comparator 90. The one hundred bit lines from the ROM 90 are coupled into the multiplexer 92 which, via the signals on the lines 104 from the X counter 96, selected ten and provides a ten-bit output word. In the preferred embodiment only eight of the ten bit lines are utilized for providing an eight-bit word as the encoded play instruction signal.

A buffer register 106 and an error detector circuit 107 are provided. The detector circuit 107 includes control logic 114 and a register 116 for determining when verified switch actuation has occurred. Unless a plurality of switches 66 has simultaneously been actuated, a DATA READY signal on a line 110 is output substantially upon identification by the comparator 98 of the column of the keyboard 60 having the operated switch 66. The eight-bit encoded, play instruction signal is coupled into the buffer register 106 for transmission to the tristate buffer 63.

The tristate buffer 63 is also coupled to receive an output inhibit signal (referred to as the CB2 control signal), on a line 108 from the energizing mechanism 18. When the eight-bit display word is ready to be output from the input mechanism 20, the error detector circuit 107 generates the DATA READY signal on the line 110. Unless the output inhibiting CB2 control signal on the line 108 is generated, indicating that the energizing mechanism 18 cannot accept a new play instruction at that time, the eight-bit encoded, play instruction signal representing a particular switch 66 actuation is output to the energizing mechanism 18 via the tristate buffer 63.

The preferred and illustrated keyboard encoder 62 is commercially available from Electronic Arrays, Inc., Mountain View, California, under Model No. EA2000 Keyboard Encoder. This keyboard encoder has a 4,000 bit ROM (programmable in ASCII code) and a capacity to encode (1) up to 99 switches; and (2) up to 10 parallel output bits per switch actuation. In the illustrated embodiment, only eight of the ten possible output bits are utilized for encoding the play instruction.

THE ENERGIZING MECHANISM 18

Referring again to FIG. 4, the encoded play instruction signals are selectively output through the tristate buffer 63 to the energizing mechanism 18 for operating the display 12. To this end, the energizing mechanism 18 includes a programmable controller 120 which is operatively associated with a display value storage section 122, and a display interface section 124. The encoded play instruction signals are input to the programmable controller 120 via a a data bus 126, for verifying that each play instruction input via the input mechanism 20 is allowable according to the rules of backgammon. The CHANCE and PLAY VALUES of the display 12 prior to input of the particular play instruction are stored in the display value storage section 122. Depending upon the allowability of the instruction, the programmable controller 120 generates a display word and couples it via the data bus 126 to update the display interface section 124. A sequence of the display words, depending on the play instruction input, characterize the CHANCE and PLAY VALUES and the status of the display 12 in general.

The Display Interface Section 124

As shown in FIG. 4, the display interface Section 124 includes a decoder driver unit 127, for energizing the indicators of the display 12, a display driver storage unit 128 for receiving the display words from the controller 120 and for appropriately conditioning the unit 127 with the display words, and a timing circuit 129 for controlling the flow of the display words into and out of the unit 128.

Figure 7:
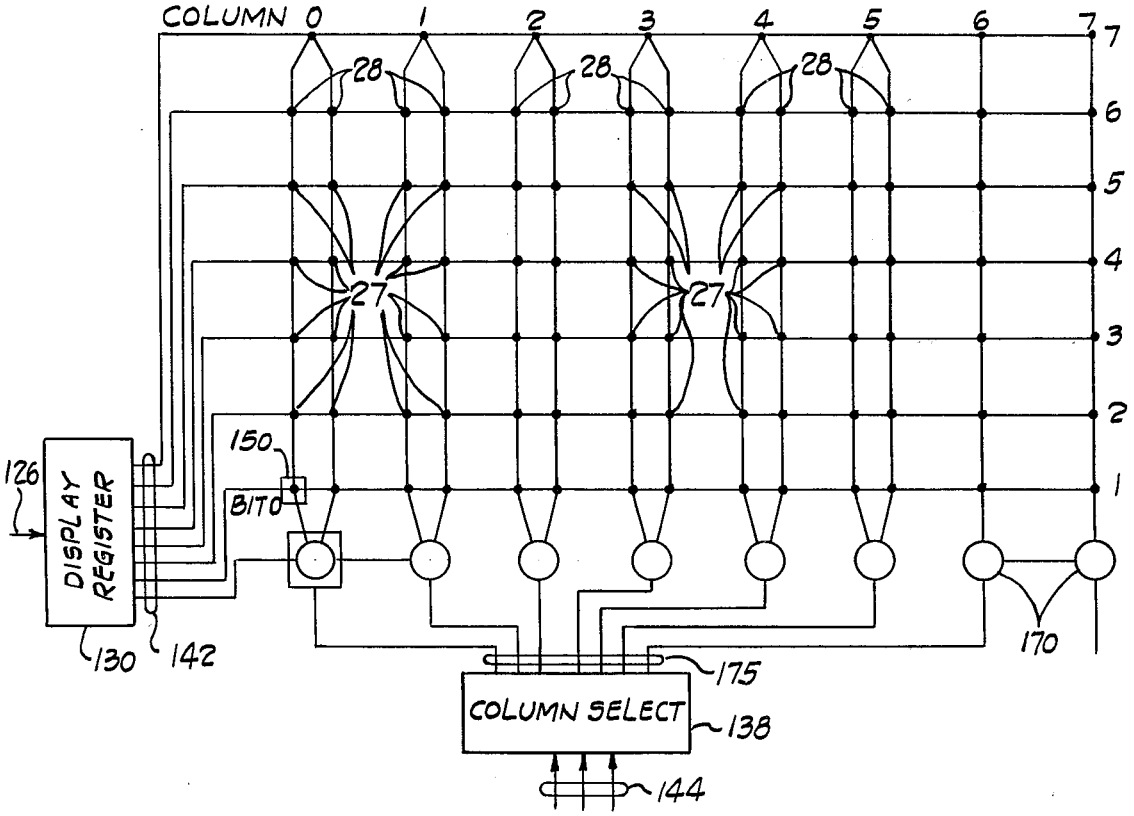
FIG. 7 is a schematic diagram of the interconnection of the display of FIG. 1 with its driver circuitry.

The decoder driver unit 127 comprises a plurality of display registers 130, 132, 134, 136, a column select circuit 138, and a sequencer 140. The display registers 130–136 and the column select circuit 138 address the display 12 for actuating the selected indicators. FIG. 7 schematically represents one portion of the display 12 having rows and columns of indicators (represented by column/row intersections) connected to one of the display registers and to the circuit 138. The display register selects certain rows of the indicators of the display 12, and the column select circuit 138 selects specific columns of the indicators of the display 12.

In more detail, the indicators of the display 12 are electrically grouped into four quadrants 0–3, with each quadrant being operated by a selected one of the display registers 130–136. Each of the quadrants of the display 12 are identically connected electrically to the associated display register; so, for ease of description, only a single quadrant, quadrant 0, and associated display register 130 are depicted in combination with the column select circuit 138 in FIG. 7.

Each quadrant has eight columns, denoted as columns 0-column 7. Columns 0–5 are assigned to contain the indicators which represent PIPS. Columns 6 and 7 are assigned to contain other STATUS indicators. Each of the columns 0–5, have pairs of indicators in each of the rows 1–6. The indicators in rows 1–5 in each column represent the linear arrays 27 of a corresponding PIP, and the indicators in the sixth row of each of columns 0–5 represent the sixth indicator 28. Row 7 of the various columns is assigned various indicators, such as the DOUBLING CUBE STATUS 32.

The display register 130 is loaded with one of the display words via the data bus 126 from the display driver storage unit 128. It generates ROW SELECT signals on a set of lines 142 for operating one or more of the rows 1–7. The column select circuit 138 is operated via COLUMN SELECTOR signals on a set of lines 144 from the programmable controller 120 for selecting one or more of the columns 0–7 to be operated. Each indicator at an intersection of an operated row and an operated column is itself operated. In the preferred and illustrated embodiment, light-emitted diodes are utilized as the indicators and the diodes are energized into conduction when operated.

Figure 8A:
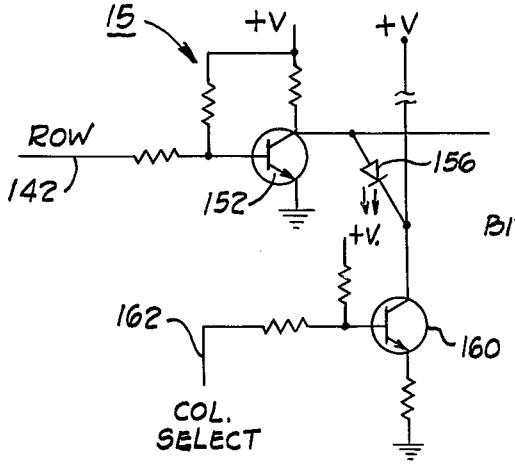
FIGS. 8*a* and 8*b* are circuit diagrams of electrical circuits for energizing the indication of the display in FIG. 1.

FIG. 8*a* depicts a row and column driver circuit 150 for selectively operating the rows and columns of the display 12. In FIG. 7, the illustrated row and column driver circuit 150 is shown schematically located in row 1, column 0.

The circuit 150 includes a row driver transistor 152 which is connected as a switch, having its base terminal coupled to receive the ROW SELECT signals on the lines 142. The row driver transistor 152 has its collector-emitter path resistively coupled to a reference potential and directly coupled to circuit ground. The collector of the transistor 152 is connected to all indicators in the respective row.

In the preferred and illustrated embodiment, the indicators are light-emitting diodes 156. There is a row driver transistor 152 for each row, and its collector is commonly connected to the anodes of all of the light-emitting diodes 156 in the respective row.

A column driver transistor 160 is provided, and it also operates as a switch. The column driver transistor 160 has its base connected to receive a COLUMN SELECT signal on a line 162, and has its collector-emitter path resistively coupled to circuit ground. The cathodes of all the light-emitting diodes 156 in the respective column are commonly connected in series with the collector-emitter path. There is a column driver transistor 160 for each of the seven columns in the display 12.

Figure 8B:
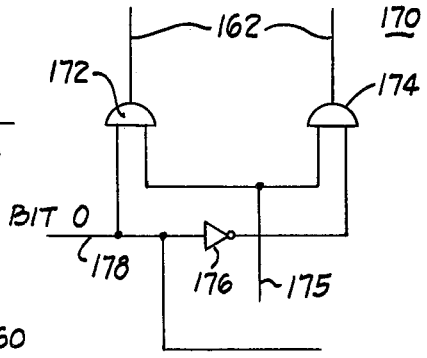
Figure 9A:
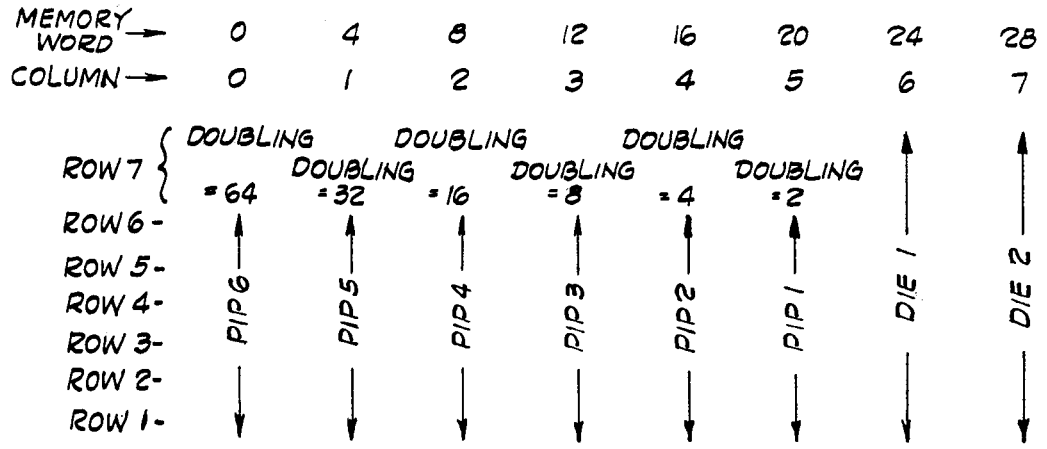
Figure 9B:
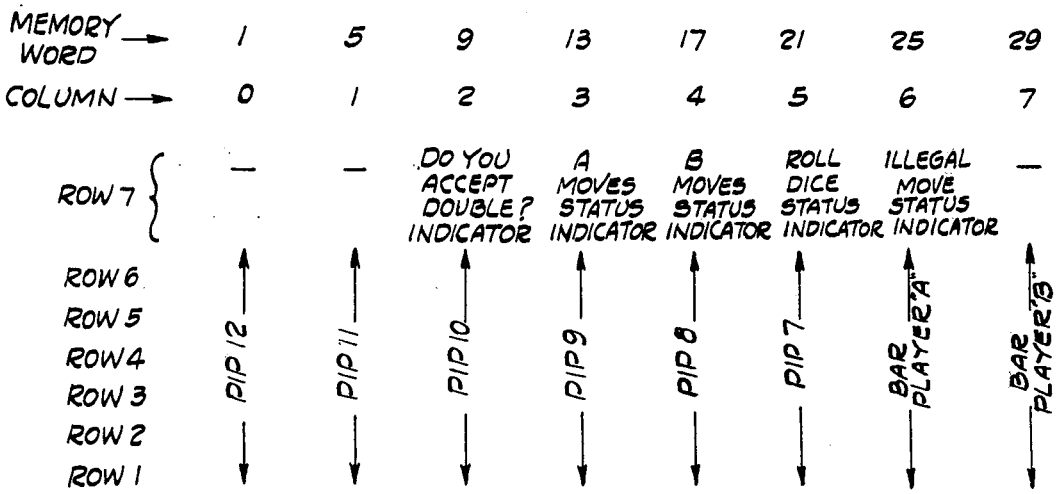

Referring to FIG. 8*b*, a column select logic circuit 170 is shown for providing the COLUMN SELECT signals on the lines 162. The column select logic circuit 170 includes first and second, dual input AND gates 172, 172. Each of the gates 172, 174 provide the respective COLUMN SELECT signals for driving one or the other of the arrays 27 in columns 0–5. Each of the gates 172, 174 have one input commonly connected to each other and to the column select circuit 138 via a line 175. The other inputs to the gates 172, 174 are connected to each other by an inverter 176 and are coupled to receive a bit (bit 0) of each display word via a line 178 from the programmable controller 120. Depending on the logic state of the selected bit on the line 178, either the gate 172, or the gate 174 is enabled for operating one of the arrays 27.

There is a pair of the gates 172, 174 for each of the columns 0–5. Because the columns 6–7 have only a single indicator in each row, there is no need to selectively enable the respective column. Accordingly, the column select logic circuit 170 for the columns 6 and 7 is merely a direct connection of the line 162 to the circuit 138.

In operation, the column select circuit 138 receives the COLUMN SELECTOR signals and energizes one of the lines 175. One of the gates 172, 174 is rendered conductive, as determined by the bit signal on the line 178, producing the COLUMN SELECT. This signal is coupled to the appropriate column driver transistor 160 for rendering it conductive. The display register energizes selective ones of the row driver transistors 152 according to the stored display words. All of the diodes 156 residing in commonly energized rows and columns are thereby energized.

The COLUMN SELECTOR signals are transmitted on the lines 144 from the programmable controller 120 to the column select circuitry 138 at a 200 Hertz rate. This rate determines (1) the rate at which the display 12 is updated by a new display word in the display registers 130–136 or, (2) the rate at which the indicators on the display 12 are refreshed. Because there are no gating circuits between the registers 130–136 and the display 12, the display 12 is refreshed or updated by the stored display word whenever the columm select circuit 138 is operated. This requires that the display registers 130–136 be updated, if necessary, with new display words prior to each operation of the column select circuit 138.

To this end, the sequencer 140 has its outputs coupled to the registers 130–136 for sequentially enabling the registers to receive the new display words, and has its inputs coupled to a timing circuit 190. The timing circuit 190 provides DECODER signals on a pair of lines 192 to the sequencer 140. The DECODER signals are binary signals which are generated to define a single sequence of eight binary logic states 000–111 at a one-megahertz rate, each time one of the COLUMN SELECTOR signals is generated (at the 200 Hertz rate). The sequencer 140 decodes the DECODER signals and sequentially energizes one of a set of lines 194 coupled to its outputs at a one-megahertz rate. Upon energization of each line, a display word from the display storage unit 122 is input into the register 130–136 which has been enabled by the one energized line 194. Accordingly, all four of the display registers 130–136 are loaded during the first four microseconds of each 1/200-second interval which is the duration of each sequential energization of the column select circuit 138. After the DECODER signals have defined one cycle of the binary states (000–111), the timing circuit 190 inhibits further transmission of the DECODER signals.

Because the column select circuit 138 sequentially enables the eight columns of the display 12, a given indicator of the display 12 is refreshed or updated every 8/200 seconds. This is sufficient for maintaining an ample amount of light output from the light-emitting diodes 156 and renders minimum flickering as preceived by the human eye.

Display Driver Storage Unit 128

The display driver storage unit 128 is a random access memory (hereafter RAM 128) which is organized to hold a plurality of the eight-bit display words. In the illustrated embodiment, the display 12 requires thirty-two such eight-bit display words to characterize its operation. Accordingly, the display storage unit 122 has sufficient memory locations to accommodate at least 32 eight-bit words. A random access memory which is suitable for the storage unit 128 is commercially available from Motorola, Inc. under the part number MCM6810L, providing storage for up to 128 of such eight-bit words.

The display driver storage unit 128 is updated, or provided with a new display word, by the programmable controller 120 whenever the display 12 is to manifest a new PLAY or CHANCE VALUE or new status. More specifically, after the FINALIZE key 84 has been actuated for indicating that a contestant has completed his input of play instructions, the programmable controller 120 conditions the display driver storage unit 128 with appropriate display words for indicating the results of the contestant's play.

Prior to operation of the FINALIZE key 84, the display registers 130–136 are also conditioned by the controller 120 for manifesting unvalidated results of the play instruction. After the FINALIZE key 84 has been actuated and the display storage unit 122 updated, the 32 words then stored in the unit 122 are transmitted into the display registers 130–136. If the display words transmitted to the registers 130–136 during the time intervals before and after the FINALIZE key 84 was actuated are the same, then the display 12 remains unchanged. However, since the programmable controller 120 updates the display storage unit 122 with different display words to at least update the STATUS indicators (even if the play instruction was valid or allowed) the display 12 will usually manifest new values after each actuation of the FINALIZE key.

In this manner, the programmable controller 120 is able to restore the display 12 to a previous PLAY VALUE and to update the STATUS indicators 30–50.

Display words are sequentially written into the display driver storage unit 128 and are read out of the unit 128 into the registers 130–136 according to operation of the programmable controller 120 and to the timing circuit 190. That is, the display driver storage unit 128 has a set of data terminals through which the display words on the data bus 126 from the programmable controller 120 are written into and read from the unit 128. The display driver storage unit 128 is responsive to a four-microsecond enable signal on a line 234 during successive 200 Hertz cycles for establishing the rate at which display words are written into the unit 128 and are read from the unit 128. The unit 128 is inactive for the remainder of each period established by the 200 Hertz frequency.

The unit 128 has a set of address input for receiving ADDRESS signals on a set of lines 204 from the timing circuit 190. The ADDRESS signals determine the storage locations into which the display words are written and the locations from which the display words are read. The unit 128 also has a read/write terminal for receiving a READ/WRITE signal on line 206 from the programmable controller 120. The READ/WRITE signal determines whether display words are to be written into of read from the storage locations specified by the ADDRESS signals.

The Timing Circuit 190

The ADDRESS signals must provide five bits of information to specify 32 locations in binary. To provide three bits of the five necessary address bits, the timing circuit 190 includes a counter 210 and an oscillator 212. The counter 210 is a three-bit counter which periodically provides on a set of lines 214 eight-binary logic states (logic states 000 to state 111). The lines 214 are directly connected as three of the lines 204 for defining the three higher order address bits of the ADDRESS signals.

The oscillator 212 is connected via a line 216 as an input to the counter 210. The oscillator 212 is a 200 Hertz oscillator which causes the eight binary states to be generated on the lines 214 at a 200 Hertz frequency, with a complete cycle requiring 8/200 seconds.

In order to provide the two lower order address bits of the ADDRESS signals, the timing circuit 190 includes a data selector 220, a counter 222, first and second AND gates 223, 224, and a flip-flop 226. The data selector 220 is a dual, two-input line to one-input line selector of conventional design. One pair of the input lines is coupled to the lines 192 for receiving the four binary bits which are produced at a one-megahertz rate and described with respect to the sequencer 140. The other pair of inputs to the data selector 220 is from the programmable controller 120 via a pair of lines 227.

The data selector 220 has a control input coupled to a line 228 having the inverse of the READ/WRITE signal on the line 206 for selection of a pair of input lines as the output lines. Accordingly, for one condition of the READ/WRITE signal, the data selector 220 couples the lines 192 as the outputs, and for the other state of the READ/WRITE signal, the selector 220 selects the lines 227 as its outputs.

The counter 222 is a two-bit binary counter having its outputs connected to the lines 192. The counter 222 has its input terminal coupled to the second AND gate 224 for selectively receiving a one-megahertz signal. To this end the AND gate 224 has an input coupled to a line 232 which is coupled to a one-megahertz clock signal from the programmable controller 120. The other input of the gate 224 is connected to the flip-flop 226 by a line 234 for enabling the gate 224 to pass the one-megahertz signal on the line 232 for only the first four microseconds after the beginning of each 200 Hertz pulse from the oscillator 212. During these first four microseconds, the counter 222 provides the four binary states on the lines 192 to the sequencer 140 and to the data selector 220, and the display driver storage unit 128 is enabled for read and writing via the ENABLE signal and the line 234.

To enable the gate 224 only during the referenced first four microseconds, the flip-flop 226 is cleared after the occurrence of four one-megahertz signals. To this end the flip-flop 226 is coupled to the oscillator 212 by the line 216 and to the first AND gate 223 by a line 236. The first AND gate 223 has its inputs connected to the lines 192 for providing a logic one signal only when the counter 222 has provided a binary 11 output state on the lines 192. Upon the logic 11 state (i.e., the completion of the referenced four-microsecond period) the flip-flop 232 is reset, disabling the second AND gate 224. This disables the counter 222 and removes the DECODER signals from the lines 192.

Accordingly, whenever the READ/WRITE signal on the line 206 is in a logic one state to cause the stored display words to be read from the display driver storate unit 128 during the referenced four microseconds, a logic zero is supplied on the line 228 to the data selector 220. This conditions the data selector 220 to transmit the four binary state on the lines 912 as its outputs as the lower two bits of the ADDRESS signals on the lines 204. When the READ/WRITE signal changes to a logic zero state, indicative that new display words from the controller 120 are to be selectively written into the unit 128, the logic one signal is generated on the line 228 which couples the signals on the lines 227 as the two lower bits of the ADDRESS signals on the lines 204.

THE PROGRAMMABLE CONTROLLER 120

The programmable controller 120 is a micro processor which is programmed to operate the display 12 according to (1) the rules of the game of backgammon and, (2) the specific play instructions from the input mechanism 20. To this end, the programmable controller 120 includes a central processing unit 240 (hereafter the CPU 240), a random access memory 241 (hereafter the RAM 241), a read-only memory 244 (hereafter the ROM 244) and a peripheral interface adapter 246 (hereafter the PIA 246). The CPU 204 has a set of data lines 250 and a set of address lines 252. The ROM 244, the RAM 241, and the PIA 246 are commonly connected to the lines 250, 252. According to conventional design, a pair of tristate buffer circuits 253 are provided at the outut of the CPU 240 for enabling the CPU 240 to accommodate the relatively heavy signal loading provided by the RAM 241, the ROM 244, and the PIA 246.

The RAM 241 includes a data storage section 242. In the illustrated embodiment the RAM 241 also is utilized as the device for implementing the display value storage section 122. This is for simplification of the interaction between the programmable controller 120 and the display value storage section 122, as otherwise the storage section 122 could be a separate memory device.

The display value storage section 122 is effectively partitioned into storage locations for storing values duplicating six copies of possible operative states of the indicators of the display 12. Each of the partitioned storage locations is referred to as a PLAYING BOARD and consists of either 26 or 27 values. These PLAYING BOARDS are referred to as the LAST BOARD, the CURRENT BOARD, the LEVEL-TWO BOARD, and the LEVELS-THREE, -FOUR, AND -FIVE BOARDS. The LAST BOARD is conditioned with 26 values which represent the operative states of the indicators of the display 12 whenever a play instruction has been accepted by the controller 120 as an allowed play instruction. The CURRENT BOARD is loaded with 27 values to represent the operative states of the indicators of the display 12 after a play instruction has been input, but prior to actuation of the FINALIZE switch 84. The LEVEL-TWO BOARD is conditioned to receive values which represent all possible allowable or valid play instructions. The values are eventually compared to the values of the CURRENT BOARD for validating a particular input of a play instruction for a given CHANCE and PLAY VALUE. The LEVEL-THREE, -FOUR, and -FIVE BOARDS hold intermediate values determined during execution of routines by the controller 120.

Each of the BOARDS stores 24 values representing the 24 PIPS. If the value for a particular PIP is zero, no MEN, and no opponent's MEN, occupy the particular PIP. A positive number stores for the PIP represents the number of one contestant's MEN on the PIP and a negative number represent the number of the other contestant's MEN on the PIP.

Each of the BOARDS stores a 25th value which represents the number of MEN the contestant, then entering his play instruction (hereafter the MOVING contestant), has in the BAR. If the stored value equals zero, he has no MEN on the BAR; a positive value indicates the number of his MEN on the BAR.

Each of the BOARDS also has a 26th value which represents the number of MEN on the BAR of the contestant not then entering his play instructions (hereafter referred to as the OPPOSING contestant). A stored value of zero represents no MEN on the BAR, and a positive value indicates the number of MEN on the OPPOSING contestants BAR.

All but the LAST BOARD have a 27th value which represents the number of the PIP which is occupied by the least advanced MAN of the OPPOSING contestant. A value equal to 25 represents that the least advanced MAN is on the BAR.

There are other specially designated storage locations in the RAM 241. An OUTPUT BUFFER storage location is provided with a capacity to hold 32 display words. The values of the OUTPUT BUFFER storage locations are used to build the bit configurations which are required for operating the display 12. The resultant display words in the OUTPUT BUFFER storage locations are eventually copied into the display driver storage unit 128 for eventual transmission to the display 12.

There are SWITCH and STATUS VALUE locations designated in the RAM 241. A MOVE NOW value is stored equal to a plus one in a designated location if a deisignated one of the contestants is then moving, and is stored equal to a minus one if the other contestant is then moving.

A CUBE VALUE location is provided. If the value at the CUBE location has been set equal to a one, a DOUBLE has not yet been proffered and the DOUBLING CUBE has not yet been used. This signifies that either contestant may initiate a DOUBLE. If the value is positive, the stored value indicates that the value of the DOUBLING CUBE and that the CUBE is owned by the contestant who has been assigned a positive MOVE NOW value. A negative value in the CUBE VALUE location indicates the value of the DOUBLING CUBE multiplied by minus one and that the CUBE is owned by the other contestant. Only the contestant owning the DOUBLING CUBE may make the next proffer of a DOUBLE.

Two pair of storage locations called ROLL 1, ROLL 2 and RL1, RL2 are provided. The value of the DICE are stored in these storage locations. The locations RL1, RL2 are respectively designated to store the value of the associated one of the DICE, and the locations ROLL 1, and ROLL 2 are loaded with the smaller and larger of the DICE values, respectively. If, a DOUBLE is thrown on the DICE, the value at the ROLL 2 location is set to a zero, and the value at the ROLL ONE location is set to the common DICE value.

A RANDOM VALUE location is provided for cotaining a sixteen-bit word used for generating the randomly determined CHANCE VALUE. The value of this location is incremented at the rate of 50,000 counts per second and the incrementing is stopped whenever the ROLL DICE switch 72 is actuated. The value determined by operation of the ROLL DICE switch 72 is then utilized by the controller 120 for providing the randomly determined CHANCE VALUE.

Figure 10:
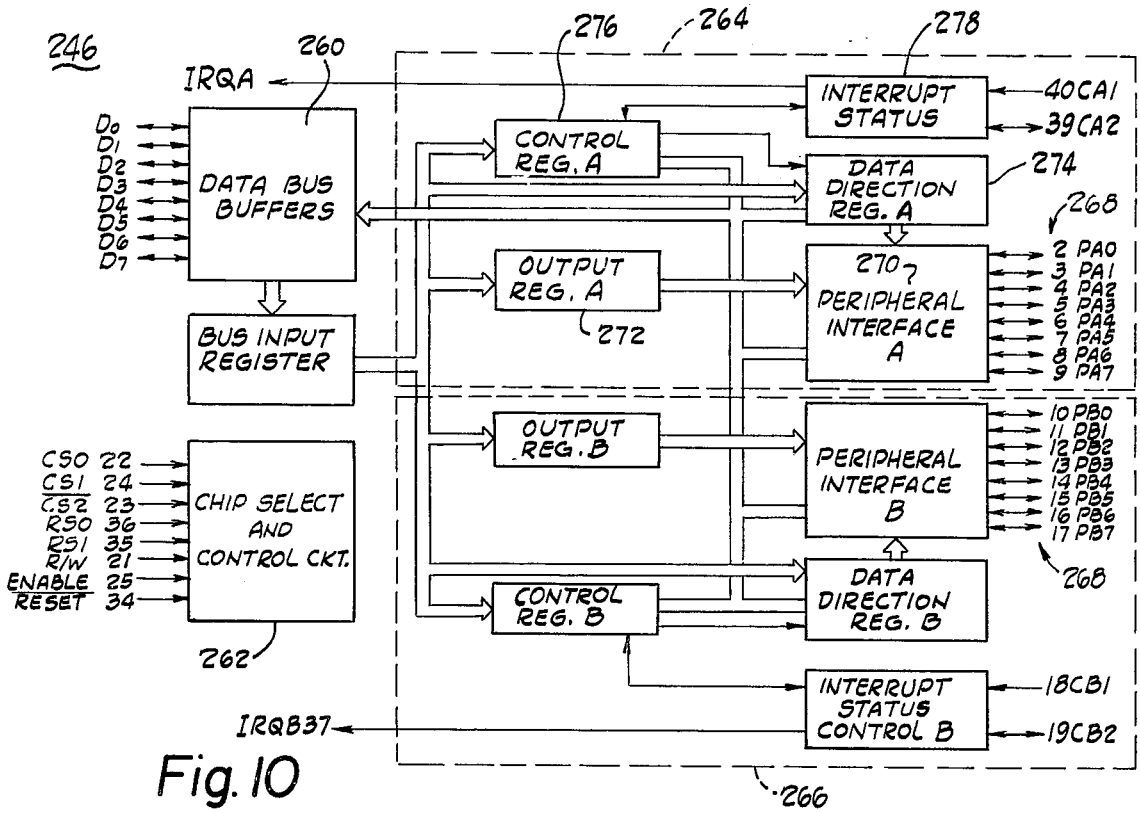
FIG. 10 is a schematic portrayal of the bit decoding of program words used in a programmable controller of FIG. 3.

Referring now to FIG. 10, the PIA 246 is functionally shown in detail. The PIA 246 includes a data bus buffer 260, a chip select and control circuit 262, and a pair of interface units 264, 266. Under control of the circuit 262, data may be input through either of the units 266, 268 for output through the buffer 260, or may be input through the buffer 260 for output through either of the units 264, 266.

Because each of the units 264, 266 are identical, only the unit 264 will be described. The unit 264 includes a peripheral interface unit 270, an output register 272 coupled for receiving data from the buffer 260 and for inputting the data into the interface unit 270, a data direction register 274 for keeping track of whether data is being input or output from the interfacia 270, and a control register 276. The control register 276 allows the CPU 240 to control operation of circuit 278. The interrupt status circuit 278 is responsive to a pair of control signals CA1, CA2, and is operable to generate the control signal CA2. The corresponding control signals for the unit 266 are the CB1 and CB2 control signals.

The CB1 control signal, when in the set or logic one state, identifies that a play instruction has been encoded by the encoder 62 and that the encoded play instruction is ready, from the input mechanism 20's standpoint, to be entered into the peripheral intervace unit B. The CB2 control signal is selectively transmitted to the buffer 63 to allow the encoded play instruction to be input onto the data bus 126. Only when the CB2 control signal is in a set state after the occurrence if the CB1 control signal during the first four microseconds after each 200 Hertz cycle will the encoded play instruction be entered onto the bus 126.

The illustrated and described PIA 246 is commercially available from Motorola, Inc., Phoenix, Arizona, under the part number MC6820. Its operation is described in detail in that company's advanced information product bulletin on the MC6820, 1975. The PIA 246 is utilized in strict accordance with the referenced advance information sheet and its operation need not be explained further in detail.

The RAM and ROM memories 241, 244 are conventional memories and are also available from Motorola, Inc. under the respective part numbers MCM6810 and MCM6830.

The CPU 240 is a microcomputer commercially available from Motorola, Inc. under the part number M6800. The interconnections and operations of the CPU 240, RAM 241, ROM 244, and PIA 246 are in accordance with the recommended design and operating procedures by Motorola as set forth in detail in that company's product brochure entitled, "The M6800 Microcomputer Family," 1975.

Examples of Operation of the PLAYING BOARDS

It is now instructive to provide two examples of the operation of the PLAYING BOARDS to explain the procedure followed by the controller 120 for generating all possible moves which a contestant can validly make for a given CHANCE VALUE and PLAY VALUE for a NONDOUBLE and a DOUBLE DICE roll. The case for a NONDOUBLE roll is described first. For purpose of this discussion, a complete move is defined as: (1) a PARTIAL move using DIE1 plus a PARTIAL move using DIE2; or (2) a PARTIAL move using DIE2 plus a PARTIAL move using DIE1. A PARTIAL move is defined as the movement of one MAN from one PIP to another utilizing the count of one DIE.

Initially the "pointer" (hereafter the PIP-PTR) which identifies PIP locations represented in the PLAYING BOARDS in the RAM 241 is positioned at the high end of the LAST BOARD (PIP 24). It is then "backed up" (moved towards lower numbered PIPS) until the MOVING contestant's MAN is found. If this MAN cannot be moved (i.e., it is blocked by opponent) using DIE2, the backup continues until (1) one is found, or (2) backup beyond PIP1 occurs. If the latter happens, all possible moves have been generated and DIE1 and DIE2 are interchanged. If a movable MAN is found, the PARTIAL move is made and the resulting board is stored in the LEVEL-THREE BOARD using a routine called PUSH.

At this point, a routine called SUBMOVE is called using DIE1. Another pointer (called the SUBPIP-PTR) is positioned at the high end of the LEVEL-THREE BOARD and is backed up until a movable MAN is found. When one is found, the PARTIAL move is made, and a COMPLETE move has now been generated. At the point a PROCES routine is called in order to compare the COMPLETED move with the contestant's CURRENT BOARD. If the BOARDS match, the contestant's move is legal. Whether legal or not, other possible moves are generated by restoring the working BOARD to the PARTIAL MOVE state stored in the LEVEL-THREE BOARD using a routine called POP. Backup of the SUBPIP-PTR continues until the SUBPIP-PTR is backed up beyond PIP1.

At this point the working BOARD is restored to the LAST BOARD and backup of the PIP-PTR on the LAST BOARD resumes as earlier described.

This procedure provides all possible moves first using DIE2, the DIE1. Since, in backgammon, different moves result by playing the other DIE first, the entire described sequence is repeated with the DIE values interchanged.

If there has been no COMPLETE move, then no moves are possible utilizing both DIES. The described procedure is shown graphically in FIGS. 11*a*–11*c* where O represents the MOVING contestant's MEN and an X represents the OPPOSING contestant's MAN. Each of the horizontal levels in each figure represents the three PLAYING BOARD levels used in a nondouble-move validation, namely, the LAST BOARD, the LEVEL-THREE BOARD, and the LEVEL-TWO BOARD. All possible moves are generated assuming:

(1) a DICE roll of 2, 5;

(2) MOVING contestant's MEN on PIP 17 and PIP 22, opponent contestant's MAN on PIP 19;

(3) there are other MOVING contestant's MEN on PIPS not shown but are blocked by OPPONENT's MEN. This implies that the BEARING OFF phase has not started;

(4) no MEN on BAR.

The process proceeds as follows in FIG. 11*a;*

(1) Start with PIP-PTR at PIP 20. The PIP-PTR is backed up by one to PIP 19 before any searching. This starting point is selected such that a PARTIAL move of 5 will not result in a move off the board;

(2) A moving man is found at PIP 17. Move it to PIP 22 and save the result in the LEVEL-THREE BOARD;

(3) Now search for a moving MAN with a DIE value of 2. Back up to PIP 22, move the MAN to 24. A COMPLETE move has now been generated;

(4) The LEVEL-THREE BOARD is not restored. The backup of the SUBPIP-PTR progresses (the "RESTORE" line in FIG. 3*a*) beginning at PIP 21 until PIP 1 is encountered (no moving MEN found);

(5) The LAST BOARD is now restored beginning at PIP 16. The backup of the PIP-PTR progresses until PIP 1 is encountered;

(6) All moves have now been generated by trying to move the 5 value first and the 2 value last. The values of the DICE are next reversed and the procedure is repeated as shown in FIG. 11*b;*

(7) Back up PIP-PTR to PIP 22, move MAN to PIP 24;

(8) Back up SUBPIP-PTR to PIP 17 move MAN to PIP 22. A COMPLETE move has been generated. Note that it is identical to the move generated in FIG. 11*a;*

Figures 11, 11A, 11B, 11C:
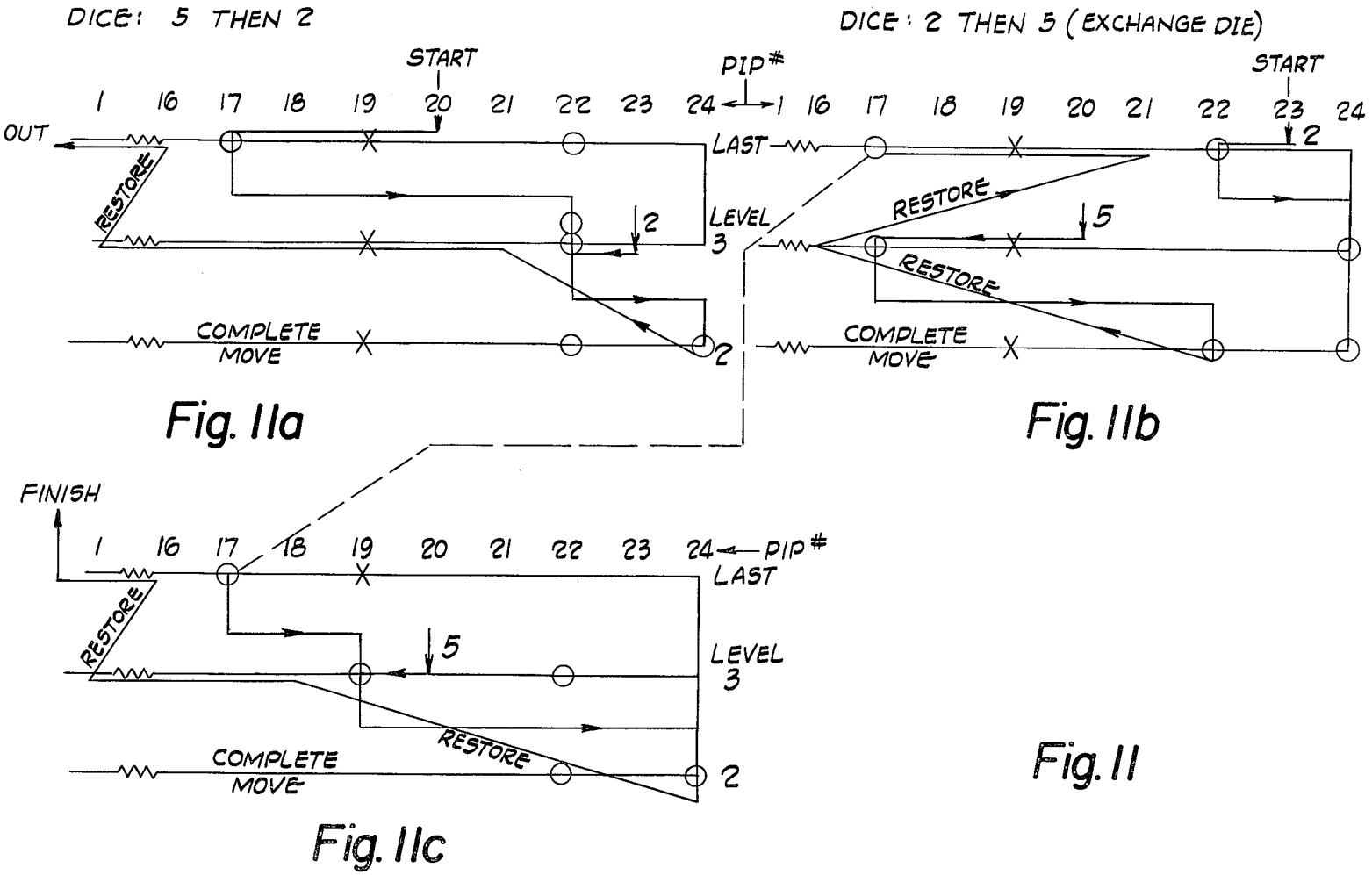
FIGS. 11, 12 are graphic representations of a pair of MOVE sequences using PLAYING BOARDS.

(9) Restore the LEVEL-THREE BOARD by backing up to PIP 1 (no moving MAN found). Next, the LAST BOARD is restored by backing up to PIP 17;

(10) Next, referring to FIG. 11*c* (following dashed line to FIG. 11*c* for clarity) the MAN is moved from PIP 17 to PIP 19. This PARTIAL move HITS the opponent who occupies PIP 19;

(11) Back up SUBPIP-PTR to PIP 19 and move MAN 5 PIPS to PIP 24. Note, this COMPLETE move is identical to FIGS. 11*a*–11*b* with the exception that an opponent was HIT;

(12) Restore LEVEL-THREE BOARD by backing up SUBPIP-PTR to PIP 1—no moving MAN found;

(13) Restore LAST BOARD by backing up PIP-PTR to PIP 1—no moving MAN found. The process is complete.

The case for a double roll is now described. A COMPLETE move for a double roll is defined as four PARTIAL moves using the DIE value.

A. To summarize the process, the PIP-PTR is positioned at the high end of the LAST BOARD. It is then backed up until a moving contestant's MAN is found. If this MAN cannot be moved, the backup continues until (1) one is found which can be moved or, (2) backup beyond PIP 1 occurs. If the latter happens, all possible moves have been generated.

B. If a movable MAN is found, the PARTIAL move is made and the resulting BOARD is stored in the next level (in order—LEVEL-THREE, LEVEL-FOUR, LEVEL-FIVE) using a routine called PUSH.

C. Subsequent to the PARTIAL move and the "saved" BOARD, the PIP-PTR is advanced to the destination PIP of the MAN first moved. Thus, the process tries to move the same MAN for each PARTIAL move.

D. The described process is repeated until four PARTIAL moves (or three, two, or one PARTIAL moves(s) if a routine called MOVES is called with DIE2 = −3 or −2 or −1, respectively) are made. A routine called PROCES is then called to validate the complete move.

E. The most recently saved level is now restored, with backup continuing at this level until (1) a movable MAN is found or, (2) backup beyond PIP 1 occurs. If the former, paragraphs B, C, D and E are repeated; if the latter, paragraph E is performed. The process stops when backup of the PIP-PTR at the LAST BOARD level goes beyond PIP 1. At this point all possible COMPLETE moves have been generated.

Figures 12A, 12B, 12C:
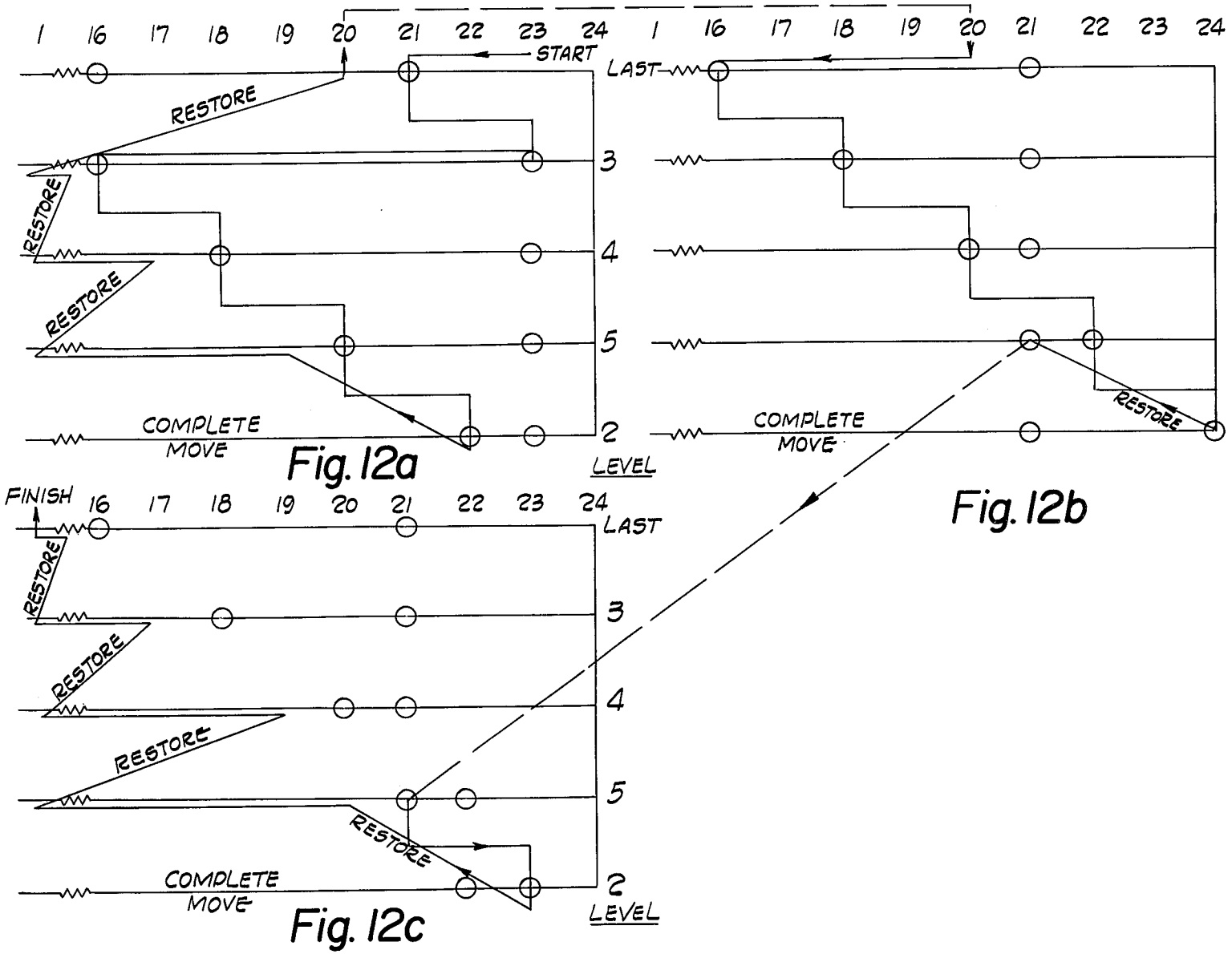

The above procedure is shown graphically in FIGS. 12*a*–12*c*. Board representation is similar to that used in FIGS. 11*a*–11*c*. All possible moves are generated assuming:

(1) a DICE roll of 2, 2;

(2) MOVING contestant's MEN on PIP 16 and PIP 21;

(3) MOVING contestant is not yet BEARING OFF because other MEN are on the board which are blocked by opponent;

(4) no MEN on BAR.

The process proceeds as follows:

(1) Start with PIP-PTR at PIP 23, start search at PIP 22 so PARTIAL move will not result in move off the board;

(2) a moving MAN is found at PIP 21; move it to PIP 23 and save resulting BOARD in LEVEL-THREE BOARD;

(3) Start next PARTIAL move at destination PIP 23. The MAN at PIP 23 cannot be moved off the board so backup is started. A movable MAN is found at PIP 16 and is moved to PIP 18. The result is saved in the LEVEL-FOUR BOARD;

(4) The movement of the MAN at PIP 18 is continued to PIP 20. The result is saved in the LEVEL-FIVE BOARD;

(5) The movement of the MAN at PIP 20 is continued to PIP 22. This is the fourth PARTIAL move which completes the move. A later described routine called PROCESS is called and the move is compared to the contestant's CURRENT BOARD for legality or validity;

(6) BOARD LEVELS FIVE, FOUR and THREE are restored and backup of the restored PIP-PTRs reveals no MOVING contestant's MEN. The LAST BOARD is restored and a MOVING contestant's MAN is found at PIP 16. (Follow dotted line to FIG. 12*b*.) The MAN is moved to PIP 18 and the result is saved in the LEVEL-THREE BOARD;

(7) The movement of this MAN is continued three additional times resulting in a COMPLETED move on the LEVEL-TWO BOARD;

(8) The working BOARD is restored to the LEVEL-FIVE BOARD and a MAN is found on PIP 21. (Follow dashed line to FIG. 12*c*.) The MAN is moved to PIP 23 and another COMPLETE move is generated. Note, that it is identical to the COMPLETE move in FIG. 12*a;*

(9) Board levels five, four, three and LAST BOARD are restored and backup of the restored PIP-PTRs reveals no movable MEN. This terminates the process.

In the two examples, there were no MEN on the BAR nor was the MOVING contestant BEARING OFF. These conditions are handled as special cases, requiring additional steps which are described subsequently in FIGS. 13–30.

The controller 120 is programmed according to the flow diagrams depicted in FIGS. 13–30. It is straightforward and routine for one of ordinary skill to write, according to the referenced flow diagrams, the necessary instructions into assembly language, to assemble the instructions, and to produce the object code compatible for programming the ROM 244 according to Motorola specifications.

THE PROGRAMMING OF THE CONTROLLER 120

The controller 120 effects operation of the display 12 according to a particular play instruction input through the input mechanism 20 for a given CHANCE VALUE. In the preferred embodiment the controller 120 is also programmed to provide the randomly determined CHANCE VALUE. In addition it is programmed to provide a validation mechanism for determining whether the particular play instruction input is valid, or allowed, according to the rules of backgammon for the given CHANCE VALUE and given occupany states of the PIPS (the PLAY VALUES). Furthermore, the controller 120 keeps tally on the various STATUS indicators which are provided on the display 12.

To this end, the programmable controller 120 is programmed according to the generalized flow diagrams in FIGS. 13–30. The symbols used in the flow diagrams are according to the convention set forth in FIG. 14.

The Reset Routine 302

Figure 13:
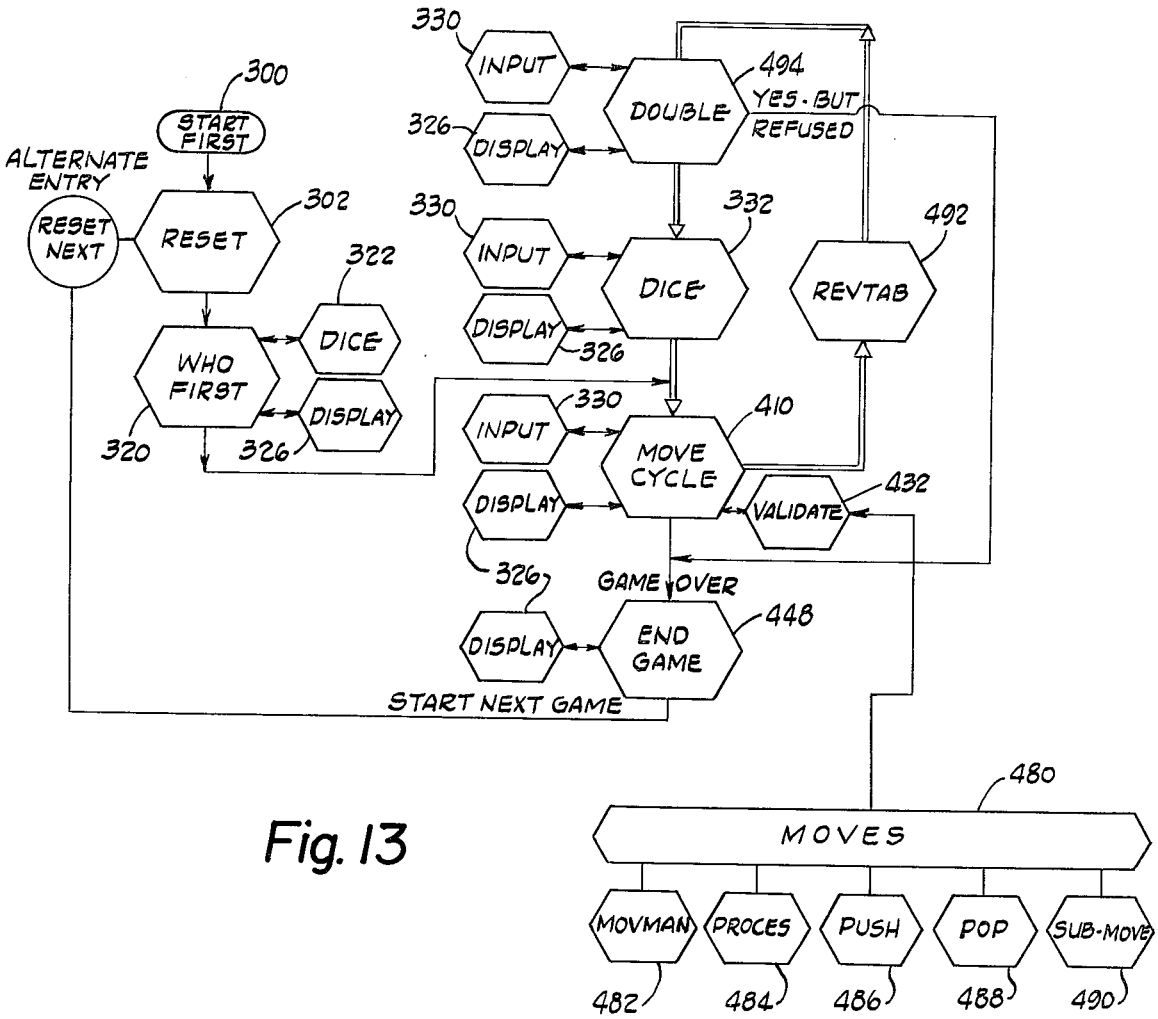
FIGS. 13–30 are detailed flow diagrams according to which the programmable controller of FIG. 3 operates the display.
Figure 14:
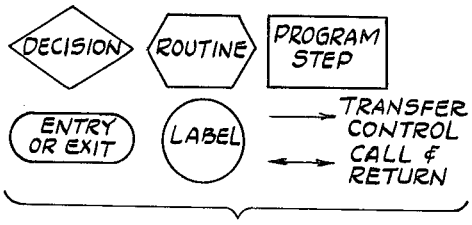
Figure 15:
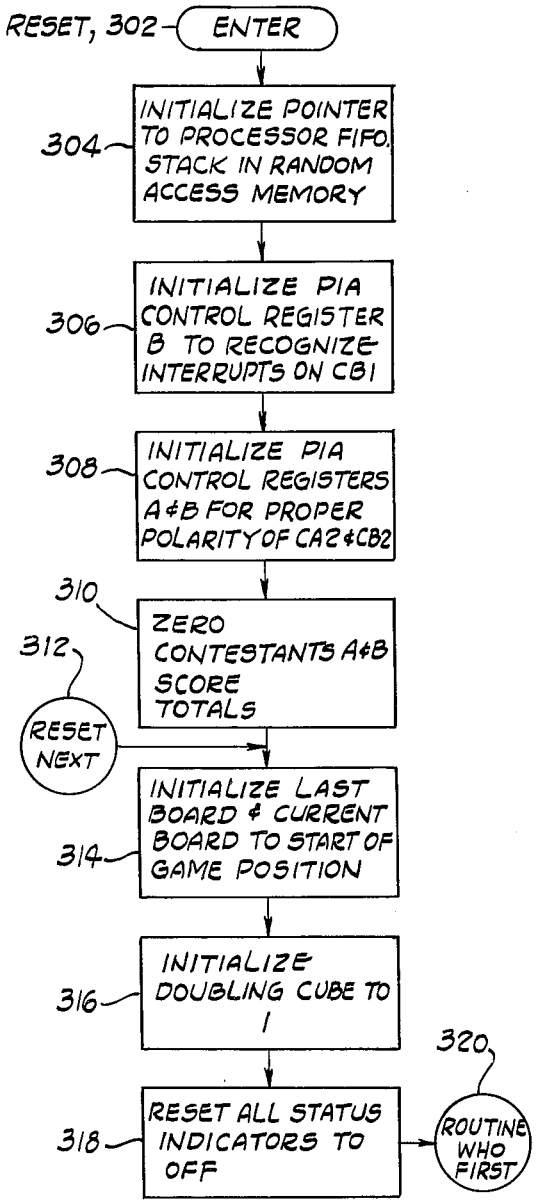

The electronic backgammon game is initiated by actuation of the START GAME switch 86, as represented by 300 in FIG. 13. This calls a RESET routine stored in the ROM 244 into play. The RESET routine 302 resets the CPU 240, essentially effecting reset of all the indicators of the display 12. More specifically, FIG. 15 shows the RESET routine 302 in more detail. As shown at 304, resetting of the CPU 240 effects initialization of a stack pointer utilized by the CPU 240. That is, the RAM 241 is structured in a first-in, first-out stack, and the stack pointer which identifies the data in the stack is initialized.

Next, and as shown at 306, the program stored in the ROM 244 causes the PIA 246 control register B to recognize any interrupts on the control line CB1. This conditions the PIA 246 to receive a play instruction when the keyboard 60 has been actuated.

Next, the PIA 246 control registers A and B are initialized to indicate the proper polarity of the control lines CA2 and CB2. This is indicated at 308.

As indicated at 310, the program stored in the ROM 244 causes the SCOREKEEPING indicators 50 to be zeroed via zeroing of appropriate locations in the RAM 241.

The steps 304–310 are performed at the beginning of every sequence of games. For interim games in the sequence, the steps 304–310 are not performed, as the steps 304–310 essentially reset the entire system. For the second and each subsequent game in the sequence, the ROM 244 is programmed with an entry point 312 which is after the step 310.

As indicated at 314, the LAST BOARD and the CURRENT BOARD are initialized to indicate the occupancies of the PIPS at the start of a game.

As indicated at 316 and 318, the DOUBLING CUBE indicators 36 are initialized to represent a value equal to one and all other STATUS indicators, for example the A's CUBE and the B's CUBE indicators 38, are extinguished. These steps complete the RESET routine, and control passes to a WHO FIRST routine 320.

The Who First Routine 320

The WHO FIRST routine is called before each game is started to determine which contestant is to enter the first play instruction. One of the contestants pushes the ROLL DICE switch 72 to display a CHANCE VALUE. Depending upon which of the dice represented by the indicators 16 has the higher value, a contestant is selected for entering the first play instruction. That is, if the DIE on the left-hand side is higher, one contestant moves, and if the value of the other DIE is higher, the other contestant moves. If they are equal, the ROLL DICE indicators 44 are automatically operated, and the ROLL DICE switch 72 is successively actuated by a contestant until nonequal DICE values are manifested. The MOVE NOW storage location in the RAM 241 is set according to which DIE has the higher value, and is indicative of which contestant is to move first.

Figure 16:
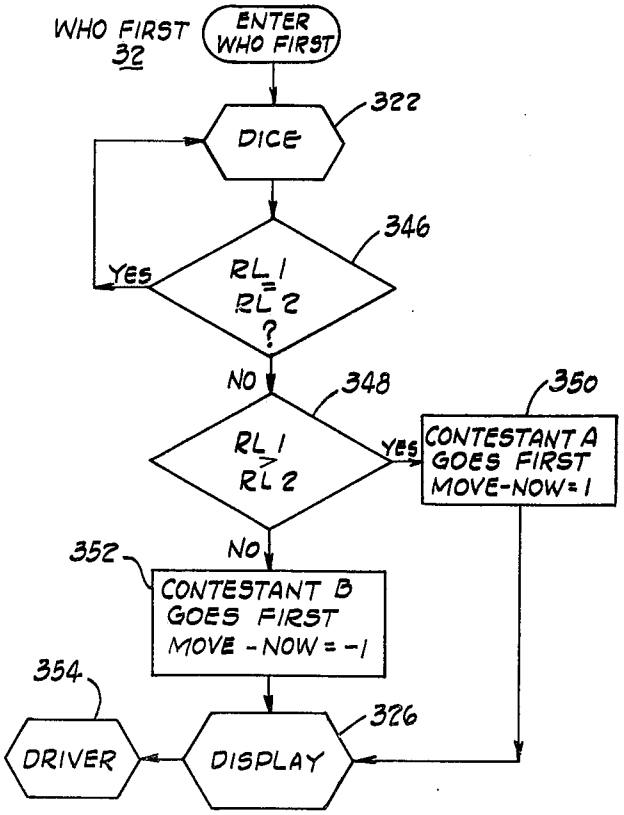

The WHO FIRST routine 320 is set forth in detail in FIG. 16. The first stage of the WHO FIRST routine is to call a DICE routine indicated at 322. The DICE routine causes the generation of a psuedo-random number by incrementing value at the RANDOM VALUE the 16-bit location in the RAM 241. Upon actuation of the ROLL DICE switch 72, the value of the 16-bit RAND location is incremented at a rate of approximately 50,000 counts per second. When the ROLL DICE switch 72 is actuated, the incrementing of the value at the RANDOM VALUE location stops to provide a generally randomly determined value. A conventional MODULO or remaindering function is then utilized to operate on the sixteen-bit number by dividing by 36 and providing the remainder as a number between 0 and 35. The value of one of the DICE is determined by (1) dividing the reduced value by six, noting the remainder, and (2) adding one to the remainder. This provides the desired number between 1 and 6 inclusive. The value of the other DIE of the CHANCE indicator 16 is obtained by dividing the reduced value at the RANDOM VALUE location by 6, rounding the result to an integer, and adding 1. These values are assigned to the RL1, the ROLL 1, the RL2, and the ROLL 2 locations in the RAM 241.

The Dice Routine

Figure 17:
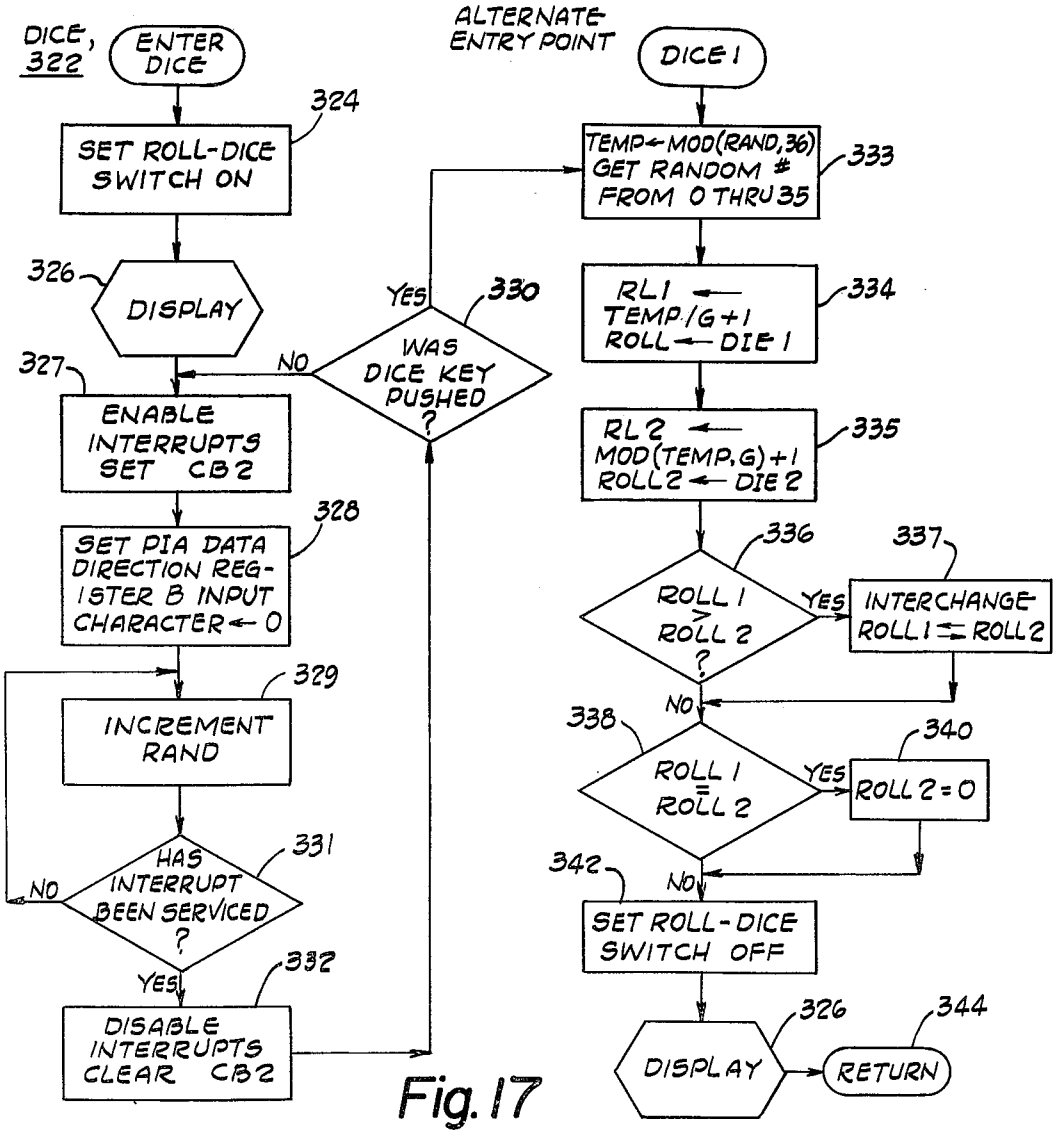

A detailed flow diagram of the DICE routine is given in FIG. 17. A ROLL DICE location is designated in the CURRENT BOARD of the RAM 241. The value at this location is selectively set to indicate when this routine is being executed. This enables the ROLL DICE indicators 44 to be operated when this value is transferred to the corresponding location in the OUTPUT BUFFER for eventually operating the display 12. As indicated at 324, the value at the ROLL DICE location is initially set into an actuated state upon calling of this subroutine.

Next, a DISPLAY 326 is called. This subroutine notes the set value at the ROLL DICE location and effects operation of ROLL DICE indicators 44 for instructing a contestant to enter chance request to the input mechanism 20. The DISPLAY 326 is described in detail by the flow diagram in FIG. 18 and will be described subsequently.

After the ROLL DICE indicators 44 have been operated, the PIA 246 is conditioned to enable the input mechanism 20 to input an encoded play instruction signal into the PIA 246. This is indicated at 327 whereby the CB2 control signal is set to a logic one state for enabling the encoded play instructions to be output through the buffer 63.

Next, as indicated at 328, all bits of the PIA data direction register B are set. This allows a subsequently generated encoded play instruction to be input via the bus 126 into the B side of the PIA 246.

At this point, in the operational sequence, the value of the sixteen-bit number stored at the RANDOM VALUE location is incremented at the 50,000 counts per second rate. This is indicated at 329.

Next, an INPUT 330 is brought into operation. The INPUT 330 is a demand routine which, upon being brought into operation via interrupts from the keyboard 60, allows play instructions input via the mechanism 20 to be transmitted into the programmable controller 120. The input 330 is shown in detail in FIG. 19 and will be described subsequently. Because this routine is a demand via functional boxes which check for keyboard interrupts, rather than a functional box designated INPUT which would imply the routine was called by the program stored in the ROM 244.

The incrementing of the value in the RAND location, indicated at 329, in FIG. 17, continues until one contestant actuates the ROLL DICE switch 72 (indicated at 330). Upon this condition, the encoder 62 generates a CB1 interrupt signal to the CB1 input of the PIA. When this interrupt signal has been generated, as indicated at 331 and the chance request has been entered, the control signal CB2 is set into a logic zero state (indicated at 332) which disables the input of any subsequent instructions into the PIA 246.

After incrementing of the value in the RAND location in the RAN 241 has been stopped to provide a generally randomly determined value, that value is operated on to provide first and second CHANCE VALUES corresponding to first and second values of the DICE. This is indicated by blocks 333, 334, and 335 and is as explained using the MODULO function. After the first and second CHANCE VALUES (according to DIE1, DIE2) have been provided, they are entered into the ROLL 1, RL1 locations and into the ROLL 2, RL2 locations, respectively. The values in the ROLL 1, ROLL 2 locations are checked to see if the value in ROLL 1 is larger than the value in ROLL 2 (at 336). If it is, the values are interchanged (at 337); if it is not, the values are checked to see if they are equal (at 338). If they are equal, the value at the ROLL 2 location is set equal to zero (at 340). Thereafter, the value at the ROLL DICE location is set equal to zero (at 342) and the DISPLAY subroutine 326 is called for manifesting the CHANCE VALUES on the display 12. As indicated at 344, control then leaves the DICE subroutine and transfers back to the WHO FIRST routine.

Referring again to FIG. 16, after the randomly determined CHANCE VALUES have been determined, the ROM 244 causes (at 346) a determination of whether the value of the RL1 and RL2 locations are equal, signifying that the values of the DICE are equal. If the values are equal, the DICE subroutine is caused to be re-executed via a contestant's subsequent operation of the ROLL DICE switch 72. Otherwise a determination is made (at 348) of whether the value stored at the RL1 location is greater than the value stored at the RL2 location for determining which of the randomly determined DIE values is larger. If the value at location RL1 is larger, one contestant is to move first (as indicated at 350), and if the value at the RL2 location is larger, the other contestant is to move first, as indicated at 352. The MOVE NOW switch is set to a value of plus or minus one accordingly to store in the RAM 241 which contestant has the privilege of the first play.

At this point the DISPLAY subroutine 326 is called up for conditioning the display 12 to indicate (1) the randomly determined values stored in locations RL1, RL2 as the CHANCE VALUE and, (2) via the MOVE indicators 40, 42 which contestant is to move first.

The Driver Routine

The control then passes to a DRIVER routine which is indicated at 354. The DRIVER routine retains control until the game is terminated. Its only purpose is to provide control of the controller 120 between each of several subsequently described routines, which are repetitively called into play until the game is completed.

The Display Subroutine 326

Figure 18:
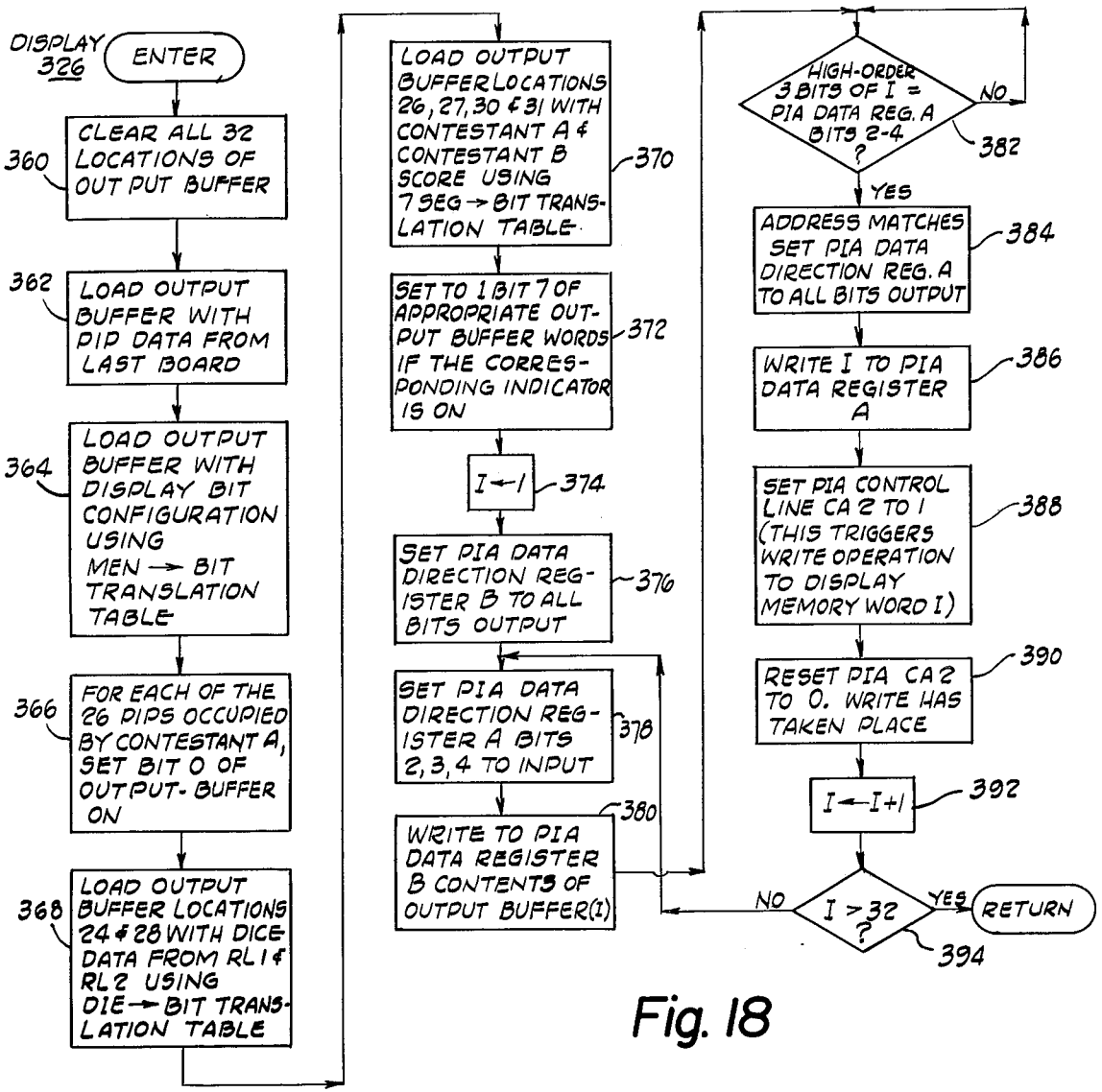

The DISPLAY subroutine 326 is shown in detail in FIG. 18. Initially, as indicated at 360, all 32 locations of the OUTPUT BUFFER locaation in the RAM 241 are cleared. Then, as indicated at 362, the OUTPUT BUFFER locations are loaded with PIP data from the LAST BOARD which have previously been stored in the RAM 241. This data is in binary format and must be converted.

Then the binary data values are converted by the CPU 240 and it loads the OUTPUT BUFFER locations with DISPLAY WORDS which are in a form for energizing selected of the indicators of the display 12. This step is indicated at 364 and requires a MEN-to-BIT translation table which is stored in the ROM 244. The MEN-to-BIT translation table translates the binary number of MEN occupying a given PIP to the bit configuration used in the display driver storage unit 128 and is shown in Table 1 below.

In Table 1, a decimal value of the binary number (DECIMAL) is stored in the LAST BOARD in locations in the RAM 241 to indicate the number of MEN on a given PIP at any given instant of time during play of the game. The DECIMAL value is translated into a six-bit binary number, occupying bits 1 through 6 of locations 0–7 corresponding to an eight-bit binary display word.

TABLE 1

| Number of Men on Pip | Bits on (one array 27) | Decimal |
|---|---|---|
| 1 | 1 | 2 |
| 2 | 1, 2 | 6 |
| 3 | 1, 2, 3 | 14 |
| 4 | 1, 2, 3, 4 | 30 |
| 5 | 1, 2, 3, 4, 5 | 62 |
| 6 | 1, 6 | 66 |
| 7 | 1, 2, 6 | 70 |
| 8 | 1, 2, 3, 6 | 78 |
| 9 | 1, 2, 3, 4, 6 | 94 |
| 10 | 1, 2, 3, 4, 5, 6 | 126 |

As indicated at 366, bit 0 of each of the seven-bit DISPLAY WORDS which are stored in the OUTPUT BUFFER location is selectively set for each of the DISPLAY WORDS representing PIPS occupied by the respective contestant. The state of bit 0 is set to a logic zero for one contestant, and is set to a logic one for the other contestant (for operating one or the other of the linear arrays 27 of the PIP indicators).

As indicated at 368, the OUTPUT BUFFER locations corresponding to words 24 and 28 are loaded with CHANCE VALUE information obtained from the RL1 and RL2 locations. To this end, a DIE-to-BIT translation table is utilized. For the illustrated CHANCE indicators 14 having seven light-emitting diodes arranged with three diodes on each of a pair of sides with a diode centered between the sides, the DIE-to-BIT translation table is as shown in Table 2.

TABLE 2

| Die Value | Bits On | Decimal Value |
|---|---|---|
| 1 | 7 | 128 |
| 2 | 1, 6 | 66 |
| 3 | 1, 6, 7 | 194 |
| 4 | 1, 3, 4, 6 | 90 |
| 5 | 1, 3, 4, 6, 7 | 218 |
| 6 | 1, 2, 3, 4, 5, 6 | 126 |

As seen from Table 2, each DIE value is stored in the RAM 241 as a DECIMAL value. The DECIMAL value is decoded into a seven-bit binary number occupying the most signficant bits of an eight-bit word. The least significant bit, bit 0, is not used.

Referring again to FIG. 18, as indicated at 370, the OUTPUT BUFFER locations corresponding to input word locations 26, 27, 30 and 31 are next loaded with a pair of two-digit values respectively representing each contestant's accumulated score for the sequence of games. A seven-segment-to-BIT translation table is used, and the translation table is shown in Table 3 below.

TABLE 3

| Digit | Bits On | Decimal |
|---|---|---|
| 0 | 1, 2, 3, 4, 5, 6 | 126 |
| 1 | 2, 3 | 12 |
| 2 | 1, 2, 4, 5, 7 | 182 |
| 3 | 1, 2, 3, 4, 7 | 158 |
| 4 | 2, 3, 6, 7 | 204 |
| 5 | 1, 3, 4, 5, 6, 7 | 218 |
| 6 | 3, 4, 5, 6, 7 | 248 |
| 7 | 1, 2, 3 | 14 |
| 8 | 1, 2, 3, 4, 5, 6, 7 | 254 |
| 9 | 1, 2, 3, 6, 7 | 206 |

Because SCOREKEEPING STATUS indicators 50 are selected to be of conventional seven-segment type, and because the segments are driven from the bit configurations stored in the display driver storage unit 128, the display words stored in the OUTPUT BUFFER locations must have seven bits. The values of the bits are determined by the most seven significant bits of an eight-bit word which is a binary decoding of a decimal representation of the values which are stored in the RAM 241.

As indicated at 372, bit 7 of certain output buffer words stored in the OUTPUT BUFFER is set to a logic one. This refers to FIGS. *9a–9d* wherein bit 7 is set for all indicators which are positioned in row 7 and which are to be operated.

Next, a five-bit index value, I, is selected. The index (at 374) set to a value equal to one. The index I is used for determining when all 32 display words stored in the OUTPUT BUFFER location have been transmitted via the PIA 246 into the display driver storage unit 128.

To transmit the first of the display words stored at the OUTPUT BUFFER locations, all bits of the PIA data direction register B are set to allow output from the data register B (at 376) and bits 2, 3, 4 of the PIA data direction register A are set to allow input to the data register A (at 378).

Next, as indicated at 380, the contents of the first display word containing OUTPUT BUFFER locations are written into the PIA data register B. Next, it is determined, if and when the states of the signals on the lines 144, as generated by the counter 210 and input to the PIA data register A as bits 2–4, equals the three highest order bits of the increment I. Upon this condition the address of the display driver storage unit 128 matches the address of a proper group of storage locations in the OUTPUT BUFFER. One of these locations is to receive the word in the PIA data register B, as will be explained. This operation is indicated at 382. When the three bits match, all bits of the PIA data direction register A are set for indicating that an output from the B register of the PIA 246 is desired. This is indicated at 384.

Thereafter, the five-bit value of increment I is written into the PIA data register A (at 386) and the PIA control line CA2 is set to a logic 1 (at 388). The first two bits of the data register B are output and supplied to the display driver register 128 as the two least significant of the five address bits needed to identify the specific storage location into which the DISPLAY WORD is to be written. Setting of the CA2 control line triggers the writing of the DISPLAY WORD from the PIA data register B into the addressed display driver storage location 128. Because these functions are occurring at a one-megahertz rate, and the signals on the lines 144 are occurring at only a 200 Hertz rate, the address on the lines 144 is still equal to the highest order bits of the increment I.

Next, as indicated at 390, the control signal CA2 of the PIA is reset to zero, indicating that the write operation has taken place. At 392 it is shown that the index I is incremented by one and, if the incremented value is less than 32 (at 394), control is returned to the function 378 for writing another DISPLAY WORD from the OUTPUT BUFFER into the display driver storage unit 128. As soon as the index I exceeds 32, all 32 DISPLAY WORDS have been written into the display driver storage unit 128 for operating the display 12 and the DISPLAY subroutine has accomplished its purpose.

The Input Subroutine

Figure 19:
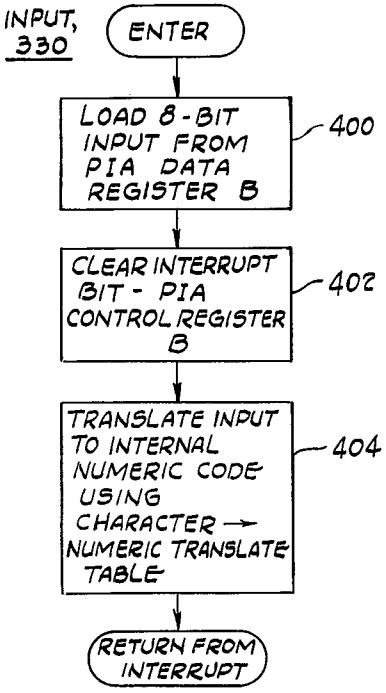

The INPUT subroutine is shown in FIG. 19. Whenever an input switch 64 is actuated and whenever the CB1, CB2 control signals of the PIA 246 are generated in the proper states, the eight-bit encoded play instruction word is input through the buffer 63 into the PIA data register B. This is indicated at 400. Then the CB2 control signal is cleared, disabling the buffer 63. This is indicated at 402.

After the encoded eight-bit play instruction has been input into the PIA 246, the controller 120 (at 404) converts it into an internal numeric code using a CHARACTER-to-NUMERIC translation table which is stored in the ROM 244. The CHARACTER-to-NUMERIC translation table converts from the ASCII encoding of the encoder 62 into the internal numeric code. Table 4 below lists the internal numeric codes which are generated for a particular switch 64 actuation.

TABLE 4

| ASCII Character Representation of Key Pushed | Function | Internal Numeric Code |
|---|---|---|
| 9 | PIP 1 | 1 |
| 8 | PIP 2 | 2 |
| 7 | PIP 3 | 3 |
| 6 | PIP 4 | 4 |
| 5 | PIP 5 | 5 |

TABLE 4-continued

| ASCII Character Representation of Key Pushed | Function | Internal Numeric Code |
|---|---|---|
| 4 | PIP 6 | 6 |
| 3 | PIP 7 | 7 |
| 2 | PIP 8 | 8 |
| 1 | PIP 9 | 9 |
| | PIP 10 | 10 |
| 0 | PIP 11 | 11 |
| i | PIP 12 | 12 |
| u | PIP 13 | 13 |
| y | PIP 14 | 14 |
| t | PIP 15 | 15 |
| r | PIP 16 | 16 |
| e | PIP 17 | 17 |
| w | PIP 18 | 18 |
| q | PIP 19 | 19 |
| l | PIP 20 | 20 |
| k | PIP 21 | 21 |
| J | PIP 22 | 22 |
| h | PIP 23 | 23 |
| g | PIP 24 | 24 |
| f | A's BAR | 25 |
| d | B's BAR | 26 |
| s | ROLL DICE | 30 |
| a | I DOUBLE | 31 |
| j | I REFUSE | 32 |
| ? | BEAR OFF | 27 |
| . | RE-MOVE | 28 |
| , | FINALIZE | 29 |
| m | I ACCEPT | 33 |

Referring again to FIG. 13, operation through the WHO FIRST routine has been described. At this point, the display 12 has been conditioned by the programmable controller 120 to indicate the first CHANCE VALUES and to indicate which contestant is to initiate play via the input of a play instruction to the input mechanism 20. A MOVE CYCLE routine 410 is then called up under control of the DRIVER routine 354.

The Move Cycle Routine

According to the MOVE CYCLE routine 410, the PLAY indicators 16 representing PIP occupancies and the BAR STATUS indicators 30 are operated to initially provide provisional PLAY VALUES. That is, for each pair of move instructions submitted by a contestant to define a play instruction, the first move instruction decreases the indicated occupancy at a first PIP, and the second move instruction increases the indicated occupancy at another PIP. There, operations provide a provisional PLAY VALUE on the display 12 until the particular play instructions have been validated for allowability according to the rules of backgammon. If the particular play instruction was allowed under the rules of backgammon and after the contestant has energized the FINALIZE switch 84, the provisional PLAY VALUE is accepted as allowed and becomes the PLAY VALUE.

Operation of the PIP indicators 16 includes a REMOVE CYCLE and an ADD CYCLE. During the REMOVE CYCLE, only inputs resulting from operation of the PIP switches 66, from the BAR switches 68, 70 and from the RE-MOVE switch 82 are allowed. The controller 120 is nonresponsive to operation of any of the other switches during this cycle.

During the ADD CYCLE, only a play instruction resulting from the operation of the PIP switches 66, the BEAR OFF switch 80, the RE-MOVE switch 82, and the FINALIZE switch 84, are allowed.

During the REMOVE CYCLE the data processor 120 ignores any move instruction which attempts to remove a MAN from a PIP which is not occupied by one or more MEN of the MOVING contestant.

During the ADD CYCLE, the move instruction is ignored unless there are: (1) zero men on the PIP, (2) one or more the the MOVING contestant's MEN on the PIP or, (3) no more than one of the NONMOVING contestant's MEN on the particular PIP. In the latter case where the MOVING contestant adds his MAN to a PIP previously occupied by the NONMOVING contestant's MAN, the NONMOVING contestant's MAN is automatically removed to the BAR (i.e., the NONMOVING contestant's BAR STATUS indicators 30 are operated).

Figure 20A:
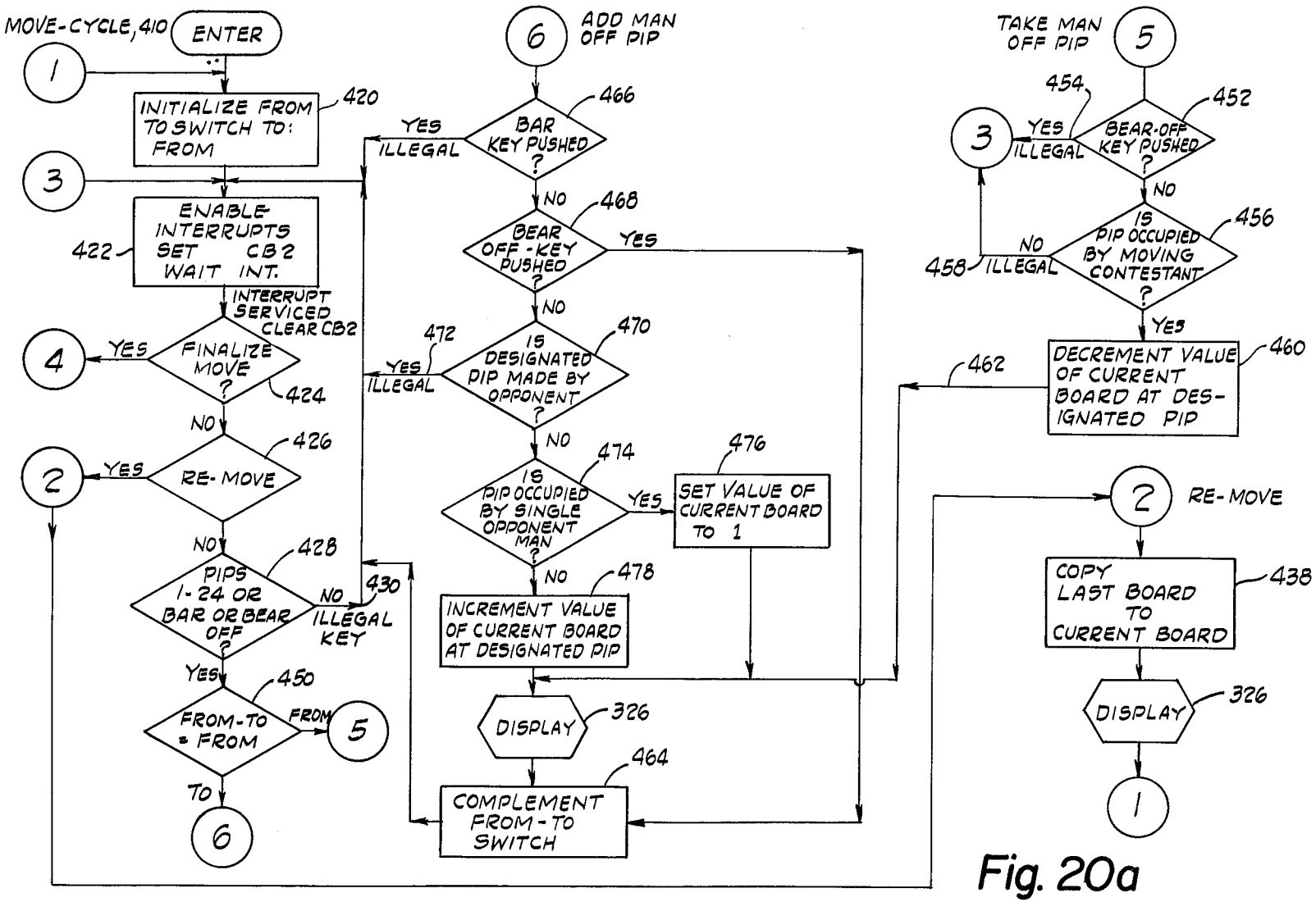
Figure 20B:
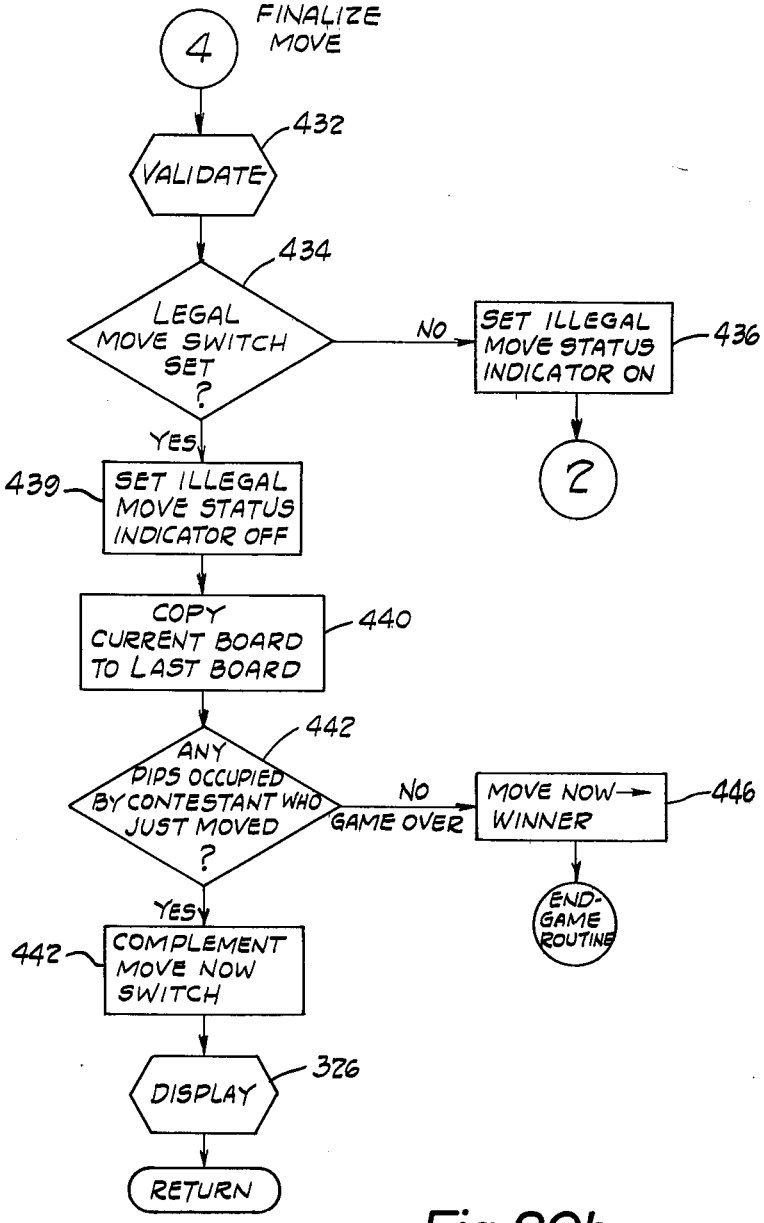

The MOVE CYCLE routine 410 is shown in detail in FIGS. 20*a*–20*b*. A storage location in the RAM 241 is designated a FROM-TO switch. The FROM-TO switch is operated as a flag to indicate whether the present state of operation is within the REMOVE CYCLE or the ADD CYCLE, indicating whether the particular indicators at addressed PIP locations should be increased in value or decreased in value.

The first step (indicated at 420) in the MOVE CYCLE routine 410 is to initialize the FROM-TO switch to a FROM value for indicating that a particular cycle is the REMOVE CYCLE. At 422 it is indicated that the PIA control line CB2 is set, enabling the input of an awaited move instruction. After the move instruction has been entered through the input mechanism 20, it is checked to see if it resulted from operation of the FINALIZE switch 84 (indicated at 424) or resulted from operation of the RE-MOVE switch 82 (indicated at 426). If the move instruction resulted from operation of either of these keys, it is checked to see whether it resulted from operation of the PIP switches 66, the BAR switches 68, 70 or the BEAR OFF switch 80 (indicated at 428). The origin of the move instruction is verified as one of these sets of switches because these switches are the only switches which may be validly operated at this time. If the move instruction was illegal, as indicated at 430, control is transferred back to location 422, awaiting a subsequent move instruction.

Referring back to the location 424, if the move instruction resulted from actuation of the FINALIZE switch 84, then operation is transferred to a VALIDATE subroutine 432 (FIG. 20*b*). The VALIDATE subroutine 432 is shown in detail in FIG. 21 and will be explained in detail subsequently. If the VALIDATE subroutine 432 indicates that the move instruction was legal or allowed according to the rules of backgammon, a predesignated location, referred to as the MOVE LEGAL switch, in the RAM 241, is set. If the MOVE LEGAL switch is "off" or cleared, the previously entered move instruction is invalid or disallowed according to the rules of backgammon.

Referring to FIG. 18*b*, if the VALIDATE subroutine 432 resulted in a clearing of the MOVE LEGAL switch, as checked at 434, the ILLEGAL MOVE indicators 46 are operated (shown at 436), and control is returned to the RE-MOVE location 426 (FIG. 20*a*). Thereafter, as indicated at 438 the LAST BOARD is copied into the CURRENT BOARD location for effectively erasing the previously input move instruction. Then the DISPLAY subroutine 326 is called into play for resetting the display 12 to the previous PLAY VALUE. Control then returns back to the location 420, awaiting another attempt to enter a valid move instruction.

Referring again to FIG. 20*b*, if the VALIDATE subroutine 432 has resulted in the MOVE LEGAL switch being set, then the ILLEGAL MOVE indicators 46 are reset (indicated at 439) if they have been set due to the input of a previous illegal move instruction.

Then as indicated at 440, the values of the storage locations in the RAM 241 designated as the CURRENT BOARD are copied into the storage locations in the RAM 241 which are designated the LAST BOARD.

It is then checked to see whether the most recently input move instruction has resulted in removal of the MOVING contestant's MEN from all PIPS. If some of the MOVING contestant's MEN remain on PIPS (at 442), then the MOVE NOW switch in the RAM 241 is complemented to indicate that it is now the other contestant's turn to become the MOVING contestant and to enter the play instruction. This is indicated at 444. The DISPLAY subroutine 326 is then called into play, and control is returned to the DRIVER routine 354.

If at location 442 it is determined that the MOVING contestant has no MEN occupying any of the PIPS, then the game is over and the MOVING contestant, then represented by the MOVE NOW switch, is declared the winner (at 446) and and END GAME routine 448 is called into play. The END GAME routine is characterized by a flow diagram in FIG. 29 which will be explained subsequently.

Referring again to FIG. 20*a* and to location 428, if a move instruction has been initially examined and has been determined to have its origin from either the PIP switches 66, or from the BAR switches 68, 70, or from the BEAR OFF switch 80, the FROM-TO switch is interrogated (at 450) to determine its state. If it is in a state indicating FROM (i.e., that operations are currently in the RE-MOVE cycle) then the play instruction is interrogated to see if its origin was from the BEAR OFF switch 80 (indicated at location 452). If so, because operation of the BEAR OFF switch 80 is legal, or valid, during only the ADD CYCLE, the move is classified as illegal (at 454) and control returns to the location 422.

If the BEAR OFF switch 80 did not produce the subject move instruction, the location of the PIP from which the MOVING contestant is attempting to RE-MOVE a MAN is interrogated to see whether the MOVING contestant has a MAN on the PIP for removal. This is indicated at 456 and if no MAN occupies the particular PIP, control is returned to the location 422 via the line 458.

If the MOVING contestant has a MAN on the particular PIP, the value of the CURRENT BOARD at the designated PIP is decreased by one (at 460). Control is then transferred via a line 462 to the DISPLAY subroutine 326 which causes the display 12 to be adjusted accordingly. Then, as indicated at 464, the FROM-TO switch in the RAM 241 is complemented and control is returned to the location 422 awaiting a new play instruction.

Referring again to location 450 in FIG. 20*a*, if the state of the FROM-TO switch indicates that the switch is in the TO position, indicating that PIP occupancy is to be increased, the move instruction is interrogated to see whether it resulted from actuation of the MOVING contestant's BAR switch 68, 70. This is indicated at 466. If so, the move is illegal as the BAR switches 68, 70 are allowed only to remove MEN from PIPS, limiting operation of the BAR switches 68, 70 to the ADD CYCLE.

Next (at 468) the play instruction is interrogated to see whether the BEAR OFF switch 80 has produced the move instruction. If so, control is transferred to the location 464 which results in complementing of the FROM-TO switch. Otherwise, as indicated at 470, the occupancy of the designated PIP is checked to see whether the opponent of the MOVING contestant has two or more MEN occupying the PIP. If so, as indicated at 472, the move is illegal and control is transferred to the location 422. If not, the designated PIP is checked to see whether the NONMOVING contestant has a single MAN on the PIP. This is indicated at 474. If so, the value of that PIP on the CURRENT BOARD is set to one (at 476) and the DISPLAY subroutine 326 is called into play. Otherwise the value of the CURRENT BOARD at the designated PIP is incremented by one (at 478) and then the DISPLAY subroutine 326 is called into play and control continues from there.

Referring again to the FINALIZE move location 424 in FIG. 20*a*, whenever the FINALIZE switch 81 is operated, the previously input play instruction must be validated by the VALIDATE subroutine 432. The VALIDATE subroutine indicates whether the MOVING contestant's play instruction was legal according to the rules of backgammon; i.e., whether for given PLAY and CHANCE VALUES, the particular play instruction is legal. To this end, the VALIDATE subroutine 432 cooperates (FIG. 13) with a MOVES subroutine 48.

The MOVES subroutine 480 which, in turn, may call a MOVMAN routine 482, a PROCES routine 484, a PUSH routine 486, a POP routine 488 and a SUB-MOVE routine 490, serves to generate all possible moves for a given roll of the DICE producing DIE1, DIE2 values (i.e., for given values of RL1, ROLL 1 and RL2, ROLL 2). For unequal DIE1, DIE2 values, the MOVES subroutine requires two individual moves—one for each die to constitute a complete move. The exeption to this is that if the MOVES routine is called and no move is possible utilizing both dice, it will be called again withe DIE2 = −1. The MOVES routine will now try to complete a move using DIE2 (the largest die) only. If this too fails, MOVES will be called attempting to make a move with DIE1 only. If this also fails, no move is possible and control is returned to the VALIDATE routine 432.

For a DOUBLES roll, both DICE are equal. Since in backgammon, a DOUBLES roll yields a move of four times the value of the die, DIE2 is set to minus four. The MOVES routine then generates all possible moves. If none are possible, the VALIDATE routine calls the MOVES routine again with DIE2 = −3. The MOVES routine now generates all possible moves with three times the die value. If none are possible, the sequence is repeated with two and then one times the value of the die, finally returning to the VALIDATE routine 437.

Each time a legal move is generated, a call is made to the PROCES routine 4 so that a comparison between the contestant-generated move and the legal moves can be made.

The MOVES routine uses four temporary PLAYING BOARDS to generate all possible moves for a given CHANCE VALUE. The LEVEL-TWO BOARD is the working BOARD used to build a COMPLETE move. LEVEL-THREE, -FOUR, and -FIVE BOARDS are used to store PARTIAL moves.

After the VALIDATE routine 432 has been executed and control has been returned to the MOVE CYCLE routine 410, and after the MOVE CYCLE routine is executed, a REVTAB routine 492 is called. When control returns from MOVE CYCLE, the MOVING contestant's move has been successfully validated and the game is not yet over. REVTAB is called to logically reverse the LAST BOARD. The MOVING contestant now becomes the OPPONENT contestant and the OPPONENT contestant becomes the MOVING contestant.

After returning from REVTAB, the new MOVING contestant may either double or roll the DICE. A DOUBLE routine 494 is called to determine whether the MOVING contestant may double at this time and to update the CUBE if he executes a legal double. If the opponent accepts, control returns to the DRIVER routine 354; if he refuses, the game is over and control transfers to the END GAME routine 448.

The DICE routine 322 is now called to generate and display the next roll of the DICE. The pseudo-random number is determined by the delay of human response in pushing the ROLL DICE switch 44.

Control now transfers to MOVE CYCLE again and the logic cycle repeats. When the game is ended, either because a DOUBLE was refused in routine DOUBLE or the MOVING contestant has BORNE OFF all his MEN, control is transferred to END GAME.

The END GAME routine determines if the game has ended in a normal game, gammon, or backgammon. The winning contestant's score totals are updated accordingly and displayed. Control then transfers to RESET NEXT to start the next game.

The Validate Routine

Figure 21:
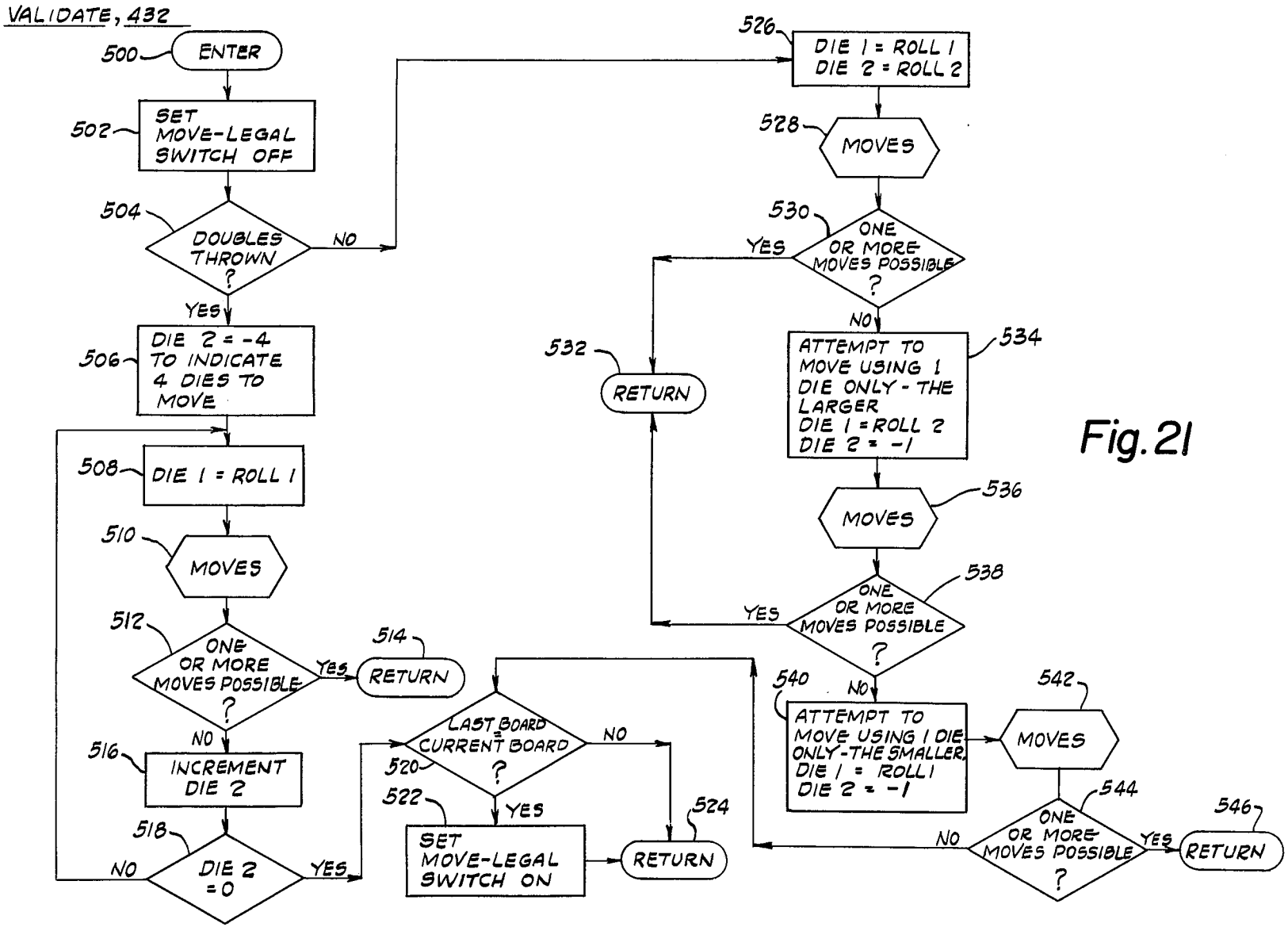
Figure 22A:
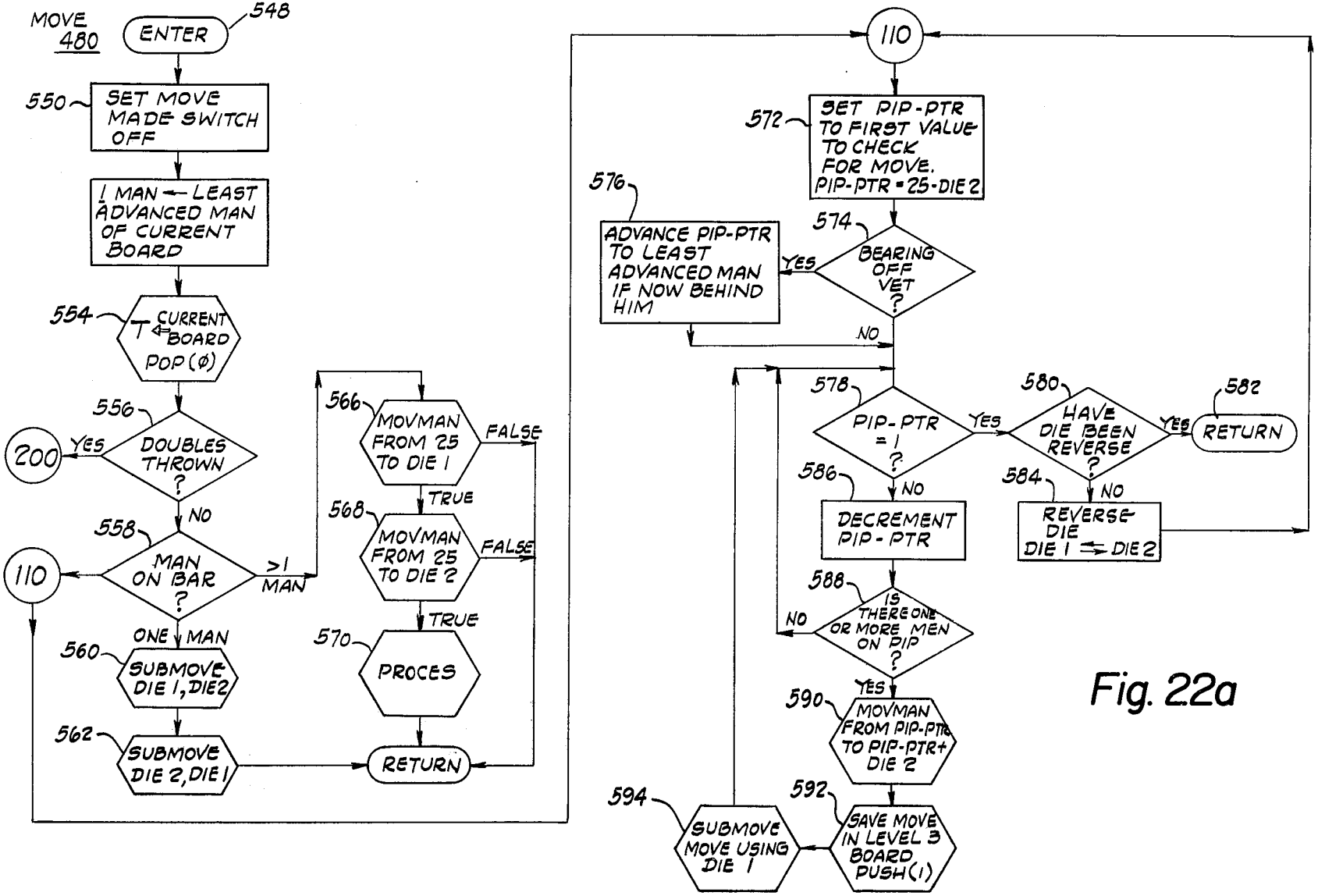
Figure 22B:
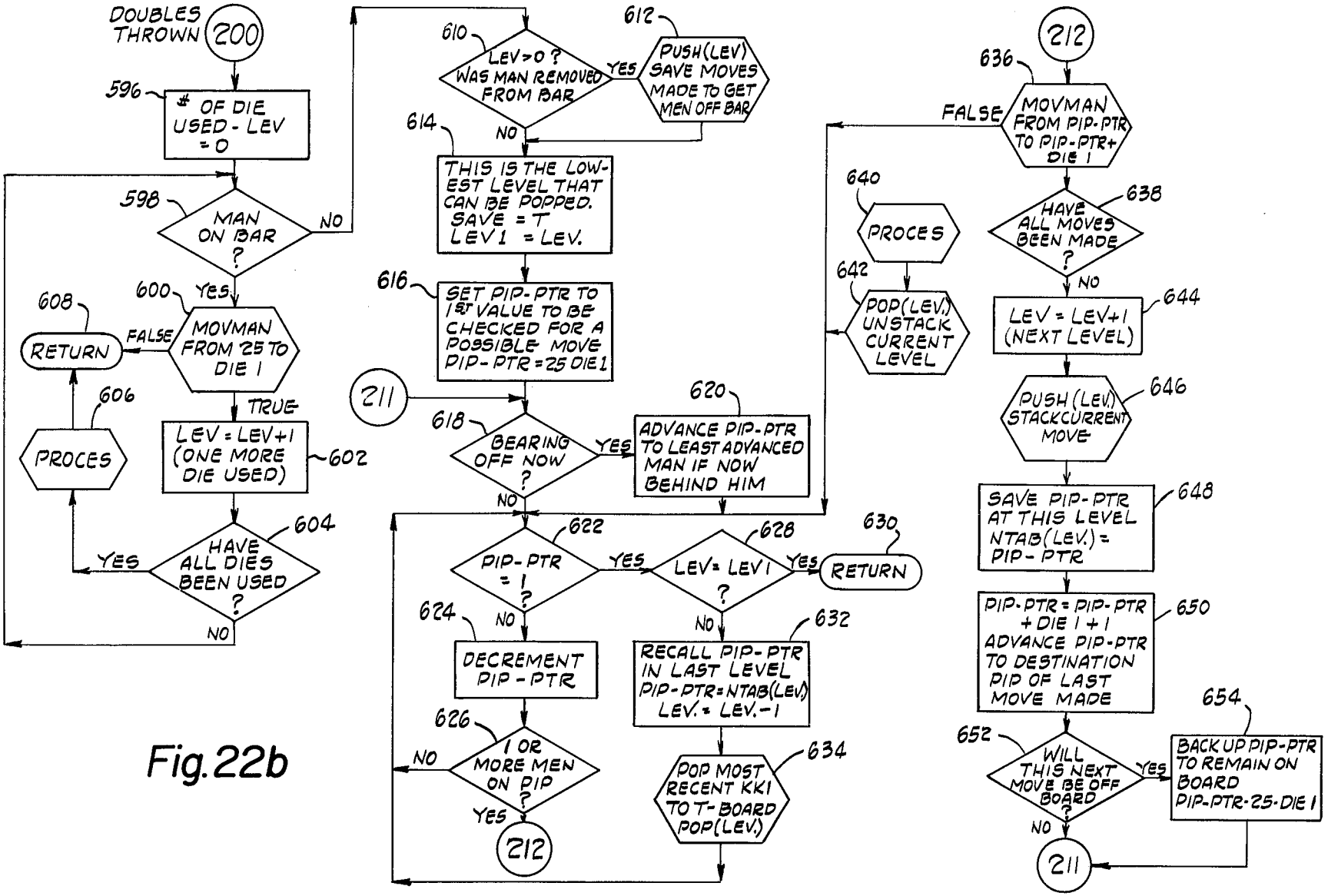

Referring to FIG. 21, the VALIDATE routine 432 is shown in detail. The VALIDATE routine entry point is at 500. The routine is called from the MOVE CYCLE routine after the FINALIZE SWITCH 84 is pushed. As indicated at 502, the MOVE LEGAL switch is turned on as soon as a legal move is found; this happens in the routine PROCES 484. It is now initialized to the "off" condition.

At 504, if DOUBLES are rolled (ROLL 2=0), control transfers to block 506 and to block 526, if not because different procedures are used to call the MOVES routine 480. Operation transfer to 506 if DOUBLES are rolled. DIE2 is set to the complement of the number of PARTIAL moves which constitute a COMPLETE move. Initially this is minus four.

At 508 the value from 1 to 6 of the DIE stored in ROLL 1 is coped to DIE1 which is an argument of the MOVES routine. At 510, the call to the MOVES routine is made. All possible legal moves are generated. If a move was found which matches the MOVING contestant's CURRENT BOARD, the MOVE LEGAL switch is now "on."

After returning from the MOVES routine, as shown at 512, if there were no moves possible with the current value of DIE2, go to block 516. If there was at least one move possible, the validation is complete and control is returned to the MOVE CYCLE routine 410. This is shown at 514.

As seen at 516, if no COMPLETE move was found (i.e., if DIE2 was minus four, implying four PARTIAL moves=1 COMPLETE move, and the MOVING contestant cannot move all four values of the DIE). DIE 2 is incremented to try to complete a move with less than four PARTIAL moves. Then DIE2 is tested for equaling zero (at 518). If no COMPLETE moves are possible using 4, 3, 2, or PARTIAL move, go to 520. Otherwise, go to block 508 and repeat the call to the MOVES routine.

Operations transferred to 520 if no COMPLETE move is possible. The LAST BOARD must then be equal to the CURRENT BOARD to constitute a legal move. If so, go to 522; if not, contestant's move is illegal—go to 524 for returning to the MOVE CYCLE routine. If operation is to 522, the move is legal, and the MOVE LEGAL switch is set "on."

Referring again to 504, operation is transferred to 526 if doubles are not rolled. The arguments DIE1 and DIE2 are set to the respective DIE value, and the MOVES routine is then called (at 528) to generate all possible moves utilizing both DICE.

After returning from the MOVES routine (at 530) is one or more COMPLETE moves utilizing both DICE were found—go to 532 and return control to the MOVE CYCLE routine. Otherwise, as shown at 534, a COMPLETE move utilizing both DICE is not possible. A call to the MOVES routine is set up with a COMPLETE move defined as a PARTIAL moves using ROLL 2, the larger DIE. DIE2 is set to a value of minus one which tells the MOVES routine that only one die value constitutes a COMPLETE move. At 536, the MOVES routine is called to generate all possible COMPLETE moves utilizing ROLL 2.

After returning from the MOVES routine at 538, if one or more COMPLETE moves utilizing the larger die was found—go to 532 and return control to the MOVE CYCLE routine. Otherwise, at 540, set up a call to the MOVES routine using the smaller die, ROLL 1. Again, DIE2 is set to minus one as in block 534.

At 542, the MOVES routine is called to generate all possible complete moves utilizing ROLL 1. At 544, if no COMPLETE moves were found then the MOVING contestant cannot move at all, so go to 520. Otherwise, one or more COMPLETE moves was found, so (at 546) return to the MOVE CYCLE routine.

The Moves Routine 480

The MOVES routine 480 is shown in detail in FIGS. **22*a*–22*b* and is explained in detail in Table 4 as it calculates all possible (valid) moves. As the MOVES routine 480 calls the MOVMAN routine 482, PROCES routine 484, PUSH routine 486, POP routine 488, and SUBMOVE routine 490, a brief description of each is given in Table 5. The routines 482–490** are explained in detail in other tables and in other figures.

TABLE 5

| Location | Description |
|---|---|
| 548 | MOVES routine entry point. All calls are made from the VALIDATE routine. Arguments DIE1 and DIE2 are passed to the MOVES routine. Initialize MOVE MADE switch indicating whether any complete move has been made. This switch will be turned "on" in the routine PROCES if a complete move is found and vice-versa. |
| 552 | The least advanced MAN is the PIP number of the |

TABLE 5-continued

| Location | Description |
|---|---|
| | location of the least advanced MAN. Its value, LMAN, is zero if there is a MAN on the BAR. Otherwise the value is 1 through 24. |
| 554 | Routine POP having an argument 0 is called. The routine POP copies the previously save levels 1, 3, 4, 5 to the level 2 or T board. In the present case call copies the CURRENT BOARD to the T board or working board. This copy includes the least advanced man value. |
| 556 | The DIE values are checked to see if doubles were thrown. Double rolls use a different algorithm than nondoubles rolls. If doubles are thrown (ROLL 2 = 0) go to block 596 (FIG. 22b). |
| 558 | If there is a MOVING contestant's MAN (MEN) on the BAR (of the CURRENT BOARD) it must be moved onto the board before other MEN can be moved. If there are none, go to 572. If one MAN is on the BAR, go to the next block. If more than one, go to 566. |
| 560 | The SUBMOVE routine is called to generate all COMPLETE moves using DIE2 to get a single MAN off the BAR and DIE1 to generate the other PARTIAL moves. |
| 562 | The SUBMOVE routine is called again to generate all PARTIAL moves using DIE1 to get a single MAN off the BAR and DIE2 to generate the other PARTIAL moves. |
| 564 | Return to the VALIDATE routine. |
| 566 | There are two or more MEN on the BAR. Therefore, both DICE must be used to place MEN on the board. The MOVMAN routine is utilized here. The MOVMAN routine makes one PARTIAL move by moving a single MAN from its FROM argument to its TO argument. If the PARTIAL move cannot be made, because the MAN is blocked by opponent's MEN, the routine returns with a FALSE status. Otherwise, the routine returns TRUE. AT 566, the MOVMAN is called to move a MAN from PIP 25 (PIP 25 designates the BAR) to the destination PIP using DIE1. Control passes to the next block if MOVMAN is TRUE; if FALSE, control returns to VALIDATE because both DICE cannot be utilized. |
| 568 | MOVMAN is called again to move the MAN on BAR to the destination PIP using DIE2. If MOVMAN is FALSE, control returns to VALIDATE. |
| 570 | PROCES is called to VALIDATE the COMPLETE move. PROCES compares the contestant's CURRENT BOARD to the working board. If they match then the contestant's move is legal and the MOVE LEGAL switch is turned "on." Control is then returned to VALIDATE at block 564. |
| 572 | There are no MEN on the MOVING contestant's BAR. The PIP-PTR is a search pointer which stores the current value of the PIP to be searched for a MOVING contestant's MAN. PIP-PTR is initialized to 25-DIE2. This insures that a PARTIAL move using DIE2 will not be off the board. |
| 574 | If the least advanced MAN on the working board is greater than 18 then the MOVING contestant may BEAR OFF his MEN—all MEN are in the HOME AREA. If this condition is not met, go to block 578. |
| 576 | The MOVING contestant is BEARING OFF his MEN from the board. Make sure the PIP-PTR is not "behind" the least advanced MAN. The term "behind" indicates the PIP-PTR value is less than the least advanced MAN. Note, when BEARING OFF the DIE value may take the MAN off the board and beyond and therefore the PIP-PTR is not subject to the restriction explained in block 572. |
| 578 | If the PIP-PTR = 1, the search for PARTIAL moves using DIE2 is completed, go to 580. Otherwise, the search continues; go to 580. |
| 580 | In backgammon, different results are possible when the other DIE is played first. Thus, after all COMPLETE moves have been generated with DIE2 played first, the DICE are interchanged and all COMPLETE moves using DIE1 first are generated. If this has not yet been done, go to 584. Otherwise, all moves have been made; return to VALIDATE. |
| 582 | Return to VALIDATE. |
| 584 | Interchange DIE1 and DIE2 values and repeat the move generation procedure by transferring to block 572. |

TABLE 5-continued

| Location | Description |
|---|---|
| 586 | The PIP-PTR is reduced by one to search the next PIP. |
| 588 | If there is a MOVING contestant's MAN (or MEN) on a PIP, go to 590. This implies that the working board value of the selected PIP is greater than 0. Otherwise, continue search at block 578. |
| 590 | Call MOVMAN (explained in block 566) to move a MAN from the PIP-PTR PIP to the PIP-PTR + DIE2 PIP. |
| 592 | The PUSH routine is called with an argument of one. The PUSH routine save the working board in one of the PLAYING BOARDS which,, in the present case, is the LEVEL-THREE BOARD. This includes the least advanced MAN value. |
| 594 | SUBMOVE is called using DIE1. SUBMOVE uses the working board and makes all possible PARTIAL moves using DIE1. PROCES is called for each COMPLETE move. Control is then transferred to block 578 to continue the PARTIAL moves using DIE2. |
| 596 | DOUBLES (in FIG. 22b) have been rolled. The number of die used is initialized to zero. This value is later compared to DIE2 to determine if all PARTIAL moves have been made. |
| 598 | If there are any MEN on the BAR of the LAST BOARD they must be moved first; go to 600. If none are on the BAR, go to 606. |
| 600 | Each call to MOVMAN (routine explained in block 566) removes one MAN off the BAR (PIP 25) and places it on the working board. If the move cannot be made, control returns to VALIDATE (block 608). All DICE cannot be utilized. |
| 602 | The number of DICE used (or PARTIAL moves made) is incremented and stored in a variable LEV. |
| 604 | If LEV is equal to the complement of DIE2, then all PARTIAL moves have been made. The COMPLETE moves is processed at block 606. If there are still PARTIAL moves to be made, control transfers to block 598. |
| 606 | PROCES (explained in block 570) is called to VALIDATE the contestant's move. |
| 608 | Return to VALIDATE. |
| 610 | At this point there are no MEN left on the MOVING contestant's BAR. If LEV is greater than 0, one or more MEN which were on the BAR have been placed on the board, go to 612. If LEV = 0, no MEN were on the BAR, go to 614. |
| 612 | Save the working board with only the PARTIAL moves required to move all MEN off the BAR in BOARD LEVEL THREE, FOUR or FIVE depending whether there was one, two, or three MEN on the BAR, respectively. This is done with a call to the PUSH routine with argument LEV. |
| 614 | Save LEV variable called LEVI. This represents the number of PARTIAL moves required to get all MEN off the BAR and is the "base" below which it cannot be restored. This is because all MEN on the BAR must be moved before other PARTIAL moves may be made. |
| 616 | Initialize PIP-PTR to 25-DIE1. This is the number of the first PIP to be searched for MOVING contestant's MEN. This value insures that no PARTIAL move will result in a move off the board. |
| 618 | If the least advanced MAN on the working board is greater than 18, the MOVING contestant is in the bearing off phase; go to 620. Otherwise, go to 622. |
| 620 | Adjust the PIP-PTR so the search is not started behind any of the MOVING contestant's MEN. When BEARING OFF the DIE value may take a MAN off the board and beyond. PIP-PTR is not subject to the restriction explained in block 616. |
| 622 | If the PIP-PTR = 1, the search at the current level is completed. Start search at former level with transfer to block 628. |
| 624 | Reduce PIP-PTR by one to back up search to next PIP. |
| 626 | If PIP is occupied by MOVING contestant, go to 636; otherwise, continue search at block 622. |
| 628 | Compare the CURRENT level with the Base level LEVI. If the BASE level has been reached, the generation of all COMPLETE moves has been done; control returns to VALIDATE. |
| 630 | Return control to VALIDATE. |
| 632 | Prepare to restore to level last saved. Restore the PIP-PTR (from NTAB vector) for the BOARD LEVEL being restored. Decrement the level indicator |

TABLE 5-continued

| Location | Description |
|---|---|
| | LEV by one. |
| 634 | Restore the last LEVEL BOARD by calling the POP subroutine with argument LEV. Transfer to block 622. |
| 636 | Move the MAN from PIP specified by PIP-PTR to PIP-PTR + DIE1. If the PARTIAL move cannot be made continue search at same BOARD LEVEL by transferring to block 622. |
| 638 | Have the required number of PARTIAL moves been made to constitute a COMPLETE move? (LEV = −DIE2?) If not, go to 644. |
| 640 | A COMPLETE moves has been generated. PROCES is called to VALIDATE the contestant's move against it. |
| 642 | The LAST SAVED LEVEL is restored by calling POP with argument LEV and the search for PARTIAL moves continues at the restored level by transferring to block 622. |
| 644 | Increment LEV to point to next LEVEL. |
| 646 | Save working board in LEVEL-THREE, −FOUR, or −FIVE BOARD by call the PUSH subroutine with argument LEV equal to 1, 2, or 3, respectively. |
| 648 | The PIP-PTR of the board just saved is also saved (in an NTAB vector). Thus, as each BOARD LEVEL is saved, its associated PIP-PTR is saved along with it. |
| 650 | The PIP-PTR is advanced to the destination PIP of the last PARTIAL move. One is added to the result because it is later subtracted (block 624) before the PIPS are searched. The result is that the algorithm attempts to move the same MAN for successive PARTIAL moves. |
| 652 | If this value of the PIP-PTR will result in a PARTIAL move off the board (PIP-PTR + DIE1 greater than 24) go to 654; otherwise, go to 618. |
| 654 | The PIP-PTR is backed up to 25-DIE1 to insure that a PARTIAL move will not result in a move off the board; go to block 618. |

Figure 23:
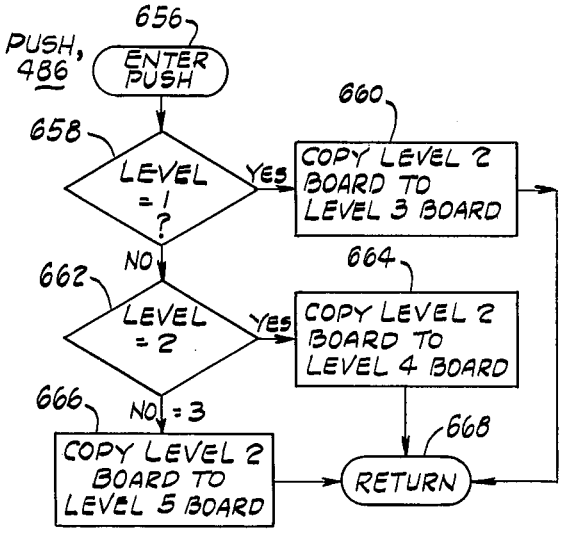

The PUSH routine 486 is shown in detail in FIG. 23 and is explained in Table 6.

TABLE 6

| Location | Description |
|---|---|
| 656 | PUSH routine entry point. PUSH is called by MOVES or SUBMOVE to save working board (LEVEL-TWO) in LEVEL-THREE, −FOUR, −FIVE BOARDS. One argument, LEVEL, is required. |
| 658 | If LEVEL = 1, go to 660; otherwise, go to 662. |
| 660 | The working board is saved in the LEVEL-THREE BOARD. This includes copying elements 1-24, 25 (MOVING contestant's BAR), 26 (opponent's BAR) and 27 (MOVING contestant's least advanced MAN). The board may subsequently be restored to the working board by calling POP with LEVEL = 1. Control then returns to the calling routine. |
| 662 | If LEVEL = 2, go to 664; otherwise, LEVEL must equal 3; go to 666. |
| 664 | The working board is saved in the LEVEL-FOUR BOARD—elements 1-27 as in block 660. A call to POP with LEVEL = 2 will restore the working board. Control then returns to the calling routine. |
| 666 | The working board is saved in the LEVEL-FIVE BOARD—elements 1-27 as in block 660. A call to POP with LEVEL = 3 will restore the working board. Control then returns to the calling routine. |
| 668 | Return to calling routine. |

Figure 24:
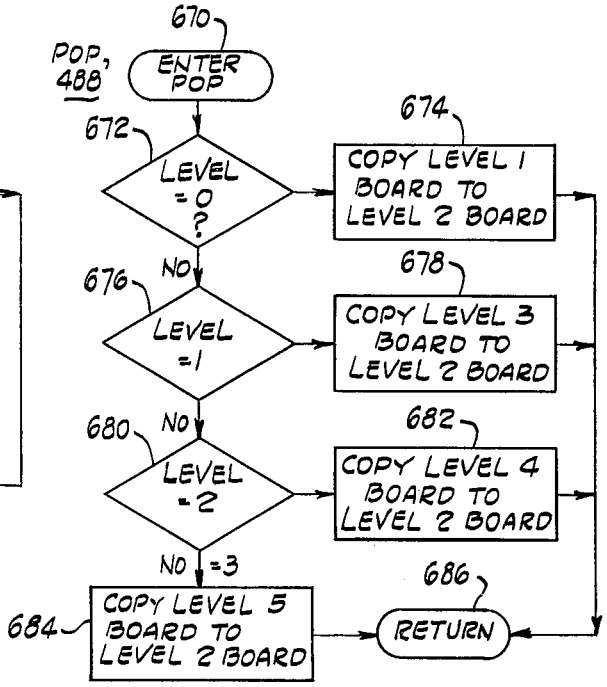
Figure 25:
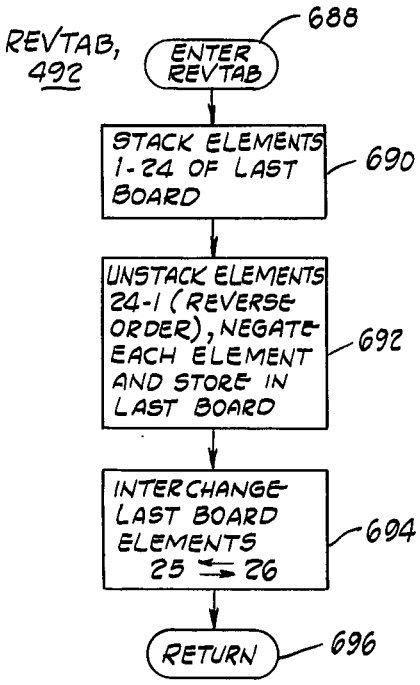

The Pop Routine 488 is explained in detail in the flow diagram of FIG. 24 and is explained in Table 7.

TABLE 7

| Location | Description |
|---|---|
| 670 | POP routine entry point. POP is called by MOVES or SUBMOVE to restore a previously saved board to the working board (LEVEL-TWO). One argument, LEVEL, is required. |
| 672 | If LEVEL = 0, go to 674; otherwise, go to 676. |
| 674 | The LEVEL-ONE or CURRENT BOARD is copied to the working LEVEL-TWO BOARD. This includes copying elements 1-24, 25 (MOVING contestant's BAR), 26 (opponent's BAR) and 27 (MOVING contestant's least advanced MAN). Control then returns to the calling |

TABLE 7-continued

| Location | Description |
|---|---|
| | routine. |
| 676 | If LEVEL = 1, go to 678; otherwise, go to 680. |
| 678 | The LEVEL-THREE BOARD is restored to the working board (LEVEL-TWO)—elements 1-27 as in block 674. Control then returns to the calling program. |
| 680 | If LEVEL = 2, go to 682; otherwise, LEVEL must equal 3, go to 684. |
| 682 | The LEVEL-FOUR BOARD is restored to the working board—elements 1-27 as in block 674. Control then returns to the calling program. |
| 684 | The LEVEL-FIVE BOARD is restored to the working board—elements 1-27 as in block 674. Control then returns to the calling program. |
| 686 | Return to calling program. |

The REVTAB Routine 492

A REVTAB routine 492 is provided. REVTAB is called by the DRIVER after each move is successfully VALIDATED. The LAST BOARD is logically reversed so the MOVING contestant and OPPONENT contestant interchange roles. The REVTAB routine is shown in detail in FIG. 25 and is explained in Table 8.

TABLE 8

| Location | Description |
|---|---|
| 688 | REVTAB routine entry point. |
| 690 | Using a conventional last-in, first-out stack (LIFO), elements 1 through 24 of the LAST BOARD are stacked element 1 first. Element 24 is therefore on "top" of the stack. This stack resides in the processor's |

TABLE 8-continued

| Location | Description |
|---|---|
| | random access memory (RAM 241). |
| 692 | Elements 24 through 1 are negated and restored to LAST BOARD in reverse order. The effect is: LAST BOARD (1) now becomes −LAST BOARD (24) LAST BOARD (2) now becomes −LAST BOARD (23), etc. |
| 694 | LAST BOARD elements 25 and 26 are interchanged. Logically, the MOVING contestant's BAR changes places with the OPPONENT contestant's BAR. |
| 696 | Control returns to the DRIVER. |

The SUBMOVE Routine 490

Figure 26:
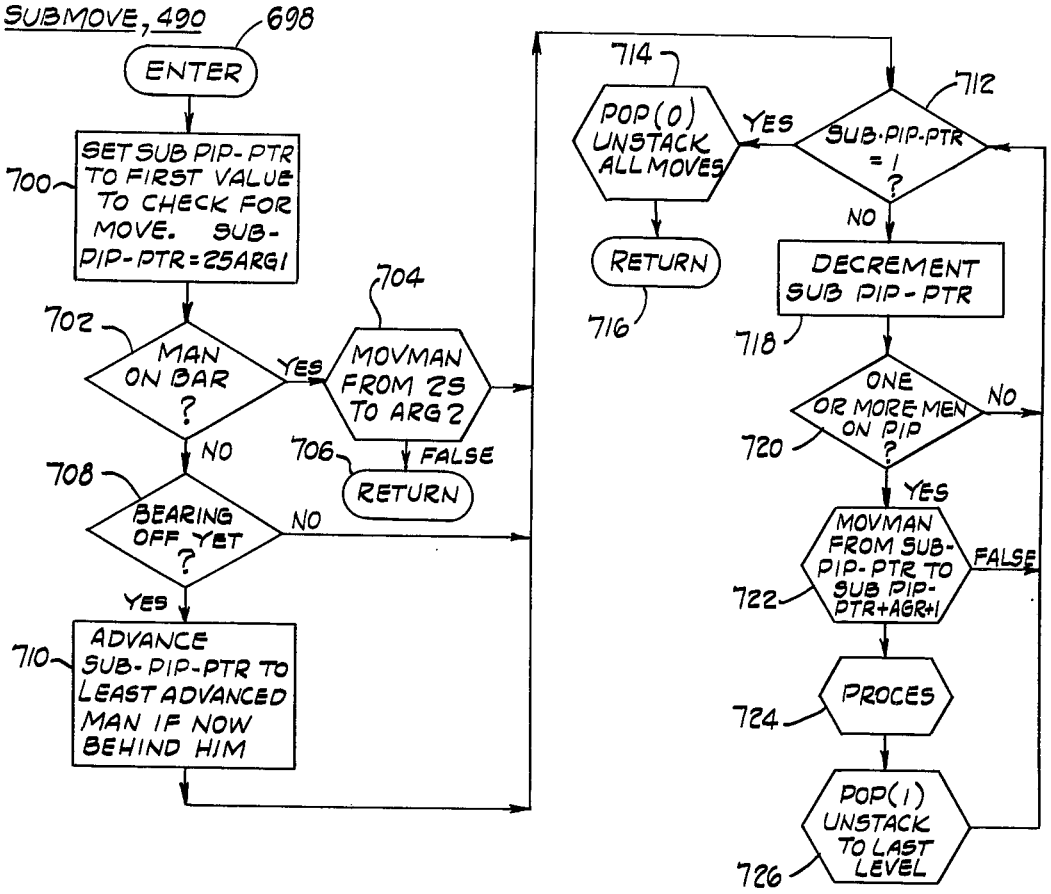

The SUBMOVE routine 490 is shown in detail in FIG. 26 and is explained in Table 9.

TABLE 9

| Location | Description |
|---|---|
| 698 | SUBMOVE routine entry point. SUBMOVE is called by MOVES to complete to move by making PARTIAL moves using two arguments ARG1 and ARG2. These arguments are set to the values of the DICE in MOVES. |
| 700 | The SUBPIP-PTR is analogous to the PIP-PTR used in MOVES (block 572). It points to the PIP in the working board to be searched for MOVING contestant's MEN. It is initialized to 25-ARG1 to insure that a PARTIAL move will not result in a move off the board. |
| 702 | If there is a MAN on the MOVING contestant's BAR, it must be moved before any other MEN may be moved. SUBMOVE is called only when there are zero or one MAN on the BAR. Cases with greater than one MAN are handled within MOVES. |
| 704 | Call MOVMAN (explained block 566) to move the MAN on BAR (PIP 25) to the PIP designated by ARG2. If successful, go to 712 to continue with PARTIAL move for ARG1. If not, a COMPLETE move cannot be generated, return to MOVES. |
| 706 | Return to MOVES. |
| 708 | If the least advanced MAN is greater than PIP 18, the MOVING contestant is in the BEARING OFF phase; go to 710; otherwise, go to 712. |
| 710 | The SUBPIP-PTR is adjusted to insure that it is not "behind" the least advanced MAN. This is explained in block 576. SUBPIP-PTR is set to "least advanced MAN + 1" if now behind him. |
| 712 | If SUBPIP-PTR = 1, the search for PARTIAL moves using ARG1 is complete fo the existing PARTIAL move using DIE2 in MOVES. If not equal to 1, go to 718. |
| 714 | Call POP with argument 0 to copy LAST BOARD to working board. Return control to MOVES to find next PARTIAL move using DIE2. |
| 716 | Return to MOVES. |
| 718 | The SUBPIP-PTR is reduced by one to search the next PIP. |
| 720 | If there are one or more MOVING contestant's MEN on the selected PIP, implying that the value of the |

TABLE 9-continued

| Location | Description |
|---|---|
| | working board is greater than 0, go to 722. Otherwise, continue search by transferring to 712. |
| 722 | Attempt to move MAN from the PIP designated by SUBPIP-PTR to SUBPIP-PTR + ARG1 with call to MOVMAN (explained block 566). If the move fails, continue PIP search by transferring to 712. |
| 724 | Call PROCES (explained in block 570) to compare COMPLETED move with contestant's CURRENT BOARD. |
| 726 | Restore the working board to the LEVEL-THREE BOARD with call to POP with argument equal to one. This logically erases the last PARTIAL move just made. The search continues by transferring to 712. |

The Proces Routine 484

Figure 27:
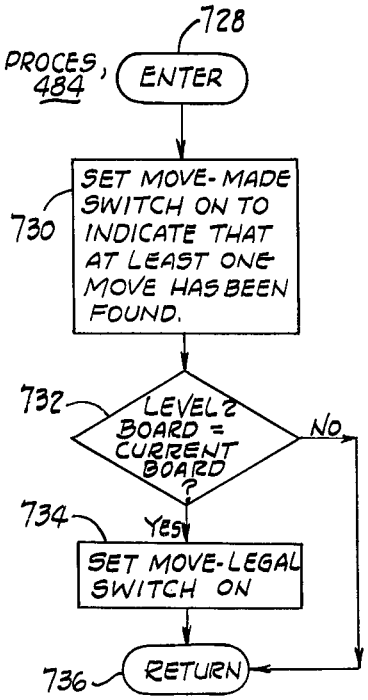

The PROCES routine is shown in detail in FIG. 27 and is explained in Table 10.

TABLE 10

| Location | Description |
|---|---|
| 728 | PROCES routine entry point. PROCES is called by MOVES or SUBMOVE to VALIDATE a COMPLETE move with the MOVING contestant's CURRENT BOARD. |
| 730 | Turn MOVE MADE switch on (initialized off at block 550) to indicate that at least one COMPLETE move has been generated. This switch is used in VALIDATE to determine whether additional calls to MOVES, with less PARTIAL moves constituting a COMPLETE move, is required. |
| 732 | The LEVEL-TWO or working BOARD is compared element by element (1 through 26) for equality. If any element is unequal, transfer to 736. |
| 734 | Turn MOVE LEGAL switch on to indicate that the MOVING contestant's move is legal. The contestant will be notified of the outcome when control returns to MOVE CYCLE. |
| 736 | Return to calling routine. |

The MOVMAN Routine 482

Figure 28:
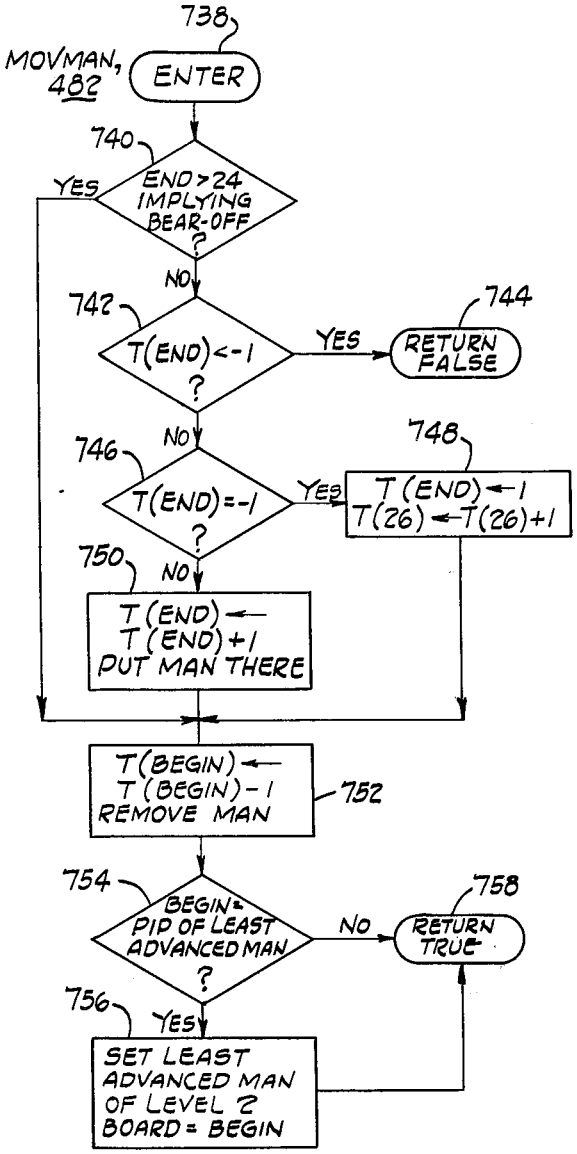

The MOVMAN routine 482 is shown in detail in FIG. 28 and is explained in Table 11.

TABLE 11

| Location | Description |
|---|---|
| 738 | MOVMAN routine entry point. MOVMAN is called by MOVES or SUBMOVE to move a single MAN from one PIP to another. The PIPS are designated by two arguments BEGIN and END. |
| 740 | If END is greater than 24, a BEARING OFF move is indicated. A BEARING OFF move is always successful; transfer to block 752. |
| 742 | If T(END) is less than −1, the destination PIP is made by the opponent and the move fails; go to 744. The T board is synonomous with the working or LEVEL-TWO BOARD. The term "made" means that a PIP is occupied by two or more MEN. |
| 744 | Return FALSE, PARTIAL move was not possible. |
| 746 | If T(END) = −1, the opponent was HIT at the destination PIP. A contestant HITS the opponent when landing on a PIP with a single opponent MAN |

TABLE 11-continued

| Location | Description |
|---|---|
| | occupying it. If so, go to 748; otherwise, go to 750. |
| 748 | The HIT opponent is removed from the PIP and the MOVING contestant's MAN is placed on T(END). The opponent is placed on the opponent's BAR by incrementing T(26) by 1; go to 752. |
| 750 | Here, no opponent was HIT. The PIP is updated by adding one to the value of T(END). |
| 752 | The PIP from which the MAN was removed is incremented by one. |
| 754 | If the MAN just moved from PIP BEGIN was the least advanced MAN on the working board, a new least advanced MAN must be found; go to 756. Otherwise, return TRUE to calling routine. |
| 756 | The working board is scanned from PIP 1 through 24. The first value greater tha 0 becomes the PIP occupied by the least advanced MAN. If the BAR (PIP 25) is occupied, the least advanced MAN is changed to 0. |
| 758 | Return TRUE to calling routine. |

The End Game Routine 448

Figure 29:
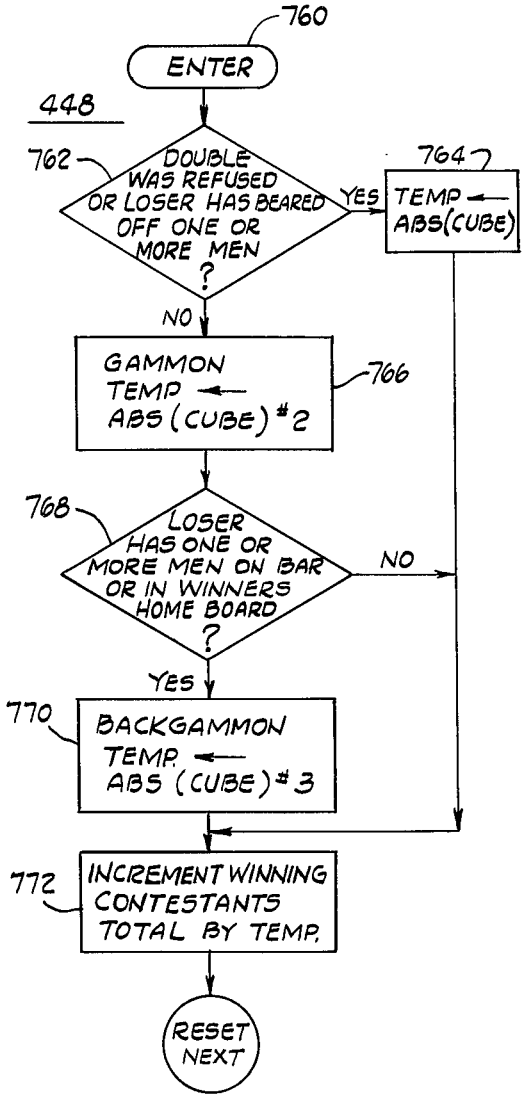

The END GAME routine 448 is shown in detail in FIG. 29 and is explained in Table 12.

TABLE 12

| Location | Description |
|---|---|
| 760 | END GAME routine entry point. END GAME is called by DOUBLE or MOVE CYCLE when the game has ended. One argument, WINNER, indicates which contestant won. If WINNER = 1, A won; if WINNER = 1, B won. If the game ended because of a refused DOUBLE, WINNER will equal 2 or −2 depending upon whether A any B won respectively. |
| 762 | If a DOUBLE was refused, WINNER will equal 2 or −2; go to 764 because gammons and backgammons are not |

TABLE 12-continued

| Location | Description |
|---|---|
| | possible. Add all negative elements of the CURRENT BOARD. If the sum does not equal −15, then the losing contestant has BORNE OFF at least one MAN and neither a gammon nor a backgammon has occurred; go to 764 if this is true. |
| 764 | Assign the absolute value of the DOUBLING CUBE to a temporary variable called TEMP. This represents the number of points by which the winning contestant's score will be incremented. The absolute value is used because the magnitude of CUBE indicates the CUBE VALUE and the sign of CUBE indicates CUBE OWNERSHIP. |
| 766 | At this point at least a GAMMON has occurred. Assign to temporary variable TEMP twice the absolute value of CUBE since a GAMMON is worth double stakes (see block 764 for explanation of CUBE). |
| 768 | If losing contestant has one or more MEN on the BAR (PIP 26) or any MEN in winner's HOME BOARD (PIPS 19–24 having ay element less than 0) then a BACKGAMMON has occurred; go to 770. Otherwise, go to 772. |
| 770 | A BACKGAMMON is worth three times the stake of a single game. Assign to temporary variable TEMP three times the absolute value of CUBE (see block 764 for explanation of CUBE). |
| 772 | The contestant's score totals are accumulated in ATOTAL and BTOTAL for contestant A and B, respectively. TEMP is added to ATOTAL if WINNER is greater than 0 or BTOTAL if WINNER is less than 0. Control subsequently transfers to RESET NEXT in the RESET routine to start the next game. |

The Double Routine 494

Figure 30:
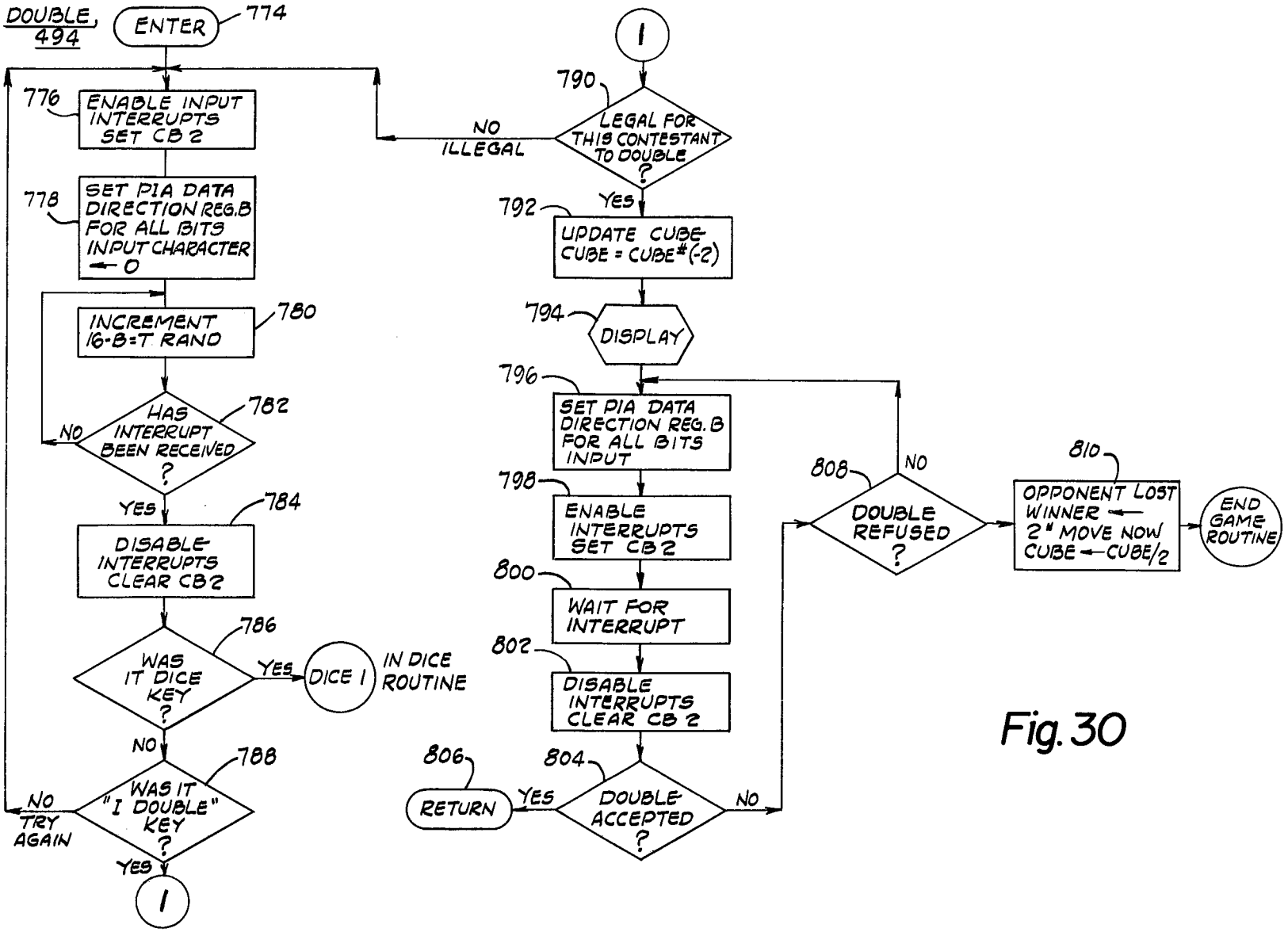

The DOUBLE routine 494 is shown in detail in FIG. 30 and is explained in Table 13.

TABLE 13

| Location | Description |
|---|---|
| 774 | DOUBLE routine entry point. DOUBLE is called by DRIVER to allow a MOVING contestant to DOUBLE if desired. |
| 776 | Interrupts are enabled and the CB2 control output in the PIA is set to one. When CB2 is set, the tristate buffer 63 connected to the outputs of the keyboard encoder 62 is enabled. When interrupts are enabled, a subsequent input from the keyboard 60 causes the processor to execute the INPUT interrupt routine. |
| 778 | The PIA data direction register B is set for all BITS input. Thus, when a switch on the keyboard 60 is PUSHED, the data will be latched into data register B. Set variable CHARACTER to 0. This variable will receive the input when a switch is actuated. |
| 780 | While waiting for the completion of the INPUT routine, the sixteen-bit RAND location is incremented. RAND is incremented approximately 50,000 times per second thus providing a pseudo-random number depending on human response time for keyboard input. |
| 782 | The interrupt has been serviced and a CHARACTER has been translated to an internal numeric code using the CHARACTER-to-NUMERIC translation table. |
| 784 | Interrupts and the tristate buffers are disabled so no keyboard 60 input reaches the PIA 246. |
| 786 | If input was due to actuation of the DICE key then the MOVING contestant does not wish to DOUBLE at this time. Transfer to DIE1 in the DICE routine. |
| 788 | If input was from I-DOUBLE switch 74, MOVING contestant wishes to DOUBLE. Transfer to 790. Otherwise, transfer to 776 because no other inputs are legal at this time. From the standpoint of the contestant, nothing appears on the display. The contestant is expected to actuate the correct key again. |
| 790 | A contestant may DOUBLE only when he owns the CUBE. Contestant A owns the CUBE if it equals any number greater than 0. B owns the CUBE if it equals one or any negative number. If the condition is met, go to 792; otherwise, go to 776. A DOUBLE is illegal for this contestant at this time. There is no |

TABLE 13-continued

| Location | Description |
|---|---|
| | indication on the display. The contestant is expected to HIT the ROLL DICE switch 72 to roll the DICE (i.e., actuate the CHANCE indicators 14). |
| 792 | The CUBE is updated by DOUBLING it and complementing its sign. |
| 794 | Call DISPLAY to show the status of the updated CUBE. Note that all PIPS, STATUS indicators, digits and DICE are updated and displayed but that only the value of the CUBE and CUBE OWNERSHIP has changed. |
| 796 | The PIA data direction register B is set for all BITS input as in block 778. This is necessary because a previous call to DISPLAY set the BITS for output. |
| 798 | Interrupts and the tristate buffer 63 are enabled (explained in block 776). |
| 800 | The processor waits for the interrupt to be processed with an "internal wait." There is no need to generate another pseudo-random number since one was just generated. |
| 802 | The interrupt has been serviced. There is no need to test CHARACTER for nonzero as was done in block 782 because the processor automatically flows into this block when the interrupt has been serviced. Interrupts and the tristate buffer are disabled. |
| 804 | If the I ACCEPT switch 78 was actuated, the game continues and control returns to the DRIVER. If not, go to 808. |
| 806 | Return to DRIVER. |
| 808 | If the I REFUSE switch 76 was pushed, the game is over, go to END GAME routine. Otherwise an illegal switch was operated. Transfer to 796 to enable input again. |
| 810 | The opponent has lost the game. WINNER is set to two times MOVE NOW. This indicates to the END GAME routine that the game was lost by a refused DOUBLE. Control is then transferred to the END GAME routine. |

It will be appreciated that improved electronic game apparatus has been provided. Only valid or legal plays may be input, as these results of illegal plays are automatically erased and previous play values are restored. The game is designed for coupling to a computerized system so that a computer can be an expert contestant against a human challenger.

Although the invention has been described in its preferred form with a certain degree of particularity, it is understood that the present disclosure of the preferred form has been made only by way of example. For example, hard wired logic circuitry could be used to effect many of the operations now performed by the controller 120. An obvious instance of this is the use of a random number generator external to the programmable controller. Numerous other changes in the details of construction and in the combination and arrangement of parts may be resorted to without departing from the spirit and the scope of the invention so hereinafter claimed.

What is claimed is:

1. An electronic backgammon game wherein a contestant enters an instruction for initiating play of the game, comprising:

(a) an illuminated display including pictorial representation of pips of a backgammon board and first, second, and third sets of electrically responsive visual indicators, the first set of visual indicators for manifesting a substantially randomly determined chance value, the second set of visual indicators for indicating the occupancy of a given pip during play of the game, and the third set of indicators for indicating which contestant is to enter the next in sequence play instruction;

(b) input means adapted to be mechanically actuated by the contestant for entering his play instructions; and (c) means coupled to the input means and responsive to the entered play instructions for selectively energizing the first and third sets of indicators to thereby initiate play, said energizing means including means for energizing the first set of indicators to display a substantially random value and for energizing the third set of indicators according to said substantially random value to thereby indicate which contestant is to enter the first play instruction.

2. The electronic backgammon game according to claim 1 wherein said energizing means includes a microprocessor programmed according to the rules of the game of backgammon.

3. The electronic backgammon game according to claim 2 wherein said energizing means includes a memory which stores the previous occupancy states of the pips during the entry of subsequent play instructions, and wherein said energizing means is responsive to actuation of the input means for selectively energizing the second set of visual indicators to indicate said previous occupancy state of at least one of the pips.

4. The electronic backgammon game according to claim 3 wherein the play instruction entry means includes an encoder for encoding each of the play instructions to provide an encoded instruction, and the energizing means further include decoder means for decoding the encoded instructions and for energizing selected ones of the indicators.

5. The electronic backgammon game according to claim 3 and further including a fourth set of visual indicators operatively responsive to said energizing means for indicating when one of the constestants has won the game of backgammon and play is terminated.

6. The electronic backgammon game according to claim 3 wherein said input means includes a manually actuable switch for conditioning said energizing means to effect energization of the second set of visual indicators for indicating the previous occupancy state of one of the pips.

7. The electronic backgammon game according to claim 6 wherein said input means includes an encoder for encoding each of the play instructions to provide an encoded instruction, and the energizing means includes decoder means for decoding each of the encoded instructions and operating selected ones of the indicators.

8. An electronic board game comprising:

(a) a playing board having a plurality of game positions;

(b) first illumination means for displaying at each of said positions a number of game pieces for each player of the game; and (c) electronic control circuitry means to move a game piece of one player from an initial position to a final position, to move a game piece of another player on said final position to a predetermined position if said another player has only one game piece on said final position to keep the one game piece in play, and to detect a number of game pieces of said another player on said final position when the one player is attempting to move a game piece and prevent the game piece of the one player from moving from said initial position to said final position when there are plural game pieces of said another player on said final position.

9. An electronic game having a plurality of game positions and a plurality of game pieces which selectively occupy the game positions, comprising:

(a) illumination means depicting the game positions and for displaying at each of said positions a number of game pieces for each player of the game; and (b) electronic control circuitry means to move a game piece of one player from an initial position to a final position, to move a game piece of another player on said final position to a predetermined position if said another player has only one game piece on said final position to keep the one game piece in play, and to detect a number of game pieces of said another player on said final position when the one player is attempting to move a game piece and prevent the game piece of the one player from moving from said initial position to said final position when there are plural game pieces of said another player on said final position.

10. An electronic game having a plurality of game pieces and a plurality of game positions which the game pieces selectively occupy, comprising:

(a) illumination means for displaying the number of game pieces at each of said positions for each player of the game; and (b) electronic control circuitry means to control movement of a game piece of one player from an initial position to a final position, to control movement of another player's game piece from said final position to a predetermined position if said another player has only one game piece on said final position thereby to keep the one game piece in play, and to detect a number of game pieces of said another player on said final position when the one player is attempting to move a game piece and prevent the game piece of the one player from moving from said initial position to said final position when there are plural game pieces of said another player on said final position.

11. An electronic backgammon game wherein a contestant enters an instruction for initiating play of the game, comprising:

(a) an illuminated display including pictorial representation of pips of a backgammon board and including electrically responsive visual indicators for manifesting a substantially randomly determined chance value, for indicating the occupancy of a given pip during play of the game, and for indicating which contestant is to enter the next in sequence play instruction;

(b) input means adapted to be mechanically actuated by the contestant for entering his play instructions; and (c) means coupled to the input means and responsive to the entered play instructions for selectively energizing the visual indicators to thereby initiate play, said energizing means including means for energizing the indicators to display a substantially random value and for energizing the indicators according to said substantially random value to thereby indicate which contestant is to enter the first play instruction.

12. An electronic backgammon game having representations of pips of a backgammon board wherein a contestant enters an instruction for initiating play of the game, comprising:

(a) an illuminated display including at least one set of electrically responsive visual indicators for manifesting a substantially randomly determined chance value, for indicating the occupancy of a given pip during play of the game, and for indicating which contestant is to enter the next in sequence play instruction;

(b) input means adapted to be actuated by the contestant for entering his play instructions; and (c) means coupled to the input means and responsive to the entered play instructions for selectively energizing the at least one set of indicators to thereby initiate play, said energizing means including means for energizing the indicators to display a substantially random value and for energizing the indicators according to said substantially random value to thereby indicate which contestant is to enter the first play instruciton.

13. A game for playing backgammon electronically, comprising:

(a) a playing board having a plurality of game positions and having first light emitting means for representing, when energized, the positions of men for each player;

(b) memory means for storing signals corresponding to the number of men of each player at each of said positions;

(c) means, connected to said memory means, for energizing said first light emitting means;

(d) means, connected to said memory means, for controlling movement of a man from an initial position to a final position and for updating said memory means to store new signals as a result of the move; and (e) means, responsive to said stored signals, for preventing a move from occurring if the final position to which one player wants to move a man has a certain number of men of the other player.

* * * * *

UNITED STATES PATENT AND TRADEMARK OFFICE

CERTIFICATE OF CORRECTION

PATENT NO. : 4,223,893

DATED : September 23, 1980

INVENTOR(S) : Tim A. Shane et al.

It is certified that error appears in the above-identified patent and that said Letters Patent are hereby corrected as shown below:

In the Abstract, lines 7 and 8, "manifest" should be --manifests--;
line 15, insert --play-- after the word "first";
Column 10, line 38, "foreiture" should be --forfeiture--;
line 43, "shown" should be --show--;
Column 13, line 68, delete "172,";
Column 16, line 28, "one-input" should be --one-output--;
line 67, "11" should be --11--;
line 68, "11" should be --11--;
Column 17, line 7, "storate" should be --storage--;
line 11, "912" should be --192--;
line 34, "253" should be --254--;
Column 19, line 33, "intervace" should be --interface--;
Column 26, line 18, "locaation" should be --location--;
Column 27, Table 3, under the column "Bits On", Digit 5 should be changed from "1, 3, 4, 5, 6, 7" to --1, 3, 4, 6, 7--;
Column 32, line 29, "48" should be --480--;
Column 33, line 50, "coped" should be --copied--;
Column 34, line 25, "is" should be --if--;
Column 44, Table 12, line 4, "1" (second occurrence) should be -- -1 --;

Signed and Sealed this

Nineteenth Day of January 1982

[SEAL]

Attest:

GERALD J. MOSSINGHOFF

Attesting Officer

Commissioner of Patents and Trademarks